United States Patent [19]

Inouye et al.

[11] Patent Number: 4,858,528

[45] Date of Patent: Aug. 22, 1989

[54] PRINTING PRESS AND CONTROL METHOD OF PLATE FEEDING OPERATION

[75] Inventors: Yoshinori Inouye, Ohtsu; Yoshihiko Osawa; Minoru Ueda, both of Koga, all of Japan

[73] Assignee: Toray Industries, Inc., Tokyo, Japan

[21] Appl. No.: 902,423

[22] Filed: Aug. 28, 1986

[30] Foreign Application Priority Data

Sep. 13, 1985 [JP] Japan ..... 60-203611

[51] Int. Cl.[4] ..... B41F 7/08; B41F 27/06

[52] U.S. Cl. ..... 101/175; 101/484; 101/485; 101/415.1; 101/177

[58] Field of Search ..... 101/142, 144, 145, 143, 101/409–411, 415.1, 233, 234, 216, 132, 136, 232, 137, 138, 140, 141, 175, 177, 176–182; 271/265, 258, 259

[56] References Cited

U.S. PATENT DOCUMENTS

| | | | |
|---|---|---|---|
| 3,451,336 | 6/1969 | Mignone | 101/132.5 |
| 3,719,142 | 3/1973 | Abe | 101/216 |
| 3,858,508 | 1/1975 | Kaneko et al. | 101/132 |
| 3,871,294 | 3/1975 | Kagari et al. | 101/142 X |
| 4,150,621 | 4/1979 | Raible | 101/207 |
| 4,328,749 | 5/1982 | Inouye et al. | 101/142 X |
| 4,459,913 | 7/1984 | Kowalik | 101/409 |

*Primary Examiner*—J. Reed Fisher

*Attorney, Agent, or Firm*—Lowe, Price, LeBlanc, Becker & Shur

[57] ABSTRACT

A printing plate (50) is provided with a plurality of positioning holes (50*d*) at the head portion (50*a*) on the basis of at least two cross sides (51*a*, 51*b*) of the printing plate (50). The printing plate (50) is delivered towards the plate cylinder (3) by the predetermined distance on the basis of two cross sides (51*a*, 51*b*) in relation to the rotation of the plate cylinder (3) so that each positioning holes (50*d*) can be engaged with the corresponding positioning pins (315) of the plate cylinder (3). This allows the printing plate (50) to be automatically and accurately mounted onto the designated position of the plate cylinder (3).

13 Claims, 47 Drawing Sheets

PRINTING PRESS AND CONTROL METHOD OF PLATE FEEDING OPERATION

BACKGROUND OF THE INVENTION

1. Field of the Invention

The present invention relates to a printing press and a control method of plate feeding operation of the same, more particularly, to a printing press and a control method capable of accurately mounting a printing plate onto predetermined position of a plate cylinder.

2. Description of the Prior Arts

Generally, any conventional printing press obliges operators to manually mount a printing plate onto a plate cylinder, thus it is difficult to mount the printing plate onto the plate cylinder. To simplify the plate-mounting process, a variety of printing presses capable of automatically mounting printing plates onto the plate cylinder have been developed. Nevertheless, any of these printing presses still involves difficulty for accurately mounting printing plates onto the predetermined positions of the plate cylinder.

SUMMARY OF THE INVENTION

The invention provides a novel printing press and a control method of plate feeding operation of the same capable of automatically mounting a printing plate onto a plate cylinder.

The printing press reflecting the preferred embodiments of the present invention is provided with a plate cylinder, a plurality of register pins set to the plate cylinder, a plate-cylinder driving mechanism that drives the plate cylinder via rotation, and a plate-forwarding mechanism. The plate forwarding mechanism delivers a printing plate having a plurality of register holes at the head portion on the basis of at least two cross sides of th printing plate towards the plate cylinder by the predetermined distance on the basis of two cross sides in relation to the rotation of the plate cylinder so that the register holes can be engaged with the register pins.

The control method of plate feeding operation of the printing press reflecting the preferred embodiments of the present invention comprises an activate step, a forward step and an engage step. In this case, a printing plate is provided with a plurality of register holes at the head portion on the basis of at least two cross sides itself. An activate step is needed for activating plate feeding operation at the predetermined rotational position of a plate cylinder. A forward step is needed for forwarding the printing plate toward the plate cylinder on the basis of said two cross sides by the predetermined distance in relation to the rotation of the plate cylinder. And an engage step is needed for engaging register holes with a plurality of the register pins set to the plate cylinder at the time the printing plate is forwarded by the determined distance.

Therefore, the primary object of the present invention is to provide a printing press and a control method of plate feeding operation of the same capable of automatically feeding the printing plate to the plate cylinder before accurately mounting it onto the plate cylinder.

According to the present invention, a novel printing press and a control method of plate feeding operation of the same are provided, which allows the printing plate having register holes at the head portion on the basis of at least two cross sides of the printing plate to be forwarded towards the plate cylinder by the predetermined distance on the basis of two cross sides so that the register holes can be accurately engaged with the register pins, thus allowing the printing press related to the present invention to automatically feed the printing plate and accurately mount the printing plate onto the plate cylinder.

These and other objects, features, aspects and advantages of the present invention will become more apparent from the following detailed description of the present invention when taken in conjunction with the accompanying drawings.

BRIEF DESCRIPTION OF THE DRAWINGS

FIG. 9 (*b*) is an enlarged diagram concerning a part of FIG. 9 (*a*);

FIGS. 27 (*b*), (*c*) and (*d*) respectively explain the operations of the mechanism for detecting deviated and/or clamped plate;

FIG. 20 is a sectional view of the plate cylinder;

DESCRIPTION OF THE PREFERRED EMBODIMENTS

A. Entire Structure

Figure 1:
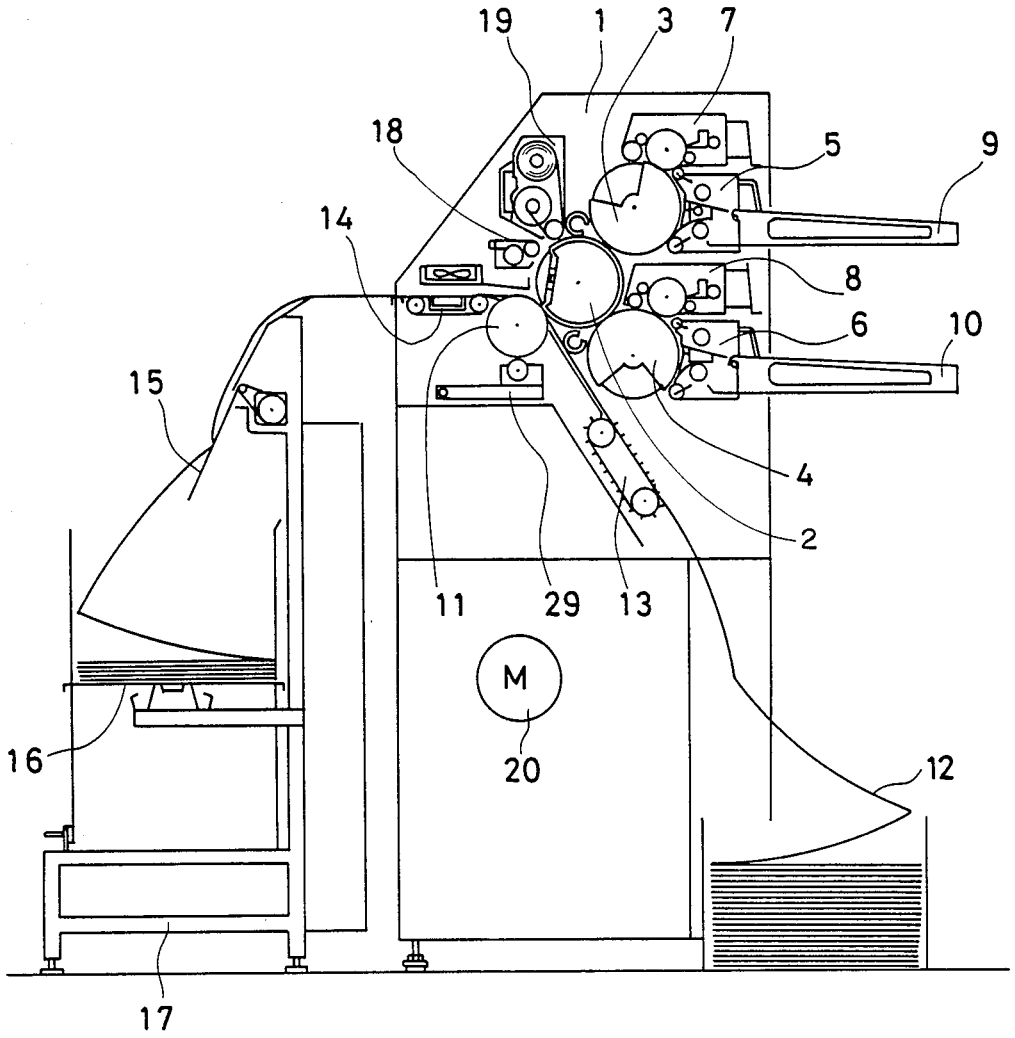
FIG. 1 is a sectional view denoting simplified block diagram of a printing press reflecting one of the preferred embodiments of the present invention.

FIG. 1 is a schematic sectional view showing a multicolor offset printing press to which an apparatus for intermittently feeding continuous paper according to the present invention is applied for enabling printing on the continuous paper. As shown in FIG. 1, a blanket cylinder 2 is arranged substantially in a central position of a printing press body 1, and plate cylinders 3 and 4 are contactably arranged at the back of upper and lower portions of the blanket cylinder 2. Detachably mounted on backward positions of the plate cylinders 3 and 4 are plate feeding/discharging units 5 and 6 for enabling automatic plate feeding to/discharging from corresponding ones of the plate cylinders 3 and 4 and inking units 7 and 8 for inking plates wound around corresponding ones of the plate cylinders 3 and 4, while plate feeding/discharging trays 9 and 10 are detachably mounted on the plate feeding/discharging units 5 and 6 respectively.

On the other hand, an impression cylinder 11 is arranged in front of the lower portion of the blanket cylinder 2 to be in contact with/separated from the blanket cylinder 2, and a pin feed tractor 13 and a suction conveyor 14 are arranged in front and at the back of the lower portion of the impression cylinder 11 respectively to control feeding of continuous paper 12 inserted between the impression cylinder 11 and the blanket cylinder 2. The pin feed tractor 13 and the suction conveyor 14 are adapted to control intermittent feeding of the continuous paper 12 in relation to the timing of contact/separation of the impression cylinder 11 and the blanket cylinder 2, for performing printing on the continuous paper 12. Provided in front of the printing press body 1 is a folder 17 having a swing guide 15 and a delivery table 16 for alternately folding the printed continuous paper 12 and receiving the same.

Detachably mounted on an upper front position of the blanket cylinder 2 are a detergent solution feeding unit 18 for feeding a detergent solution to the blanket cylinder 2 and a wiping unit 19 for wiping out the detergent solution respectively. Further, an impression cylinder cleaning unit 29 is arranged under the impression cylinder 11 for cleaning the surface thereof.

A main motor 29 is provided in a lower space of the printing press body 1 to drive the blanket cylinder 2 and the suction conveyor 14 through, e.g., belts while the blanket cylinder 2, the plate cylinders 3 and 4 and the impression cylinder 11 are mechanically interlocked by gears arranged to be engaged at single end portions of the said cylinders, to form a driving system through the main motor 20. Driving units or actuators such as pulse motors and solenoids are mounted on the remaining mechanical portion at need, and sensors and switches are appropriately mounted on prescribed portions as data input means for controlling driving timing for the driving system.

Figure 2:
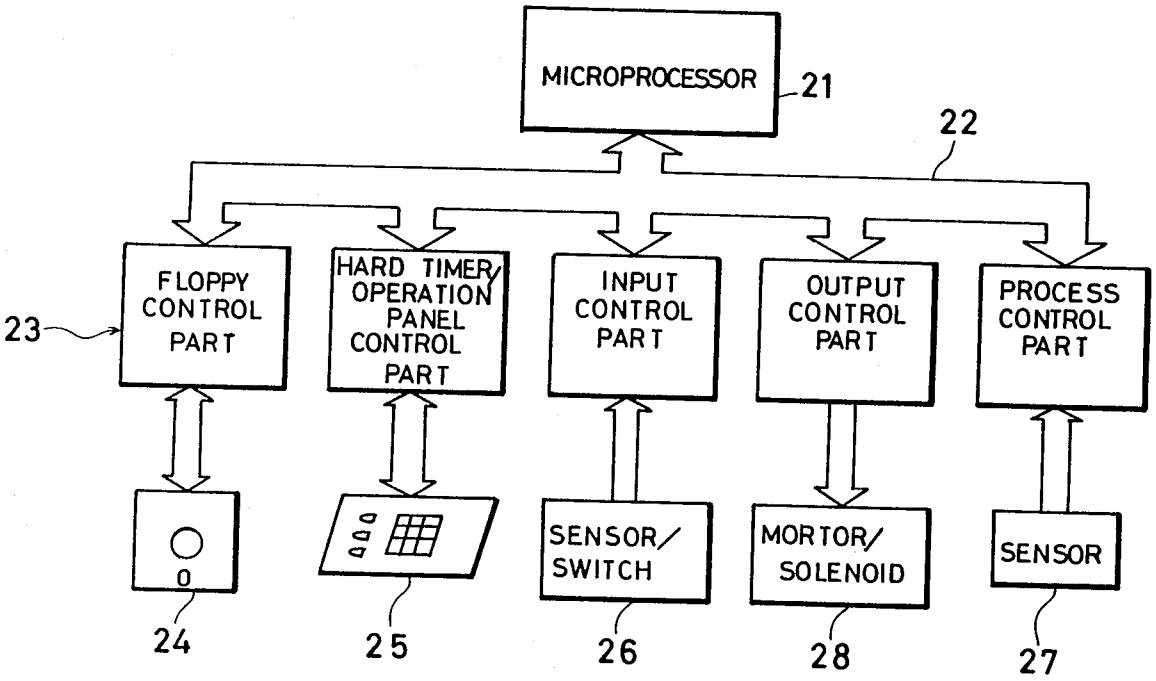
FIG. 2 is a simplified block diagram of a control system controlling the operation of the printing press shown in FIG. 1.

FIG. 2 schematically shows a control system employed in the printing press, in which a microprocessor 21 is connected with external units 24 to 28 through a control bus 22 and respectively control parts 23. A system program is stored in an external memory unit 24 such as a floppy disk, to be supplied to the microprocessor 21 for starting the system. An operator supplies a command through an operation panel 25 provided on the side portion of the printing press body 1 for example, so that the microprocessor 21 fetches required data from sensor/switch means 26 and sensor 27 to appropriately drive a driving system 28 formed by motors, solenoids and the like in accordance with the system program.

Next, constitution and operation related to the plate feeding and discharging unit are described below.

Figure 3:
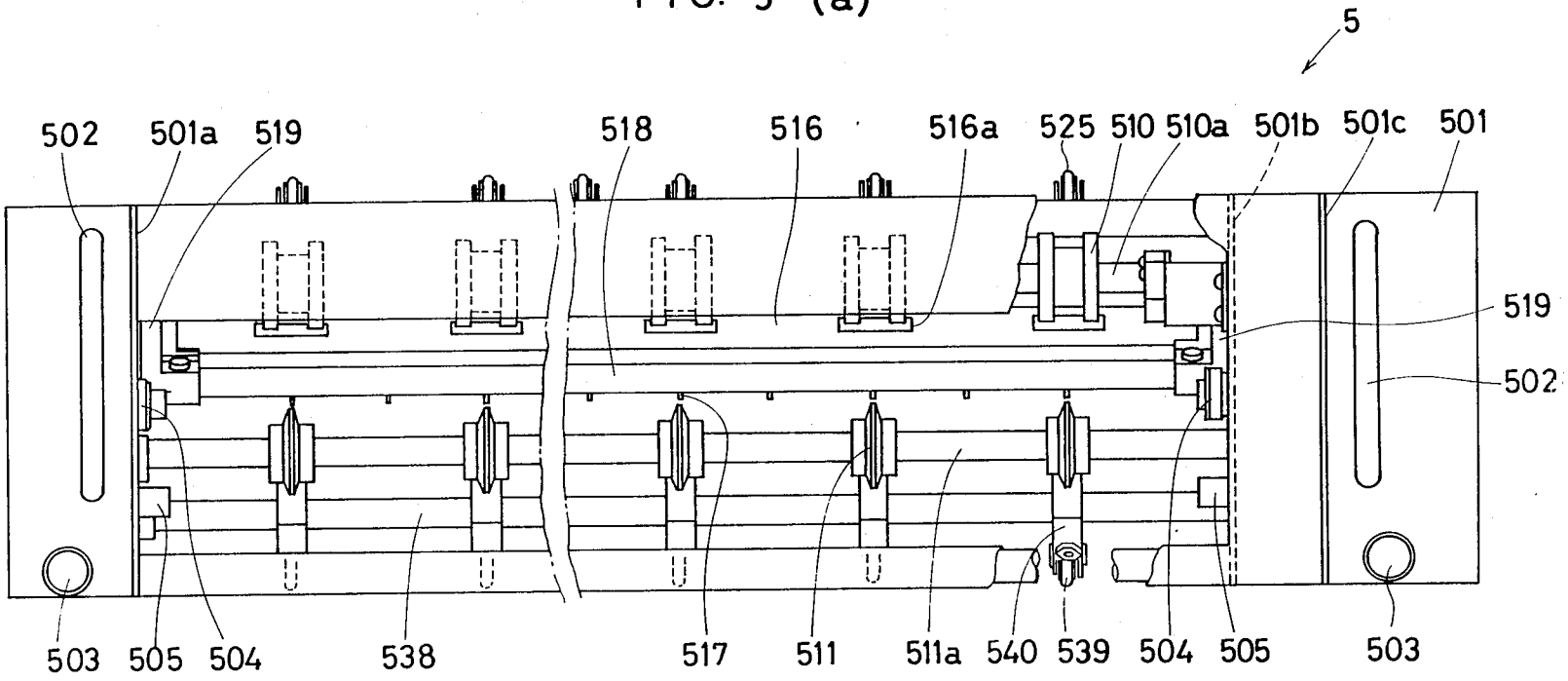
FIG. 3 is a diagram denoting the constitution of a plate feeding/discharging unit.
Figure 3:
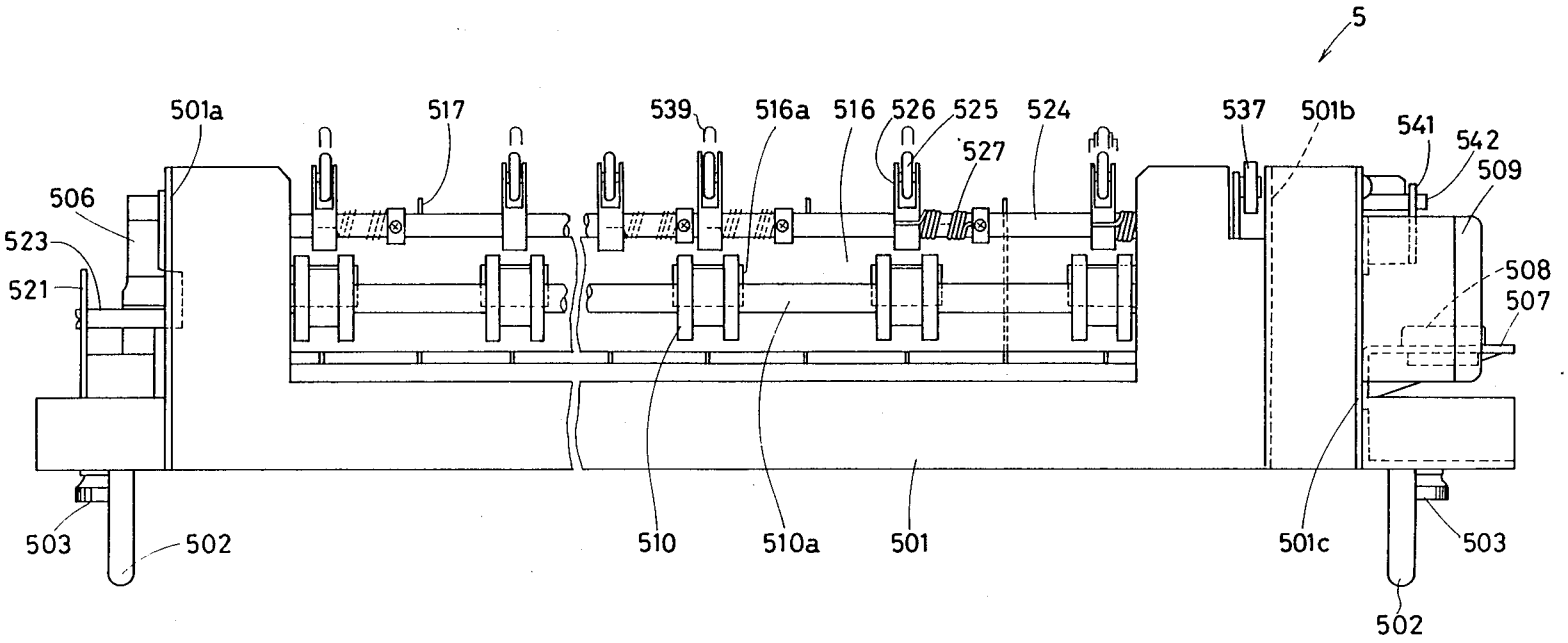
Figure 3:
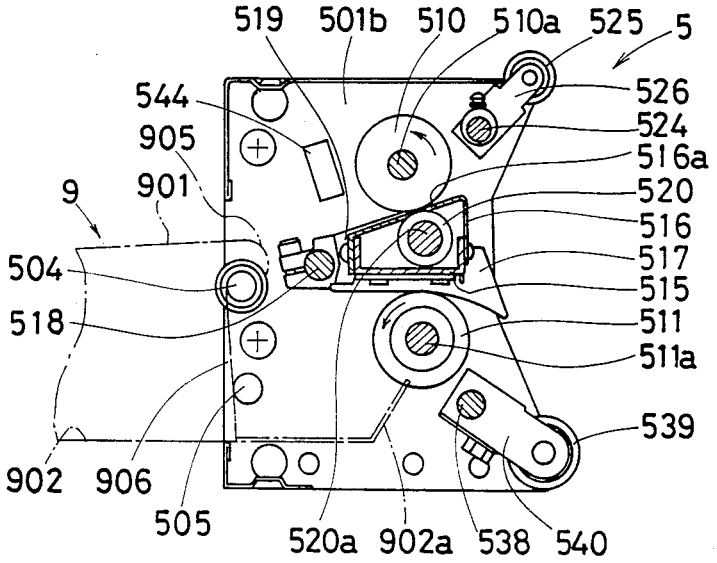
Figure 3:
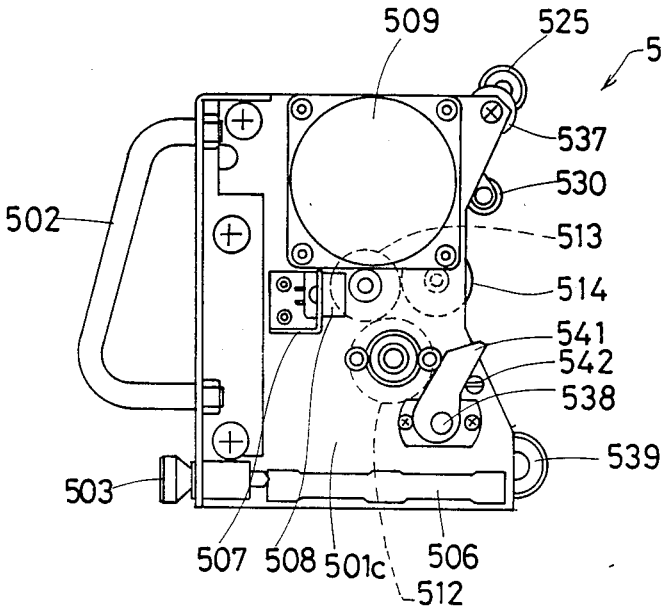
Figure 3:
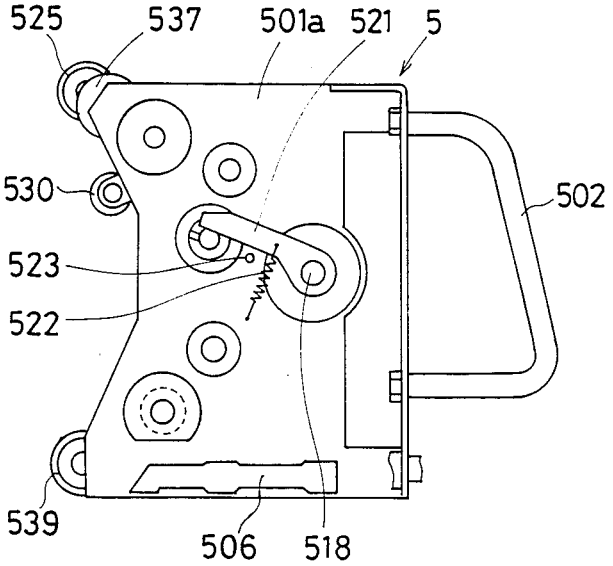

B. Plate feeding and discharging mechanism (1) Constitution and installation of a plate-feeding-/discharging unit (I) Constitution of a plate feeding/discharging unit FIG. 3 denotes a plate-feeding/discharging unit. FIG. 3 (*a*) is the front view of the plate feeding/discharging unit. FIG. 3 (*b*) is a plain view, (*c*) is a sectional view, (*d*) is a right lateral view, and (*e*) is a left lateral view, respectively.

The plate feedig/discharging unit 5 is provided with a unit-frame 501 having frame constitution, while this unit-frame 501 is provided with handles 502 and unit-securing screws 503 on both sides of a front surface. In addition, the unit-frame 501 is also provided with left-side board 501*a* and right-partition board 501*b*, which are respectively provided with an engaging pin 504 and a positioning pin 505 for mounting a plate feeding/discharging tray 9 shown in FIG. 1. Unit-installation rails 506 are respectively set to the bottom part of external lateral surfaces of the left-side board 501*a* and the right-side board 501*c*. The external surface of the right-side board 501*c* are provided with connector 508 via installation metal 507 and pulse motor 509 for activating plate-feeding operation, while the pulse motor 509 and the connector 508 are electrically connected to each other via cables (not shown).

The plate-feeding driving rollers 510 and the plate-discharging driving rollers 511 are installed between the left-side board 501*b* and the right-partition board 501*a* of the unit-frame 501. A right end of a roller shaft 510*a* of the plate-feeding driving roller 510 is connected to said pulse motor 509 via shaft-coupling means (not shown). When activating the plate-feeding operation, the plate-feeding driving rollers 510 are driven by said pulse motor 509 so that it rotates counterclockwise as shown in FIG. 3 (*c*). A right-end of shaft 511*a* of the plate-discharging driving rollers 511 extends itself to a position between the right-partition board 501*b* and the right-side board 501c, while a gear 512 shown in FIG. 3 (*d*) is installed to the extended right-end of shaft 511a. The gear 512 is connected to driving gear 514 via gear 513 installed between the right-partition board 501b and the right-side board 501c. The driving gear 514 engages with a plate-cylinder gear 301 shown in FIG. 9(*a*) when a plate-feeding/discharging unit 5 is installed to the printing press body 1, thus allowing the plate-discharging driving rollers 511 to rotate counterclockwise as shown in FIG. 3(*c*) in accordance with the rotation of a plate cylinder 3 while feeding or discharging plate.

A supporting metal 515 is set between the left-side board 501a and the right-partition board 501b in the area between the plate-feeding driving rollers 510 and the plate-discharging driving rollers 511. The plate-feeding start-up board 516 is mounted onto the upper surface of the supporting metal 515, whereas a plate-discharging guide 517 is set to the bottom surface of the supporting metal 515. The plate-feeding start-up board 516 is provided with apertures 516a that allow passage of the incoming and outgoing plate-feeding driving rollers 510 in the position corresponding to these driving rollers 510.

A driving shaft 518 capable of freely rotating itself is installed between the left-side board 501a and the right-partition board 501b in front of the plate-feeding start-up board 516. Supporting arms 519 are set to both ends of the driving shaft 518, whereas auxiliary plate-feeding driving rollers 520 capable of freely rotating themselves are installed between the tip-ends of these supporting arms 519. Operation lever 521 is installed to the left-end of the driving shaft 518 as shown in FIG. 3 (*e*). When the operation lever 521 is operated for causing the supporting arms 519 to be rotated in the clockwise or counterclockwise direction pivoting the driving shaft 518, the auxiliary plate-feeding driving rollers 520 are then driven so that these either come into contact with or depart from the plate-feeding driving roller 510 via apertures 516a which allows the incoming and outgoing movement of the auxiliary plate-feeding driving rollers 520. The operation lever 521 is energized by a spring 522 shown in FIG. 3 (*e*) so that the operation lever itself can rotate counterclockwise. More particularly, the auxiliary plate-feeding driving rollers 520 are rotated in the direction of departing from the plate-feeding driving rollers 510. The rotary movement of the operation lever 521 is eventually stopped by stopper pin 523 on the external surface of the left-side board 501a, and as a result, the movement of the operation lever 521 is effectively regulated. The operation lever 521 is driven in conjunction with the activated operation of solenoid (to be described later on) provided for the printing press body 1. When this solenoid is activated, the operation lever 521 causes the auxiliary plate-feeding driving rollers 520 to come into contact with the plate-feeding driving rollers 510 so that a printing plate can securely be nipped by the driving rollers 510 and 520 to eventually allow the plate-feeding operation to be started. The auxiliary plate-feeding driving rollers 520 cause gear (not shown) set to the left end of own shaft 520a to be engaged with gear (not shown) set to the left end of the plate-feeding driving roller shaft 510a. As a result, when the plate-feeding driving rollers 510 are rotated counterclockwise as shown in FIG. 3 (*c*) while the plate feeding operation is underway, the auxiliary plate-feeding driving rollers 520 are driven clockwise at the same rotating speed as that of the plate-feeding driving roller 510 to eventually allow the printing plate nipped between the both rollers 510 and 520 to be forwarded in the direction of the plate cylinder, i.e., to the right of FIG. 3 (*c*).

A rotary shaft 524 capable of freely rotating itself is set to the upper rear portion of the unit-frame 501 and between the left-side board 501a and the right-partition board 501b. A roller-supporting arm 526 latching plate-holding rollers 525 is installed to a rotary shaft 524. The roller supporting arm 526 is energized by torsion coil spring 527 shown in FIG. 3 (*b*) set to the rotary shaft 524 so that the roller supporting arm 526 can be rotated clockwise, i.e., in the direction of pressing the printing plate, while the clockwise rotation of the roller supporting arm 526 is regulated by a stopper mechanism (not shown) at an adequate position.

Figure 4:
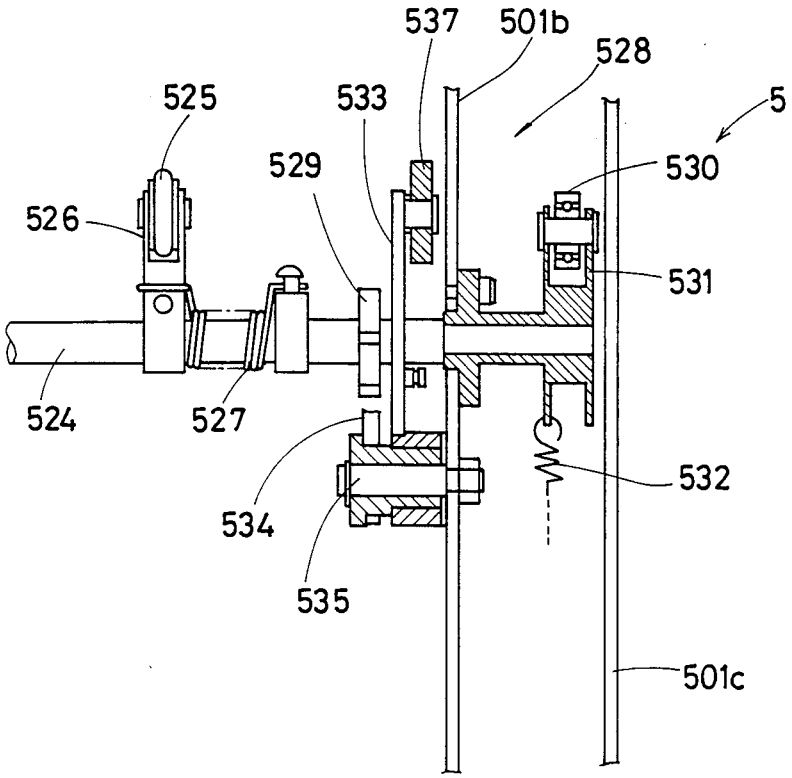
FIG. 4 is a simplified diagram denoting the constitution of the lock mechanism of a plate holding rollers.
Figure 4:
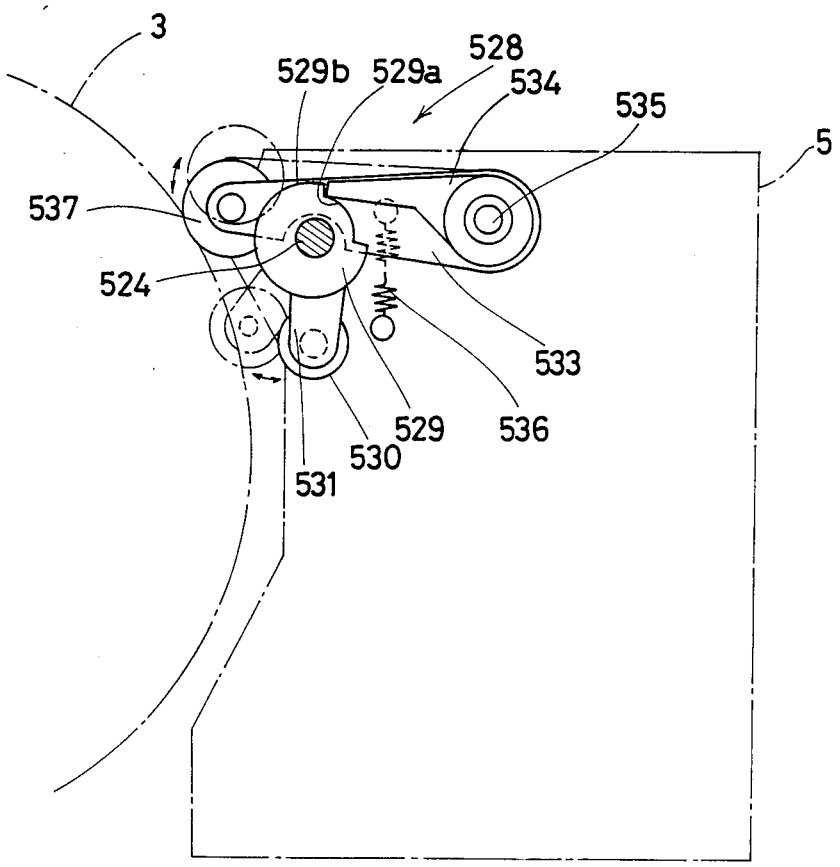

A locking mechanism 528 locking the plate-holding rollers 525 at the designated plate-holding position is installed to the right-end of the rotary shaft 524 as shown in FIG. 4(*a*). The locking mechanism 528 secures the latchet wheel 529 having coupling concave 529a along the external circumference of the wheel to the rotary shaft 524. Likewise, the locking mechanism 528 secures the plate-holding activation arm 531 to the rotary shaft 524. The plate-holding activation arm 531 freely rotates itself in the range designated by broken line and solid line shown in FIG. 4 (*b*). In addition, the plate-holding activation arm 531 is energized by spring 532 shown in FIG. 4 (*a*) so that it can rotate clockwise as shown in FIG. 4 (*b*). When the arm 531 rotates clockwise, it causes the plate-holding roller 525 to leave the plate cylinder 3 via the rotary shaft 524. On the other hand, an unlocking arm 533 provided with an unlocking roller 537 at its tip end and a latchet 534 are secured to shaft 535 set to the right-partition board 501b in the state of integrally being connected to each other so that the integrated unit can freely rotate itself and be rotated counterclockwise by the force energized by a spring 536 as shown in FIG. 4 (*b*). As a result, the tip end of the latchet 534 is pressed against a specific area ranging from the external circumference 529b of the latchet wheel 529 to the concave 529a so that the tip end of the latchet 534 can freely slide inside of this area.

Next, operation of the locking mevchanism 528 is described below. When the plate-holding activation roller 530 is rotated in the counterclockwise direction (see FIG. 4(*b*)) by the plate-holding roller cam 356 shown in FIG. 18 (details will be described later on) set to the plate cylinder 3, the rotary shaft 524 also rotates counterclockwise, thus allowing the plate-holding rollers 525 to be set to the designated plate-holding position. Simultaneously, the latchet wheel 529 also rotates counterclockwise, thus causing the tip end of latchet 534 to move from the external circumference 529b of the latchet wheel 529 to the concave 529a. When the tip end of latchet 534 reaches the concave 529a, due to energized force given by spring 536, the tip end of the latchet 534 falls into the concave 529a to stop its movement. As a result, the latchet wheel 529 is prevented from rotating clockwise by the energized force from the spring 532, and thus the plate-holding roller 525 is latched at the plate-holding position. The locked mechanism is released when an unlocking cam 306 (see FIG. 20(*b*)) set to the plate cylinder 3 kicks an unlocking roller 537 upwards. When the unlocking roller 537 is kicked upwards, the unlocking arm 533 rotates clockwise pivoting the shaft 535 as shown in FIG. 4 (*b*). This causes the latchet 534 to also rotate clockwise to disengage the latchet 534 from the concave 529a. As a result, due to the energized force from the spring 532, the latchet wheel 529 rotates clockwise together with the rotary shaft 524 and the plate-holding activation arm 531 as shown in FIG. 4 (*b*), thus allowing the plate-holding rollers 525 to return to the original position apart from the plate cylinder 3.

Referring again to FIG. 3, a rotary shaft 538 capable of freely rotating itself is installed to a specific position between the left-side board 501*a* and the right-partition board 501*b* in the lower rear end of the unit-frame 501. A supporting arm 540 that latches the plate-holding rollers 539 are secured to the rotary shaft 538. Due to the energized force from spring means (not shown), the rotary shaft 538 is compulsorily moved in the clockwise direction, i.e., in the direction in which the plate-holding rollers 539 leave the plate cylinder 3 as shown in FIG. 3 (*c*). An operation lever 541 is installed to the right end of the rotary shaft 538 as shown in FIG. 3 (*d*). A stopper pin 542 constraining the clockwise rotation of the operation lever 541 is installed to the external surface of the right-side board 501*c*. When the operation lever 541 is held by the stopper pin 542, the plate-holding rollers 539 are in a position apart from the plate cylinder 3. In conjunction with the activation of solenoid (to be described later on) provided for the printing press body 1, the operation lever 541 is rotated counterclockwise as shown in FIG. 3 (*d*) before eventually being set to a rotating position where the operation lever 541 correctly presses the plate-holding rollers 539 against the plate cylinder 3.

In addition, a sensor 544 for detecting the presence of the printing plate is installed to the upper part of the supporting arm 519 as shown in FIG. 3 (*c*), while the sensor 544 is substantially made of reflective photoelectric sensor means.

Figure 5:
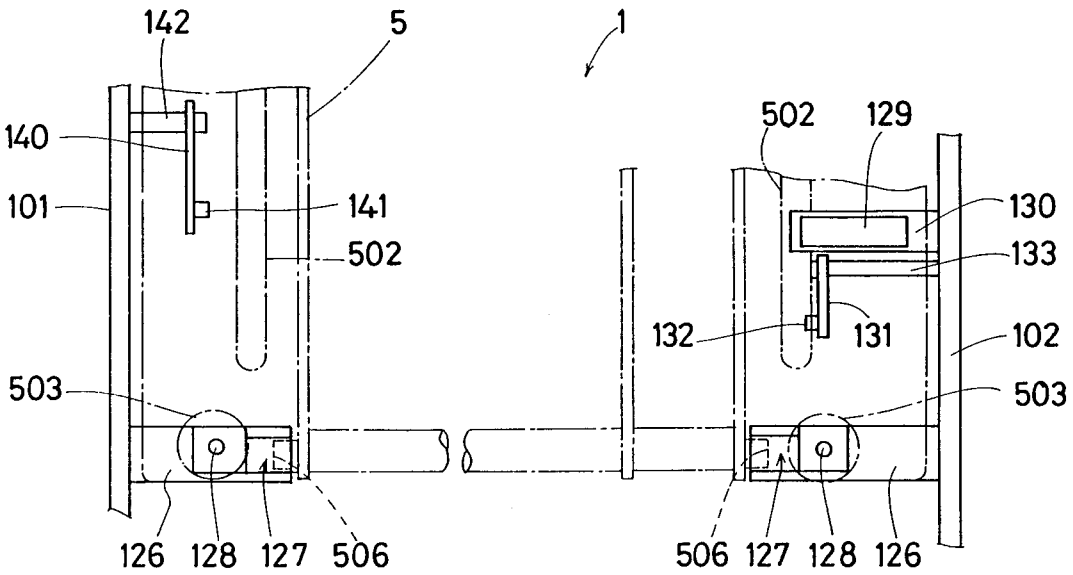
FIG. 5 is a simplified block diagram denoting the condition of the plate feeding/discharging unit mounted onto the printing press.
Figure 5:
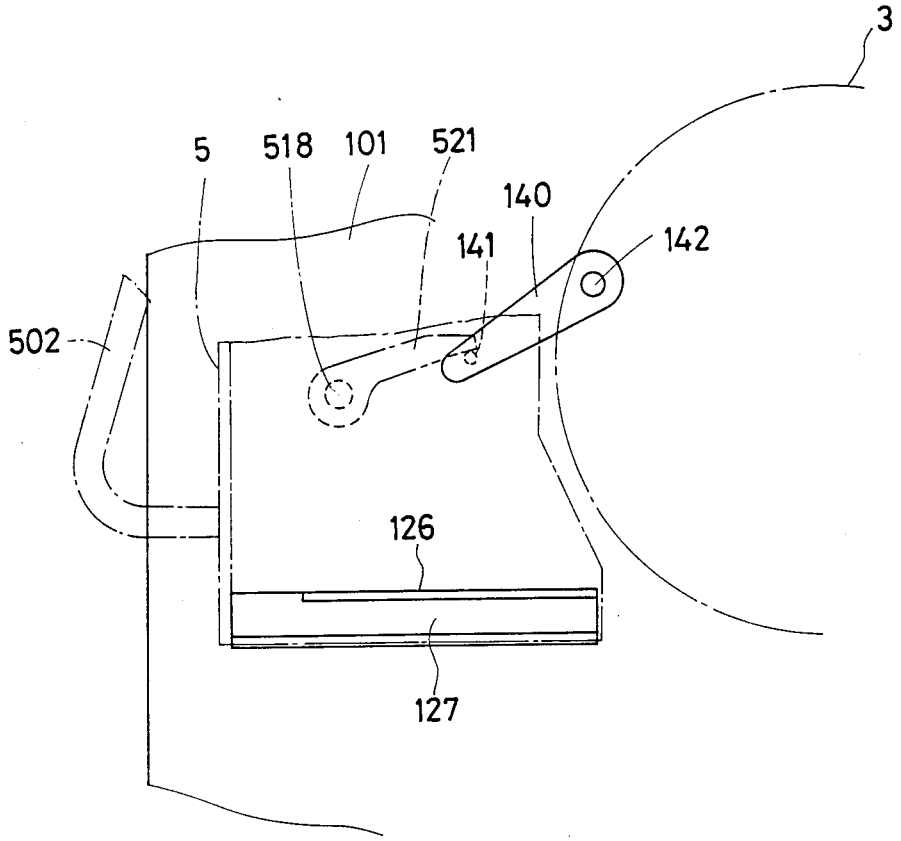

(II) Constitution of component parts allowing installation of the plate feeding/discharging unit Next, a constitution of the component parts allowint the installation of the plate feeding/discharging unit 5 is described below. FIG. 5 (*a*) is a diagram denoting the rear constitution of the printing press body 1, whereas FIG. 5 (*b*) is the internal constitution of the left-side board 101 shown in FIG. 5 (*a*).

As shown here, a pair of the rail-receiving members 126 are secured to the internal surfaces of the left-side board 101 and the right-side board 102. The internal surfaces of the rail-receiving members 126 are respectively provided with rail-coupling grooves 127 which horizontally extend themselves from the back portion of the printing press towards the portion of this printing press. Screw holes 128 are provided for the front surface of these rail-receiving members 126.

A connector 129 is set to the right-side board 102 via a fixing metal 130 in the upper front position of the right-side rail-receiving member 126. The connector 129 is connected to microprocessor 21 via the control parts 23 shown in FIG. 2.

Figure 7:
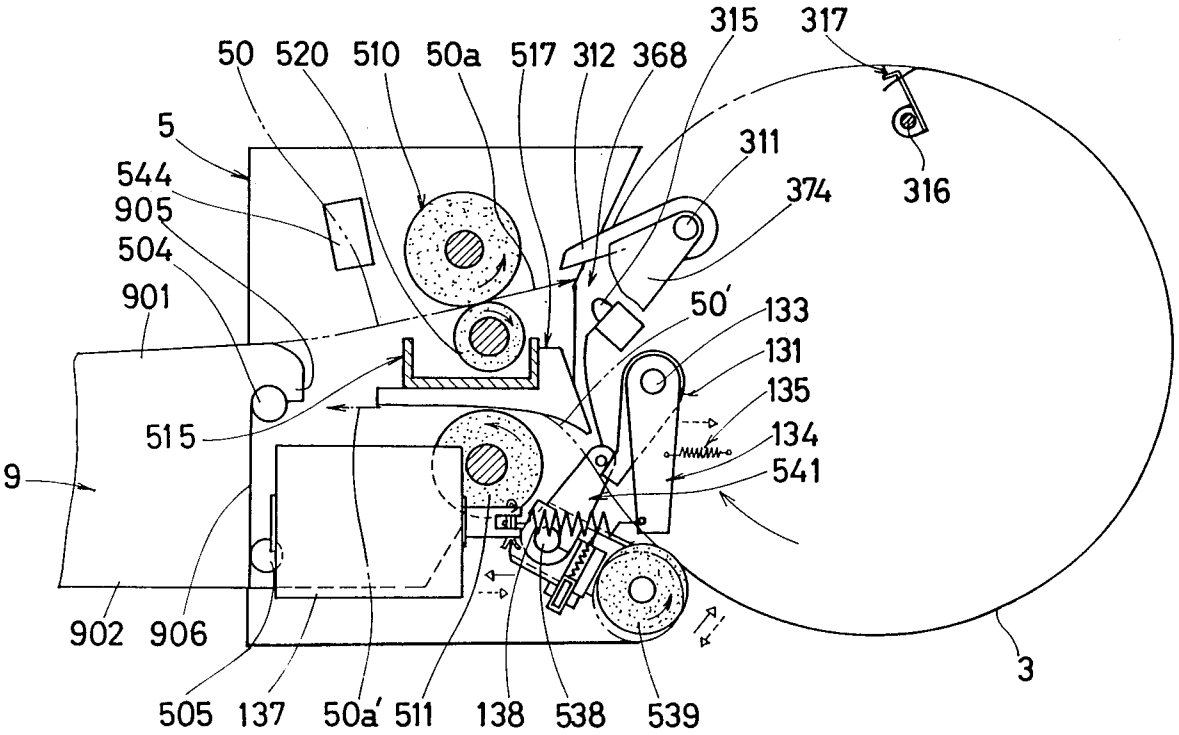
FIG. 7 explains a plate-discharging operation.

A driver lever 131 is provided in the upper rear position of the right-side rail-receiving member 126 for allowing the discharged plate-holding roller 539 to come into contact and depart from the plate cylinder 3. The tip end of the driver lever 131 is provided with a coupling pin 132 to be engaged with the operation lever 541 (shown in FIG. 3 (*d*) ) of the plate feeding/discharging unit 5, while the driver lever 131 is secured to the driving shaft 133 which is installed to the right-side board 102 and capable of freely rotating itself. The right end of this driving shaft 133 extends to the external portion of the right-side board 102, while the right end of this shaft 133 is provided with a lever 134 shown in FIG. 7 (illustration of the right-side board is deleted here). A spring 135 that energizes the lever 134 for rotating in the counterclockwise direction (see FIG. 7) is set between one end of the lever 134 and the right-side board (not shown in FIG. 7). In addition, to rotate the lever 134 in the clockwise direction, a solenoid 137 is installed to the right-side board (not shown). The solenoid 137 and the lever 134 are respectively connected to each other via a spring 138. When the power is fed to this solenoid 137, the lever 134 is driven so that it rotates in the clockwise direction as shown in FIG. 7, thus causing the lever 131 to also rotate clockwise before eventually being set to the predetermined rotating position for activating operation of the operation lever 541 of the plate feeding/discharging unit 5. When the power is OFF from the solenoid 137, energized force from the spring 135 causes the lever 134 to rotate counterclockwise for returning to the original position. As a result, the driver lever 131 also rotates counterclockwise to return to the predetermined position for inactivating operation of the operation lever 541 of the plate feeding/discharging unit 5.

Figure 6:
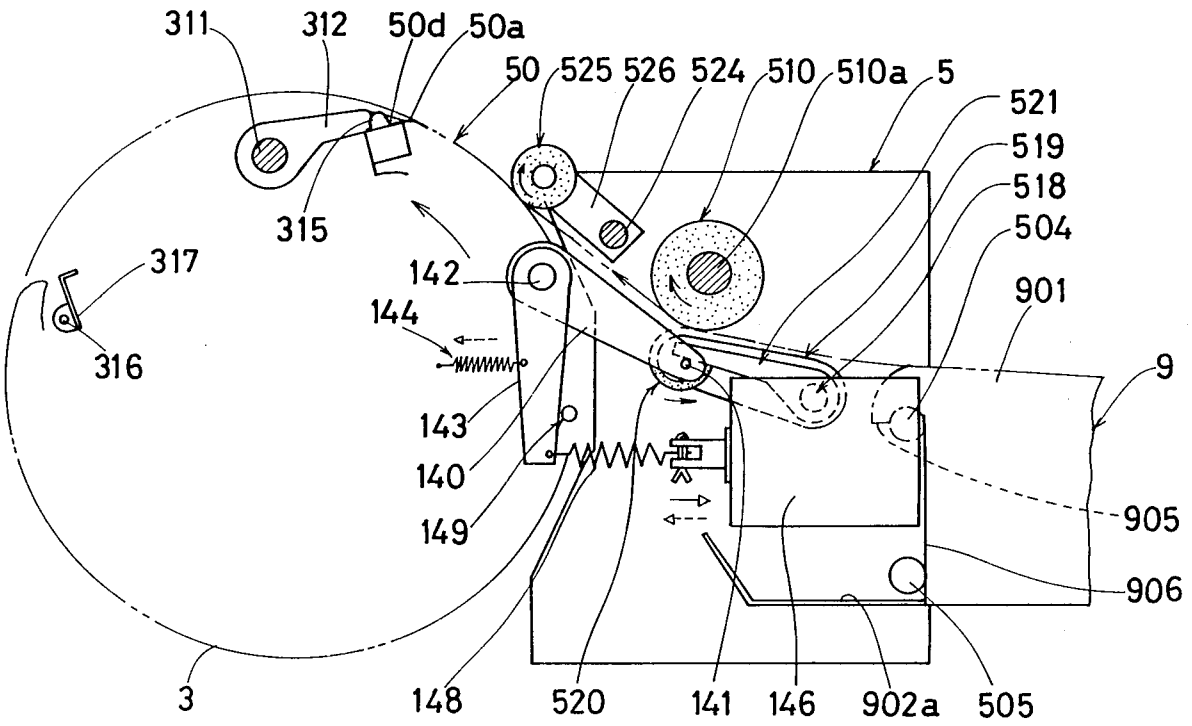
FIG. 6 explains a plate-feeding operation.

On the other hand, the driver lever 140 is installed to the upper position of the left-side rail-receiving member 126 shown in FIG. 5 for allowing the auxiliary plate-feeding driving rollers 520 shown in FIG. 3 of the plate feeding/discharging unit 5 to come into contact with and depart from the plate-feeding driving rollers 510. The tip end of the driver lever 140 is provided with a coupling pin 141 to be engaged with the operation lever 521 of the plate feeding/discharging unit 5, while the driver lever 140 is secured to the drive shaft 142 which is installed to the left-side board 101 and capable of freely rotating itself. The left end of this drive shaft 142 extends to the external portion of the left-side board 101, while the left end of the drive shaft 142 is provided with a lever 143 shown in FIG. 6 (illustration of the left-side board 101 is deleted here). A spring 144 for causing the lever 143 to rotate clockwise (see FIG. 6) is set between one-end of the lever 143 and the left-side board (not shown). A solenoide 146 is installed to the left-side board (not shown) for causing the lever 143 to rotate itself in the counterclockwise direction. The solenoid 146 and the lever 143 are connected to each other via a spring 148. A stopper pin 149 is set to the left-side board (not shown) for constraining the counterclockwise rotation of the lever 143. When the power is fed to the solenoid 146, the lever 143 is rotated in the counterclockwise direction as shown in FIG. 6, and as a result, the driver lever 140 also rotates in the counterclockwise direction before eventually being set to the predetermined rotating position to activate operation of the operation lever 521 of the plate feeding/discharging unit 5. Next, when the power is OFF from the solenoid 146, energized force from the spring 144 causes the lever 143 to turn clockwise before returning to the original position. Consequently, the driver lever 140 also rotates clockwise to return to the predetermined rotation position for relieving the operation lever 521 of the plate feeding/discharging unit 5 from the operative status. (III) Mounting the plate feeding/discharging unit Next, procedure needed for mounting the plate feeding/discharging unit 5 onto the printing press is described below. The mounting operation is done while no power is fed to the solenoids 137 to 146 mentioned above.

First, a operator lifts the plate feeding/discharging unit 5 by manually holding the handles 502 with both hands, and then, as shown in FIG. 5, by inserting the rails 506 into the rail-coupling grooves 127 of the rail-receiving members 126, the operator pushes the plate feeding/discharging unit 5 forward into the farthest position. After setting the plate feeding/discharging unit 5 to the farthest position, the operator then fastens the screws 503 into the screw holes 128 of the rail-receiving members 126, thus completing the unit mounting operation.

After installation of the plate feeding/discharging unit 5 in the position, the connector 508 on the part of the unit 5 shown in FIG. 3 is then connected to the connector 129 on the part of the printing press body 1 shown in FIG. 5. This allows the pulse motor 509 and the sensor 544 detecting the presence of the printing plate (which are respectively shown in FIG. 3) to be electrically connected to microprocessor 21 shown in FIG. 2.

In addition, as shown in FIG. 7, the tip end of the operation lever 541 of the plate feeding/discharging unit 5 is engaged with the coupling pin 132 of the driver lever 131 set to the printing press body 1. Thus, when the power is fed to the solenoid 137 while the above condition is present, the driver lever 131 rotates clockwise pivoting the driving shaft 133. As a result, the operation lever 541 is rotated counterclockwise pivoting the rotary shaft 538 so that the plate-holding roller 539 can be set to the plate-holding position. When the power is OFF from the solenoid 137, the plate-holding roller 539 is back to the original position which is apart from the plate cylinder 3 by reversing the operation described above. This operation is shown in FIG. 7.

Next, after completing the installation of the plate feeding/discharging unit 5 to the printing press body 1, as shown in FIG. 6, the tip end of the operation lever 521 of the plate feeding/discharging unit 5 is engaged with the coupling pin 141 of the driver lever 140 provided on the part of the printing press body 1. As a result, when the power is fed to the solenoid 146 while the above condition is present, the driver lever 140 rotates counterclockwise pivoting the drive shaft 142. Consequently, the operation lever 521 is rotated clockwise pivoting the driving shaft 518. This allows the auxiliary plate-feeding driving rollers 520 of the plate feeding/discharging unit 5 to be set to the position in contact with the plate feeding driving rollers 510. When the power is OFF from the solenoid 146, the auxiliary plate-feeding driving rollers 520 are back to the original position which is apart from the plate-feeding driving rollers 510 by reversing the operation described above.

The plate feeding/discharging unit can be removed from the printing press body 1 by reversing the procedure for mounting it.

Note that a plate feeding/discharging unit 6 has a constitution which is identical to that of the plate feeding/discharging unit 5, and likewise, it can be mounted onto and removed from the printing press body 1 by applying the procedure identical to that is applied to the plate feeding/discharging unit 5.

Figure 8:
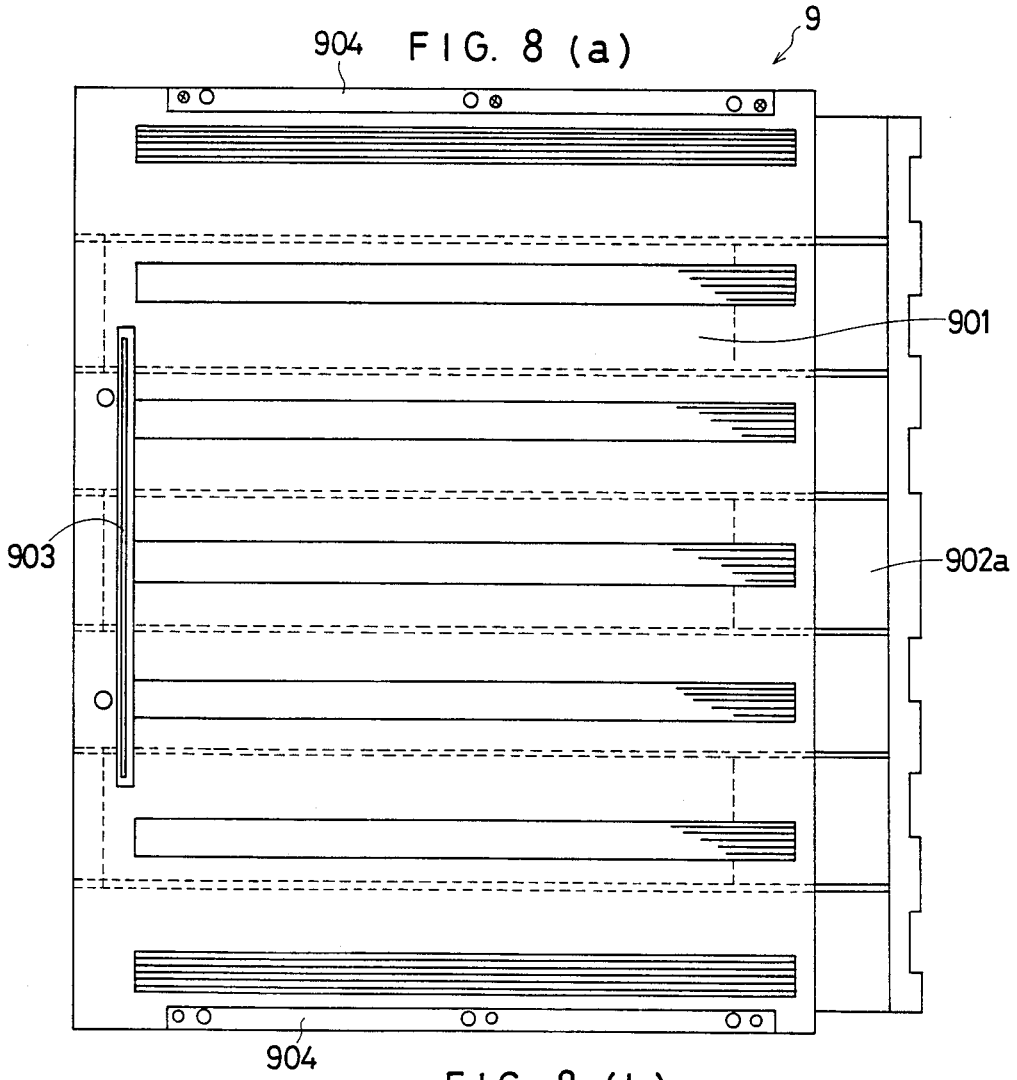
FIG. 8 is the constitution of a plate feeding/discharging tray.
Figure 8:
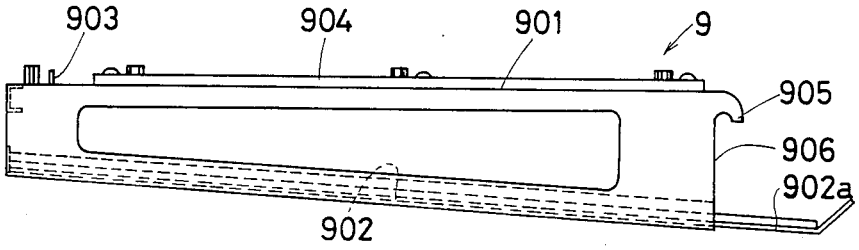
Figure 9:
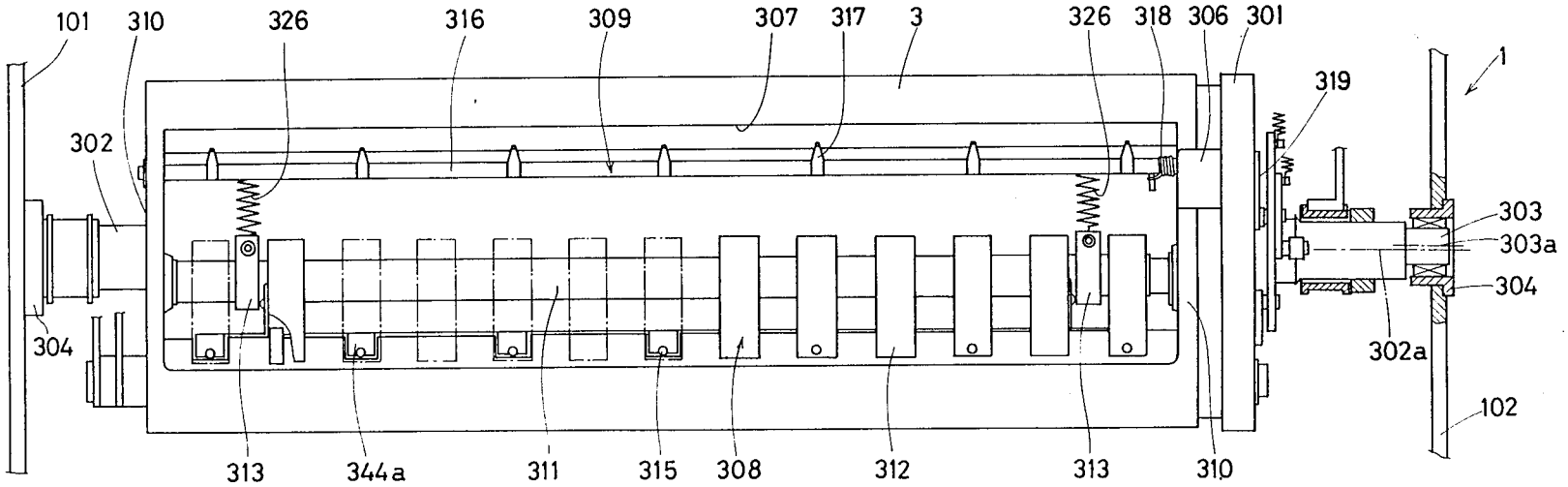
FIG. 9 (*a*) is a view of a plate cylinder shown from the rear position of the printing press.
Figure 9:
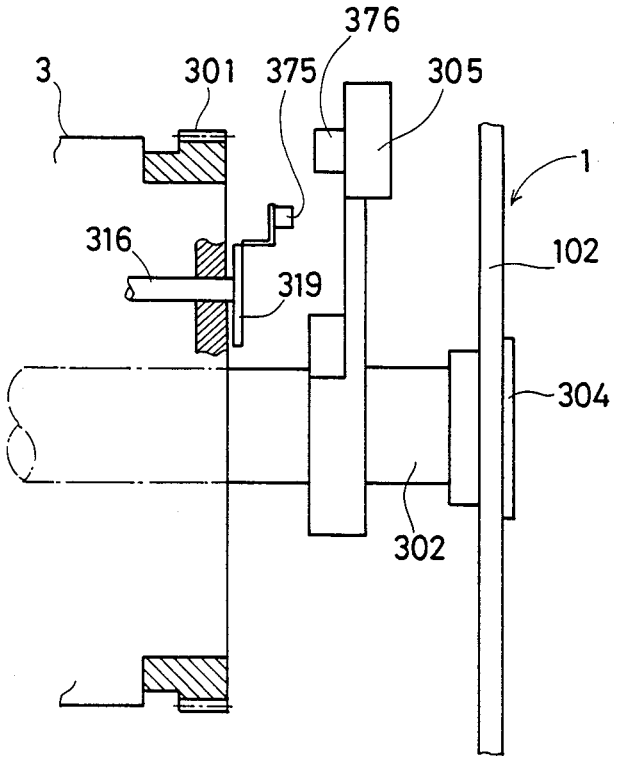

(2) Constitution and the procedure for the installation of a plate-feeding/discharging tray FIG. 8 (*a*) is a plain view of a plate feeding/discharging tray 9 and FIG. 9 (*b*) denotes its lateral view. An upper part of the plate feeding/discharging tray 9 is provided with a plate-feeding table 901 for forwarding a printing plate for delivery, whereas a lower part of which is provided with plate-discharging table 902 for storing a discharged printing plate. An upper rear portion of the plate-feeding table 901 is provided with a plate-end positioning member 903, whereas both sides of an upper surface of the plate-feeding table 901 are respectively provided with lateral positioning members 904 for correctly positioning both sides of the delivered printing plate. Both sides in front edge of the plate feeding/discharging tray 9 are respectively provided with hooks 905 for installing tray.

As shown in FIG. 3 (*c*), when installing the plate feeding/discharging tray 9 to the printing press body 1, the hooks 905 are first engaged with the engaging pins 504 in the state in which the extended part 902*a* in the front edge of plate-discharging table 902 is fully inserted into the plate feeding/discharging unit 5 so that both-sides 906 of the front edge of tray 9 can be engaged with the positioning pins 505. The plate feeding/discharging tray 9 is removed from the printing press body 1 by applying the procedure reversing that is described above.

Figure 10:
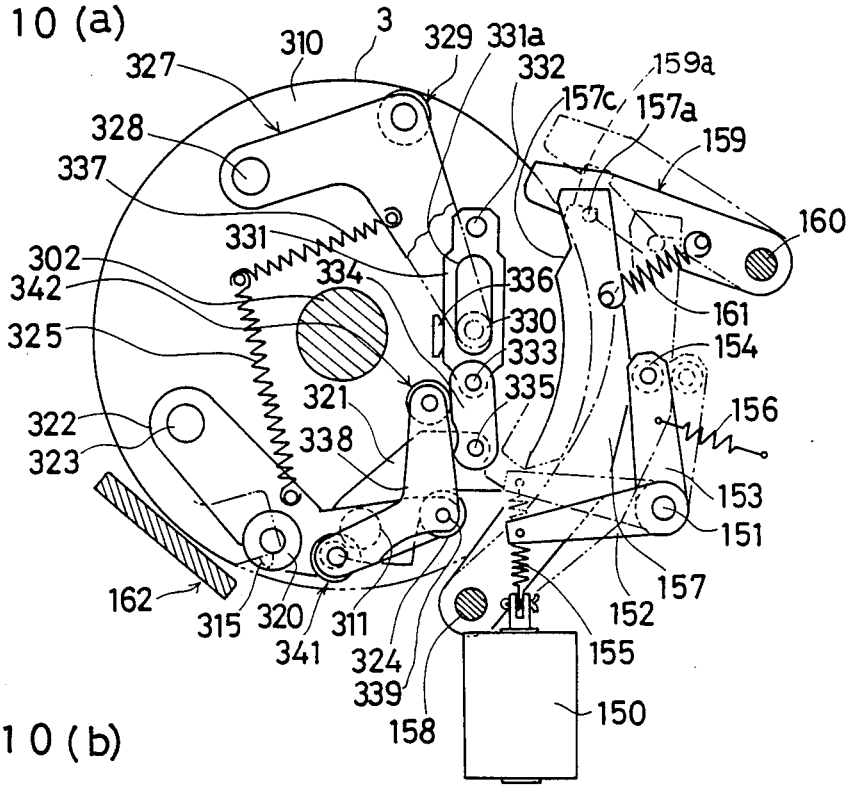
FIGS. 10 and 11 respectively explain the opening/-closing operation of the plate-head holding nails.
Figure 10:
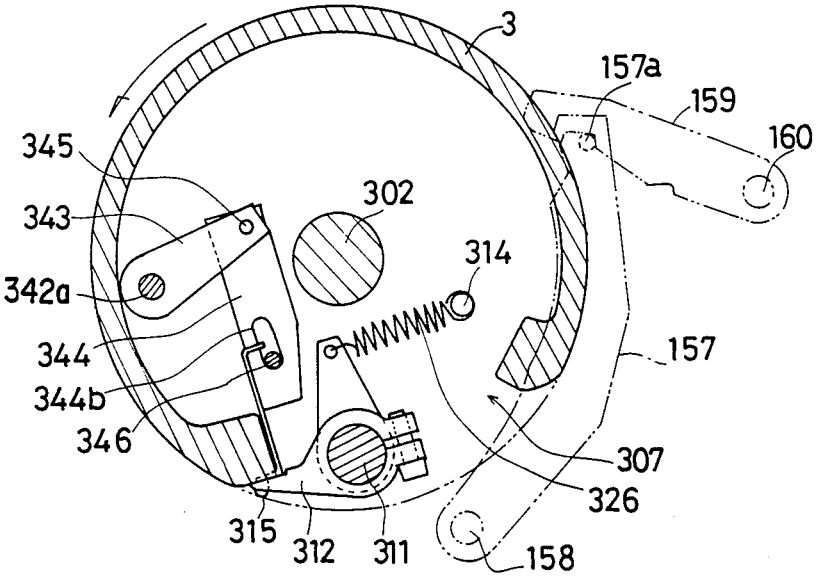

A plate feeding/discharging tray 1 shown in FIG. 10 has a constitution identical to that of the plate feeding-/discharging tray 9, while it can be mounted onto and removed from the plate feeding/discharging tray 10 by applying the same procedure so that is applied to the plate feeding/discharging tray 9.

(3) Mechanical constitution of the plate cylinder and the printing press body.

FIG. 9 is the diagram of the plate cylinder 3 observed from the back of the printing press body 1. As shown in FIG. 9, the plate-cylinder gear 301 is secured to a right edge of the plate cylinder 3. The plate cylinder 3 is held by a plate-cylinder supporting shaft 302 together with the plate-cylinder gear 301 so that it can freely rotate. Both ends of the plate-cylinder supporting shaft 302 are respectively provided with eccentric shafts 303 having the eccentric rotation axis 303*a* against axis 302*a* of the plate-cylinder supporting shaft 302. These eccentric shafts 303 are respectively held by bearings 304 secured to the right and left side boards 101 and 102 of the printing press body 1 so that they can freely rotate themselves. The plate cylinder 3 is rotated by engaging the plate-cylinder gear 301 with the blanket cylinder gear (not shown) set to a right end of the blanket cylinder 2 shown in FIG. 1. The plate cylinder 3 either comes into contact with or departs from the blanket cylinder 2 by causing the eccentric shafts 303 to be driven either clockwise or counterclockwise within a specific angle using a pulse motor for example.

A part of the external circumference of the plate cylinder 3 is provided with an aperture 307 throughout the entire width in the direction of the shaft. A plate-head clamping mechanism 308 and a plate-end holding mechanism 309 are respectively set to one end and the other end inside of the aperture 307 in the direction of the circumference.

Referring now to the accompanying drawings, constitutions of the plate cylinder 3 and the printing press body 1 are described below in accordance with respective mechanical components. (*a*) A plate-head clamping mechanism FIGS. 9 (*a*), 10 (*b*) and 11 (*b*) respectively denote a plate-head clamping mechanism 308. A nail shaft 311 capable of freely rotating itself is set between the left and right sides 310 and 310 of the plate cylinder 3. A plurality of plate-head clamping nails 312 are secured to the external circumference of the nail shaft 311 in the equal pitches in shaft orientations of the nail shaft 311. A pair of links 313 are secured to the position close to both ends of the nail shaft 311. A pair of tension springs 326 are set between spring-shoe pins 314 set inside of the plate cylinder 3 and the tip ends of links 313, thus allowing the plate-head clamping nails 312 to be rotated in the clockwise direction, i.e., in the direction of closing nails, pivoting the nail shaft 311, as shown in FIG. 10 (*b*). These plate-head clamping nails 312 are opened by operating the plate-head clamping nail operating mechanism (to be described later on) set to the left end of the plate cylinder 3.

On the other hand, plate-head register pins 315 project themselves at the positions opposite from the plate-head clamping nails 312 along the aperture edge of the plate cylinder 3. The plate-head clamping mechanism 308 clamps the plate head by closing the plate-head clamping nails 312 by engaging the plate-head register pins 315 with pin holes provided for the lead edge portion of the printing plate (not shown).

(b) A plate-end holding mechanism

Figure 25:
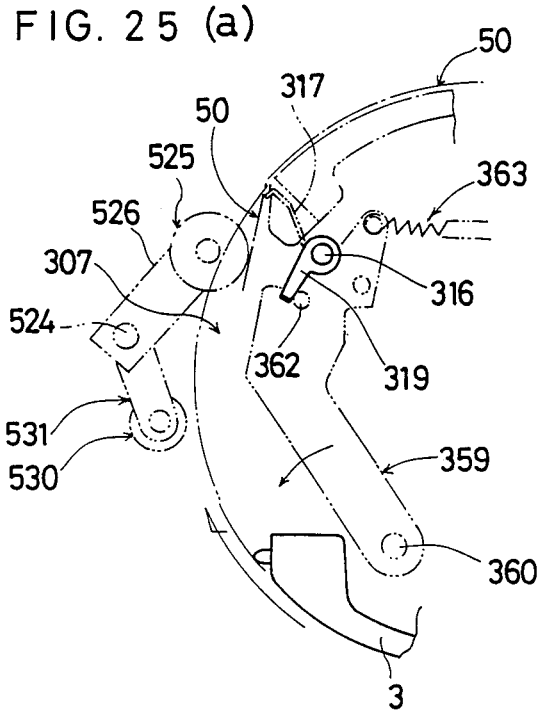
Figure 25:
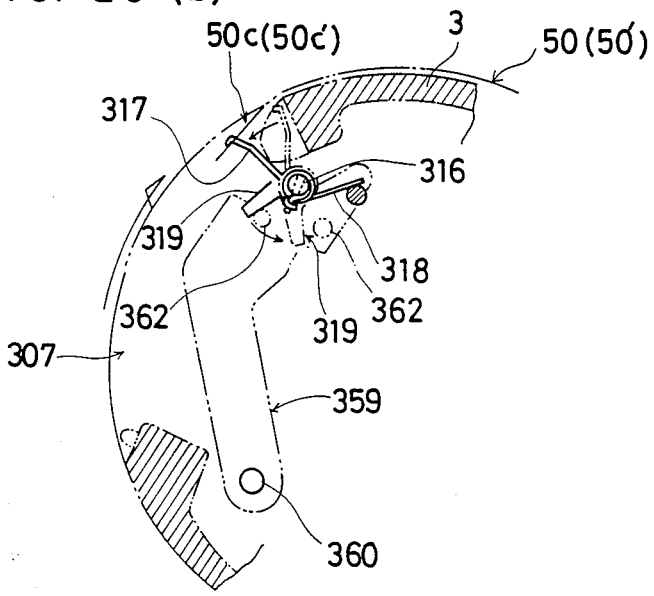

A plate-end holding mechanism 309 is shown in FIGS. 9 (*a*) and 25, respectively. A hook shaft 316 is set between the left and right sides 310, 310 of the plate cylinder 3 so that it can freely rotate itself. A plurality of plate-end hooks 317 are secured in equal pitches in shaft orientations of the hook shaft 316. A torsion coil spring 318 is externally set to the position close to the right edge of the hook shaft 316, thus allowing the plate-end hooks 317 to be rotated in the counterclockwise direction, i.e., in the direction of pulling the plate end, pivoting the hook shaft 316, as shown in FIG. 25. In addition, a link 319 is secured to the external position of the plate-cylinder gear 301 in the right edge of the hook shaft 316. The link 319 is rotated either clockwise or counterclockwise by means of a plate-end hook operation mechanism to be described later on, thus making it possible for the plate-end hook 317 to correctly hold and release the tail edge.

(c) A plate feeding/discharging cam mechanism

Figure 11:
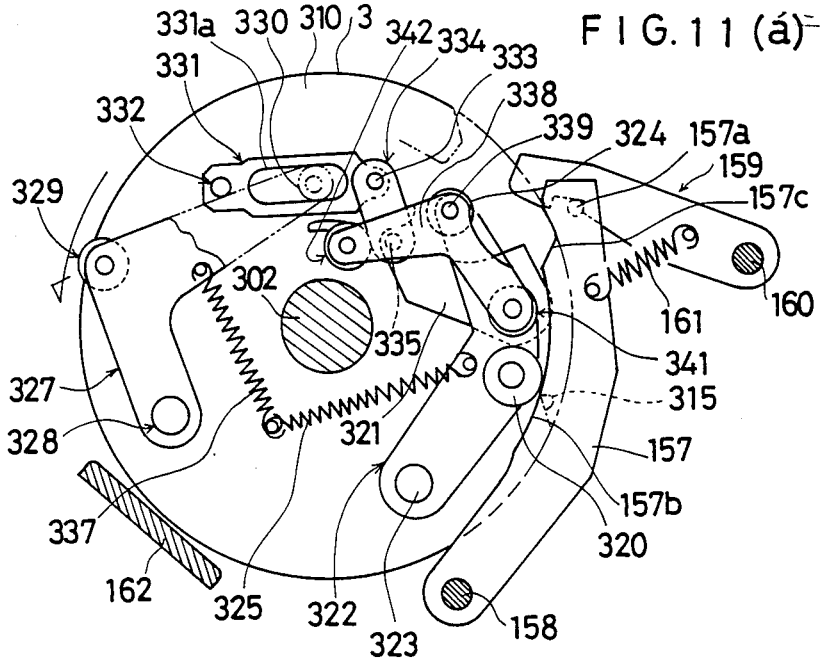
Figure 11:
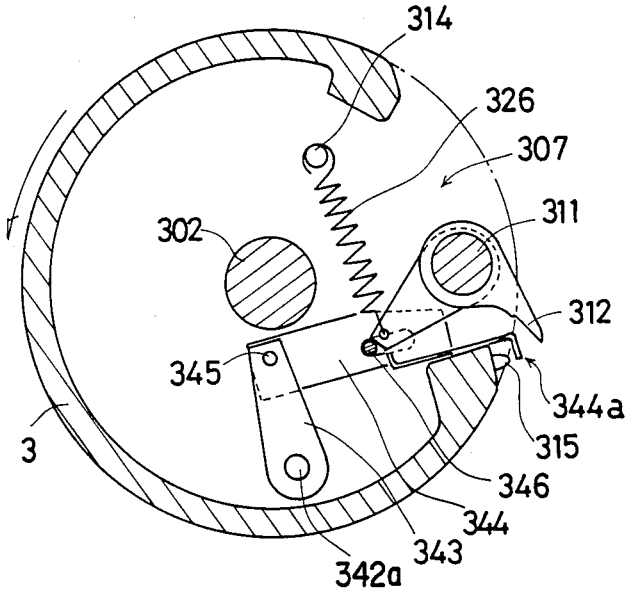

The left-side board 101 of the printing press body 1 is provided with a plate feeding/discharging cam mechanism shown in FIGS. 10 and 11. Note that, to easily understand the constitution, illustration of the left-side board 101 is deleted from FIG. 11. The same applies to the ensuing drawings. The plate feeding/discharging cam mechanism is comprised of the following: A solenoid 150 is secured to the external surface of the left-side board 101. A shaft 151 penetrating the left-side board 101 is set so that it can freely rotate itself. A link 152 and a set-lever 153 are respectively secured to the external and internal edges of the shaft 151. A set-roller 154 is secured to the tip end of the set-lever 153. In addition, a spring 155 is set between the link 152 and the solenoid 150. A spring 156 is set between the set-lever 153 and the left-side board 101 for energizing the set-lever 153 so that it rotates clockwise. On the other hand, a plate feeding/discharging cam 157 capable of freely rotating itself is installed via shaft 158 projecting onto the internal surface of the left-side board 101. In addition, a lock-lever 159 capable of freely rotating itself is installed via another shaft 160 projecting onto the internal surface of the left-side board 101. A tension spring 161 is set between the plate feeding/discharging cam 157 and the lock-lever 159 to energize the lock-lever 159 so that it can rotate counterclockwise. The counterclockwise rotation of the lock-lever 159 is constrained by engaging the lock-lever 159 itself with the locking pin 157*a* set to the tip end of the plate feeding-/discharging cam 157.

Next, operation of the plate feeding/discharging cam mechanism is described below. When the solenoid 150 is activated, the link 152 rotates counterclockwise via the spring 155 as shown in FIG. 10(*a*). This causes the set-lever 153 to rotate counterclockwise pivoting the shaft 151 against the energized force from the spring 156. As a result, the set-roller 154 presses the plate feeding/discharging cam 157 so that the plate feeding/discharging cam 157 starts to rotate itself counterclockwise pivoting the shaft 158. When the plate feeding/discharging cam 157 rotates counterclockwise by the predetermined angle, the locking pin 157*a* falls into the groove 159*a* of the lock-lever 159, and as a result, the plate feeding/discharging cam 157 is latched at its rotating position, i.e., the cam 157 is securely locked. When the power is OFF from the solenoid 150 after locking the plate feeding/discharging cam 157, tractive force from the spring 155 is freed, thus allowing the link 152 and the set-lever 153 to respectively rotate clockwise pivoting the shaft 151 by the energized force from the spring 156 before returning to their original positions. While this operation is underway, the plate feeding/discharging cam 157 remains being latched at the locked position mentioned above. The plate feeding/discharging cam 157 is unlocked when the roller 320 set to the plate cylinder 3 kicks the tip end of the lock-lever 159 in conjunction with the counterclockwise rotation of the plate cylinder 3 shown in FIG. 16. More particularly, when the tip end of the lock-lever 159 is kicked upward by the roller 320, the locking pin 157*a* set to the plate feeding/discharging cam 157 is disengaged from the groove 159*a* of the lock-lever 159. This allows the plate feeding/discharging cam 157 to rotate in the clockwise direction due to tensile force from the tension spring 161 before returning to its original position shown in FIG. 17. This completes unlocking operation of the plate feeding/discharging cam 157.

(d) A plate-head clamping nail operation mechanism

As shown in FIGS. 10 (*a*) and 11 (*a*), the external surface of the left-side part of the plate cylinder 3 is provided with a plate-head clamping nail operation mechanism. This mechanism is comprised of the following: The left-end of the nail shaft 311 shown in FIG. 10 (*b*) extends itself up to the outer portion of the left-side part of the plate cylinder 3 shown in FIG. 10 (*a*), while a first link 321 is connected to the extended portion of the nail shaft 311. A second link 322 is installed to a shaft 323 set to the left-side part of the plate cylinder 3 so that it can freely rotate. Rollers 320 and 324 are respectively installed to the center and tip-end positions of the link 322. A tension spring 325 is installed between the link 322 and the left side 310 to allow the link 322 to rotate counterclockwise pivoting the shaft 323. The counterclockwise rotation of the link 322 is constrained by engaging the roller 324 with the link 321.

Figure 15:
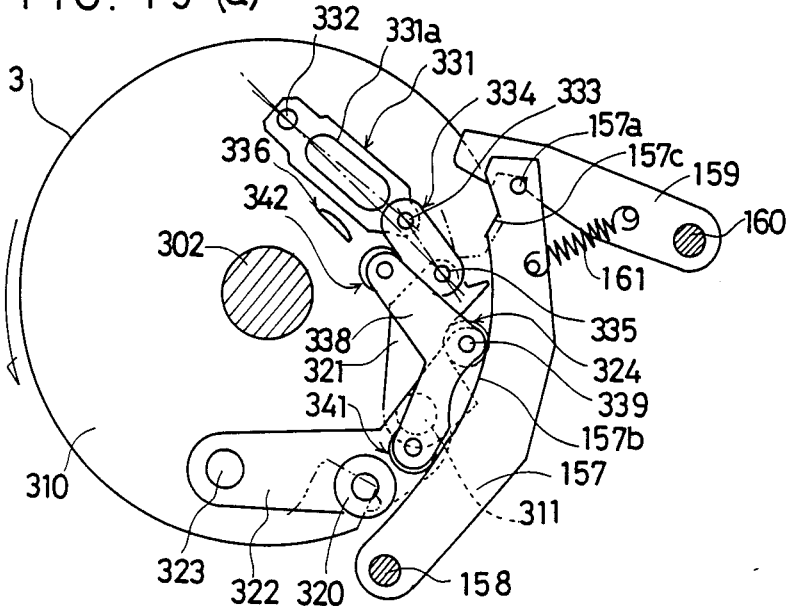
FIGS. 15 through 17 respectively explain the operations of the plate-head holding vice mechanism.
Figure 15:
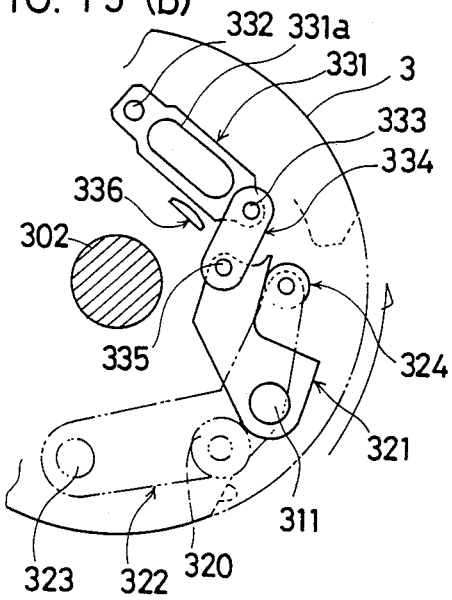
Figure 15:
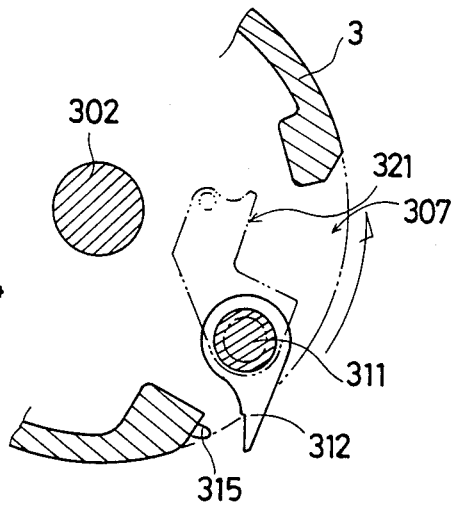
Figure 16:
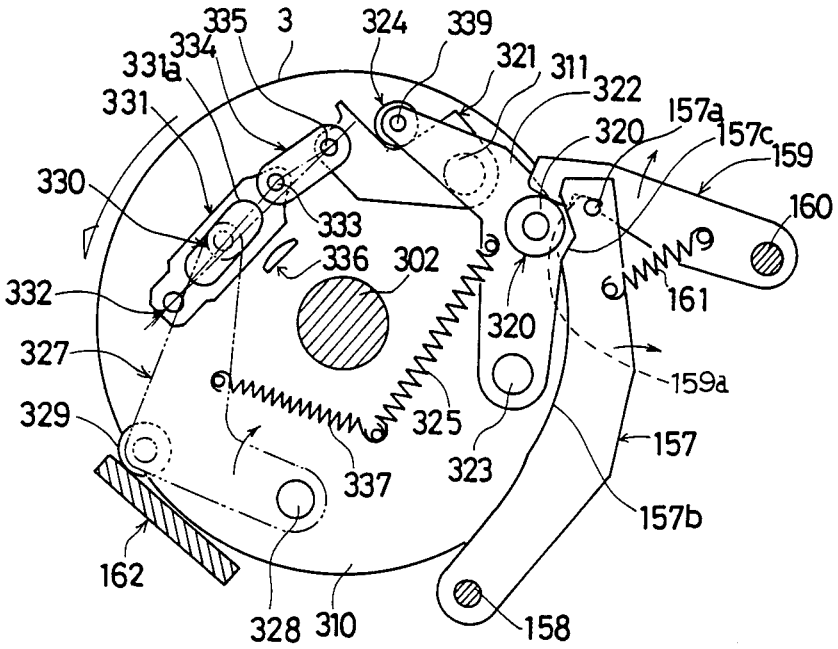

Next, operation of the plate-head clamping nail operation mechanism is described below. First, the plate feedign/discharging cam 157 is locked as shown in FIG. 10 (*a*). Next, a plate-head clamping vice mechanism (to be described later on) is unlocked. In conjunction with the counterclockwise rotation of the plate cylinder 3, the roller 320 of the link 322 runs over the cam surface 157*b* of the plate feeding/discharging cam 157 to rotate over the cam surface 157*b* as shown in FIG. 11 (*a*). This causes the link 322 to rotate counterclockwise pivoting the shaft 323. As a result, the other link 321 is pressed to the left by roller 324 set to the tip end of the link 322 as shown in FIG. 15 (*b*). This causes the nail shaft 311 to also rotate counterclockwise as shown in FIG. 15 (*c*). Thus, the nail shaft 311 rotates counterclockwise by overcoming the force from the tension spring 326 shown in FIG. 11 (*b*), and as a result, the plate-head clamping nail 312 secured to the nail shaft 311 also rotates counterclockwise, thus eventually allowing the plate-head clamping nail 312 to execute "opening" operation. When the roller 320 of the link 322 reaches the concave 157*c* of the plate feeding/discharging cam 157 by further rotation of the plate cylinder 3 as shown in FIG. 16, the roller 320 falls into the concave 157*c* to disengage the plate feeding/discharging cam 157 from the pressing operation against the link 322. Thus, after being released from the constraint applied by the plate feeding/discharging cam 157, the links 322 and 321 are respectively allowed to rotate clockwise pivoting the shaft 323 and the nail shaft 311, while the nail shaft 311 also rotates clockwise by receiving tensile force from the tension spring 326 shown in FIG. 11. This allows the plate-head clamping nails 312 shown in FIG. 10 (*b*) to execute "closing" operation. When the plate cylinder 3 rotates furthermore, as was described earlier, the roller 320 kicks the lock-lever 159 upwards so that the plate feeding/discharging cam 157 can be unlocked.

(e) A plate-head clamping vice mechanism and a vice-releasing mechanism

As shown in FIGS. 10 (*a*), 11 (*a*), 15 through 17, in addition to the plate-head clamping nail operation mechanism described above, the external surface of the left side 310 of the plate cylinder 3 is provided with a plate-head clamping vice mechanism and a vice-releasing mechanism as well. Of these, the plate-head clamping vice mechanism is comprised of the following: As shown in FIG. 16, a link 327 (fifth link) is installed to the left side 310 of the plate cylinder 3 via a shaft 328 so that it can freely rotate itself. Rollers 329 and 330 are respectively installed to the center and tip-end positions of the link 327. A third link 331 is also installed to the left side 310 via a shaft 332 so that it can freely rotate itself. The link 331 is provided with a lengthy hole 331*a*, with which the roller 330 of the link 327 is engaged so that it can freely slide its position. In addition, a fourth link 334 is connected to the tip end of the link 331 via a pin 333 so that it can freely rotate itself. The other end of the link 334 and the tip end of the link 321 are connected to each other via another pin 335 so that they can freely rotate themselves. A stopper 336 for constraining the clockwise rotation of the link 331 is projectively installed to the inner position of the link 331 of the left side 310 of the plate cylinder 3. In addition, a tension spring 337 buffering the centrifugal force applied to the link 327 relative to the rotation of the plate cylinder 3 is provided between the left side 310 and the link 327. In addition, a plate-head clamping nail locking cam 162 for inwardly placing the roller 329 of the link 327 inside of the plate cylinder 3 is installed to the designated position of the printing press body 1.

Operation of the plate-head clamping nail vice mechanism is described below. As shown in FIG. 16, the plate-head clamping nails 312 are first closed by engaging the roller 320 of the link 322 with the concave 157*c* of the plate feeding/discharging cam 157 before clamping the plate head. Immediately after the plate-head clamping is done, the roller 329 of the link 327 is pressed against the plate-head clamping nail locking cam 162, thus causing the link 327 to rotate clockwise pivoting the shaft 328. When the link 327 rotates clockwise, the roller 330 of the link 327 slides inside of the lengthy hole 331*a* of the link 331, thus allowing the link 331 to rotate in the clockwise direction pivoting the shaft 332. As a result, when the pin 333 moves its position from the position shown in FIG. 16 to the straight line connecting the pin 335 nd the shaft 332, the pin 333 forcibly rotates the nail shaft 311 clockwise via the link 321 using the reached position as the top dead center. This delivers enormous pressure to the plate-head clamping nails 312. Now, when the link 331 keeps clockwise rotation to cause the pin 333 to move itself to a position slightly in excess of the top dead center mentioned above as shown in FIG. 17, the link 331 is then caught by the stopper 336 and locks itself. This causes powerful pressure to be continuously and stably delivered to the plate-head clamping nails 312.

On the other hand, the vice-releasing mechanism for unlocking the plate-head clamping nail vice mechanism is comprised of the following: As shown in FIGS. 10 (*a*) and 11 (*a*), center part of a sixth link 338 is connected to the tip-end of the link 322 via a shaft 339 so that the link 338 can freely rotate itself. Rollers 341 and 342 are respectively set to both ends of the link 338. The shaft 339 is concurrently with the rotary shaft of the roller 324 set to the tip-end of the link 322.

Next, operation of the vice-releasing mechanism is described below. When the plate cylinder 3 rotates to the position shown in FIG. 10 (*a*) while the vice mechanism remains being locked, the plate feeding/discharging cam 157 is locked in accordance with the procedure described above. Next, the roller 341 of the link 338 runs over the plate feeding/discharging cam 157 as shown in FIG. 15 (*a*). As a result, the link 338 rotates in the clockwise direction pivoting the shaft 339, thus causing the roller 342 set to the edge part of the link 338 to press the link 334 in the direction of the external circumference of the plate cylinder 3. On receipt of pressure, the link 334 rotates clockwise pivoting the pin 335 to simultaneously cause the link 331 to rotate counterclockwise pivoting the shaft 332. As a result, the pin 333 passes through the straight line (i.e., top dead center)connecting the pin 335 and the shaft 332 so that the vice mechanism can be unlocked to allow the link 321 to rotate in the counterclockwise direction pivoting nail shaft 311.

(f) A plate-head extrusion mechanism

Figure 12:
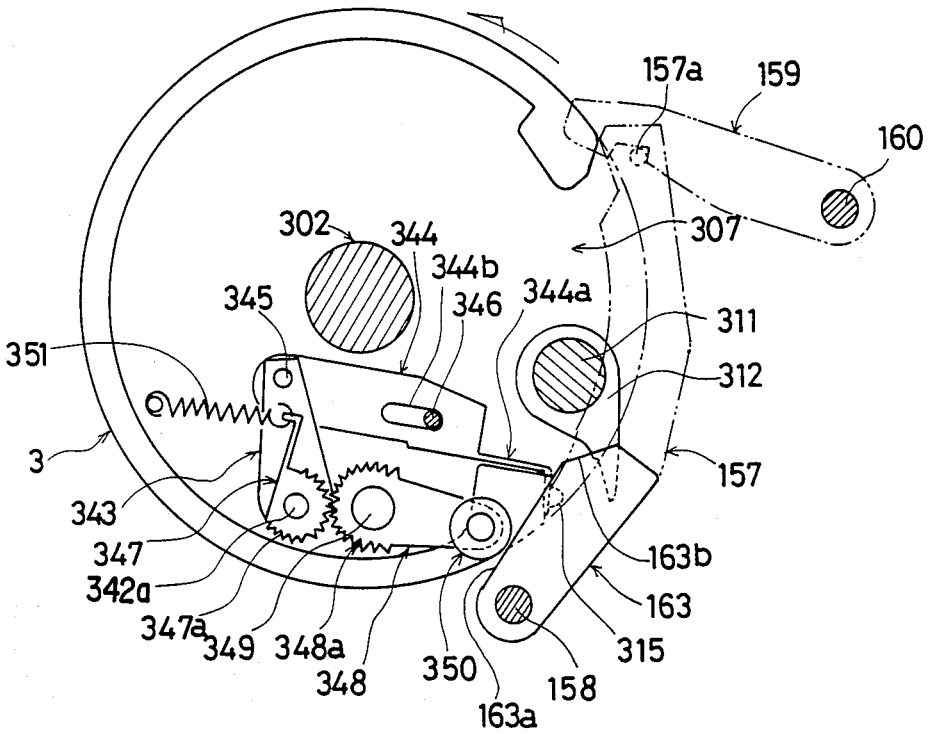
FIGS. 12 through 14 respectively explain the operations for protruding and withdrawing of the plate extruding nails.
Figure 12:
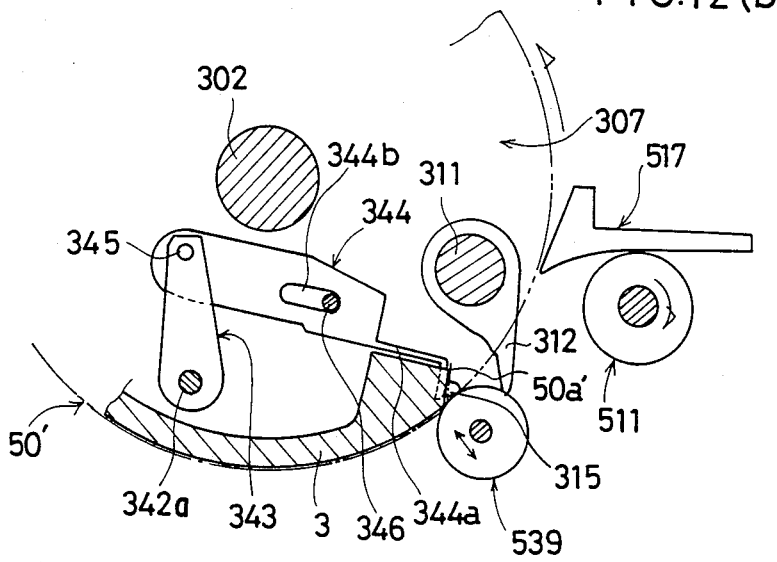

As shown in FIGS. 9 (*a*), 12 through 14, the plate cylinder 3 is internally provided with the plate-head extrusion mechanism, which is comprised of the following: An end of a link 343 is secured to a shaft 342*a* set between the left and right sides 310/310 of the plate cylinder 3, in which the shaft 342*a* freely rotates itself. On the other hand, a shaft 346 set inside of the plate cylinder 3 is connected to a lengthy hole 344b of a link 344 having plate-extrusion nails 344*a* at the tip end so that the shaft 346 can freely slide itself, while the rear end of the link 344 and the tip end of the link 343 are connected to each other via a shaft 345 so that both links can freely rotates themselves. A plurality of links 343 and 344 are respectively provided in the direction of the rotary shaft of the plate cylinder 3 in the positions corresponding to respective plate-head register pins 315. When the shaft 342*a* rotates either clockwise or counterclockwise, the link 344 moves forward or backward via the link 343 to allow the plate extrusion nails 344*a* to either come out from or enter into the edge surface of aperture. The left edge of the shaft 342*a* extends itself up to the external part of the left side 310 of the plate cylinder 3. A link 347 having a gear 347*a* is secured to the edge of the extended shaft 342*a*. In addition, another link 348 having a gear 348*a* engaged with gear 347*a* is connected to a shaft 349 set to the external surface of the left side 310 of the plate cylinder 3 so that the link 348 can also freely rotate itself. A cam follower 350 is set to the tip end of the link 348. In addition, a tension spring 351 is set between the tip end of the link 347 and the left side 310 of the plate cylinder 3, thus causing the shaft 342*a* to be rotated counterclockwise as shown in FIG. 12. In other words, the shaft 342*a* is rotated so that the plate extrusion nails 344*a* can be led into the edge surface of aperture of the plate cylinder 3. On the other hand, a plate-discharging cam 163 corresponding to the cam follower 350 is secured to the shaft 158 which is concurrently with the rotary shaft of the plate feeding/discharging cam 157. This allows the plate-discharging cam 163 to rotate either clockwise or counterclockwise within a specific range pivoting the shaft 158 in conjunction with the operation of the plate feeding/discharging cam operation mechanism.

Figure 13:
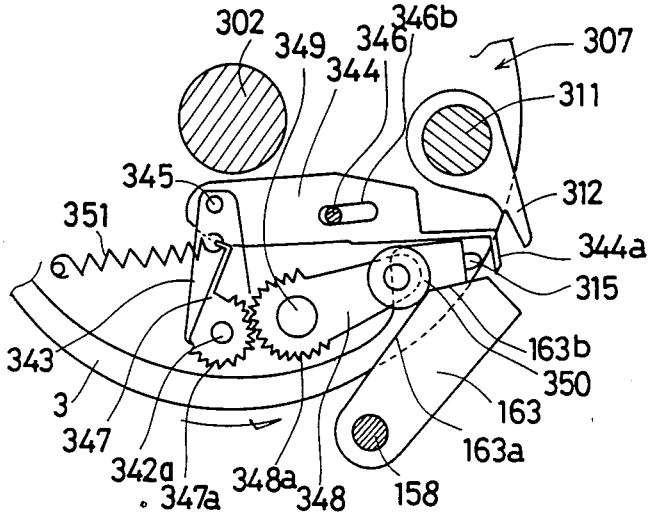
Figure 13:
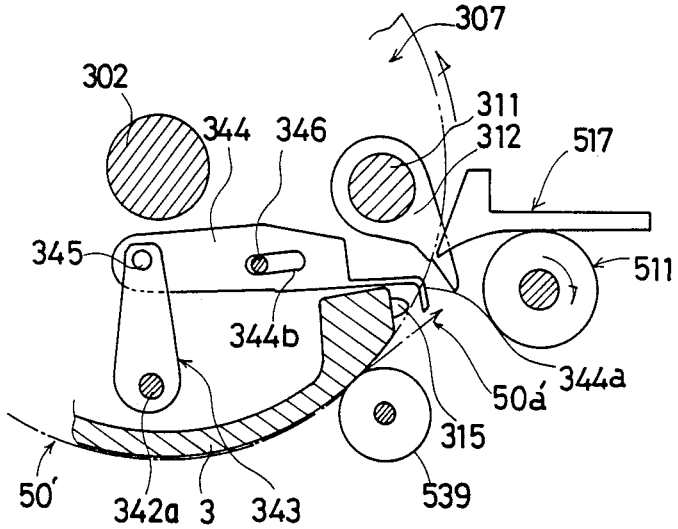
Figure 14:
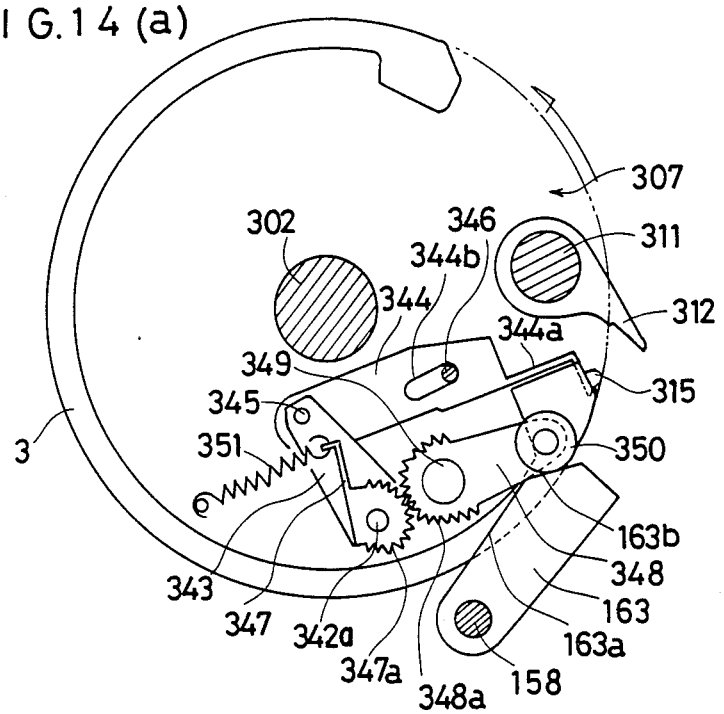
Figure 14:
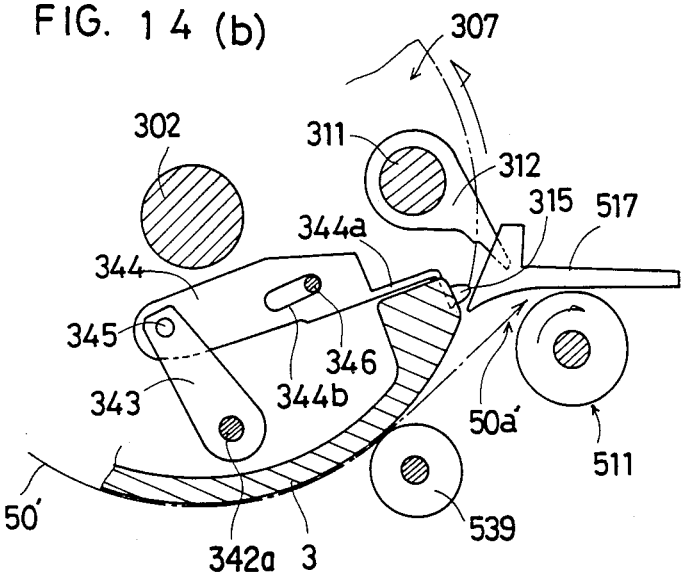

The plate-head extrusion mechanism provides the following functions. After locking the plate-discharging cam 163 at the designated position shown in FIG. 12 (*a*) and then the plate-head clamping nails 312 executes "opening" operation, the cam follower 350 runs over the first cam surface 163*a* of the plate-discharging cam 163. This causes the link 348 to rotate counterclockwise pivoting the shaft 349. When the link 348 rotates counterclockwise, as shown in FIG. 13, the rotation force is transmitted from the gear 348 to the gear 347*a*, thus allowing the link 347 to rotate clockwise pivoting the shaft 342*a* against the energized force from the tension spring 351. This causes the link 343 to also rotate clockwise to activate the plate-extrusion nails 344*a* of the link 344 so that the nails 344*a* comes out of the edge surface of aperture of the plate cylinder 3. In this case, as shown in FIG. 12 (*b*), if the lead edge 50*a*′ of the printing plate 50′ were preliminarily latched by the plate-head register pins 315, the plate head 50*a*′ is extruded from the plate-head register pins 315 by the plate extrusion nails 344*a* as shown in FIG. 13. Then, as shown in FIG. 14 (*a*), when the plate cylinder 3 continuously rotates itself, the cam follower 350 moves its position to the second cam surface 163*b* after passing through the first cam surface 163*a* of the plate-discharging cam 163. This causes the link 348 to be rotated clockwise pivoting the shaft 349 by the energized force from the tension spring 351. As a result, the links 343 and 347 respectively rotate counterclockwise to activate the plate extrusion nails 344*a* for entry into the edge surface of aperture of the plate cylinder 3.

(g) A plate-holding roller cam mechanism

Figure 18:
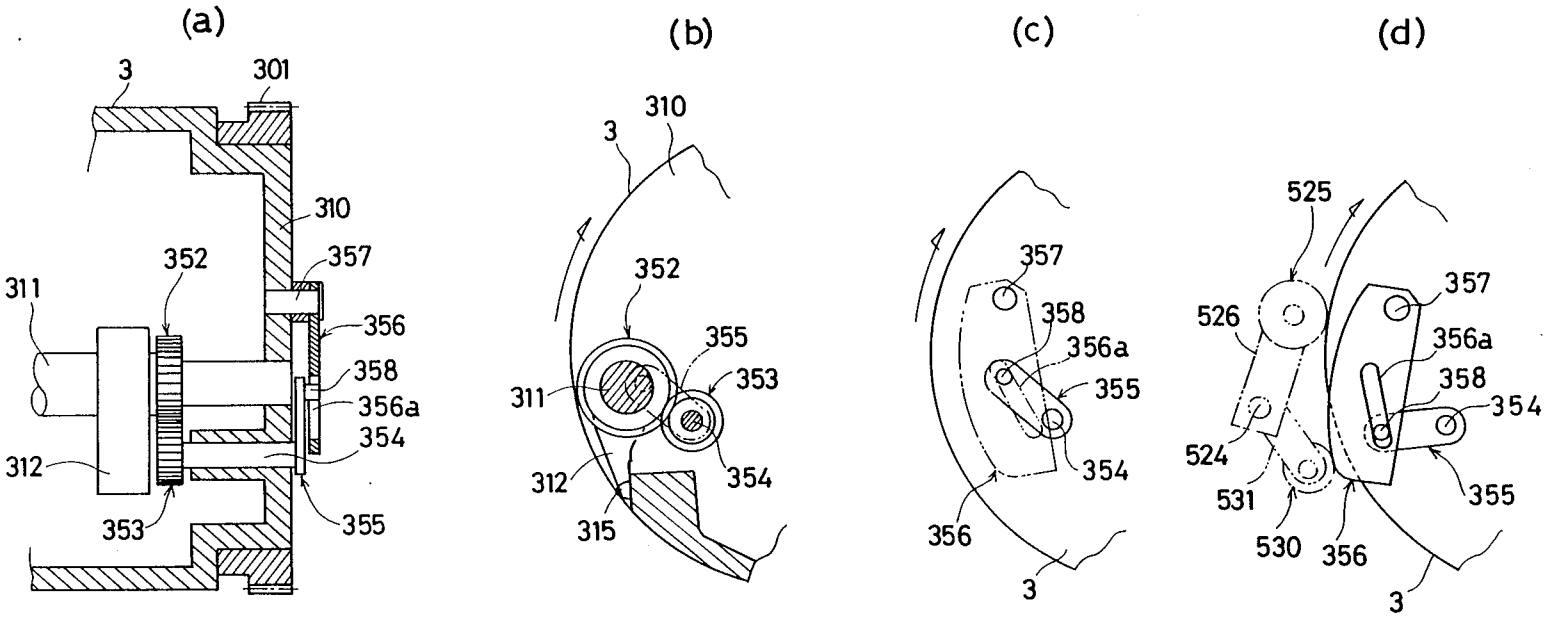
FIG. 18 explains the operations of the cam mechanism in relation to the plate-holding rollers.

As shown in FIG. 18, the right side 310 of the plate cylinder 3 is provided with a plate-holding roller cam mechanism, which is comprised of the following: A gear 352 is secured to a position close to the right edge of the nail shaft 311 inside of the plate cylinder 3. In addition, a fulcrum shaft 354 securing a small gear 353 engaged with the gear 352 at an edge is installed to the right side part 310 so that it can freely rotate itself, while a link 355 is secured to the other edge of the fulcrum shaft 354. On the other hand, a plate-holding roller cam 356 is set to the right side part 310 via a fulcrum pin 357 so that it can freely rotate itself. A pin 358 set to the tip end of the link 355 is engaged with a lengthy hole 356*a* of the plate-holding roller cam 356 so that it can freely slide its position.

The plate-holding roller cam mechanism provides the following functions. When the plate-head clamping nails 312 open themselves according to the procedure described above, the gear 352 secured to the nail shaft 311 rotates clockwise as shown in FIG. 18 (*b*). This causes the small gear 353 and the link 355 to simultaneously rotate counterclockwise. When the link 355 rotates counterclockwise, the pin 358 set to the tip end of the link 355 slides through the lengthy hole 356*a* of the plate-holding roller cam 356. This activates the plate-holding roller cam 356 to rotate clockwise itself pivoting the fulcrum pin 357 before it is eventually set to the predetermined position. Likewise, when the plate-head clamping nails 312 close themselves, operation reversing the above sequence is executed, thus allowing the plate-holding roller cam 356 to be back to the original position to reset the entire operation.

(h) Contacting and departing operations of a plate-holding roller

Figure 19:
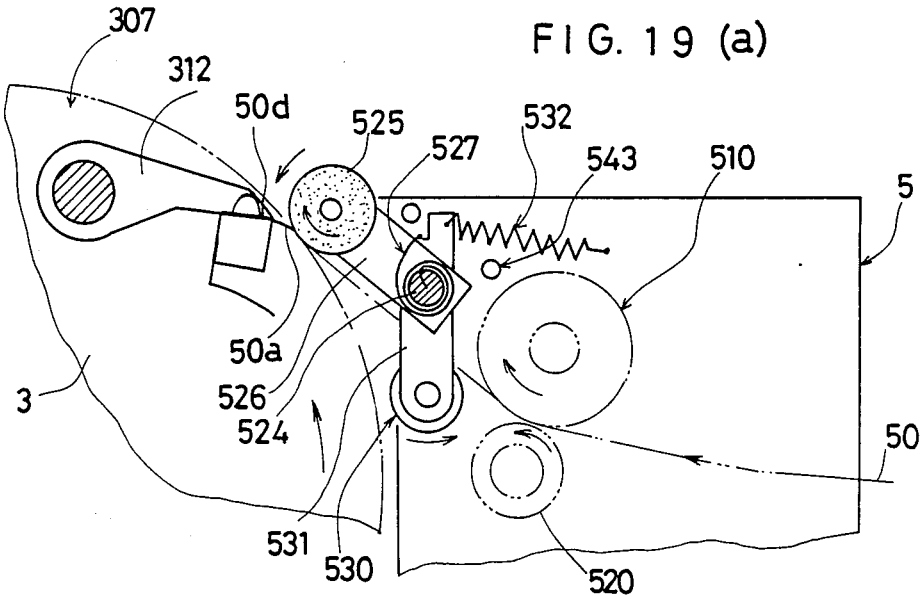
FIG. 19 explains the operations needed for locking the plate holding rollers.
Figure 19:
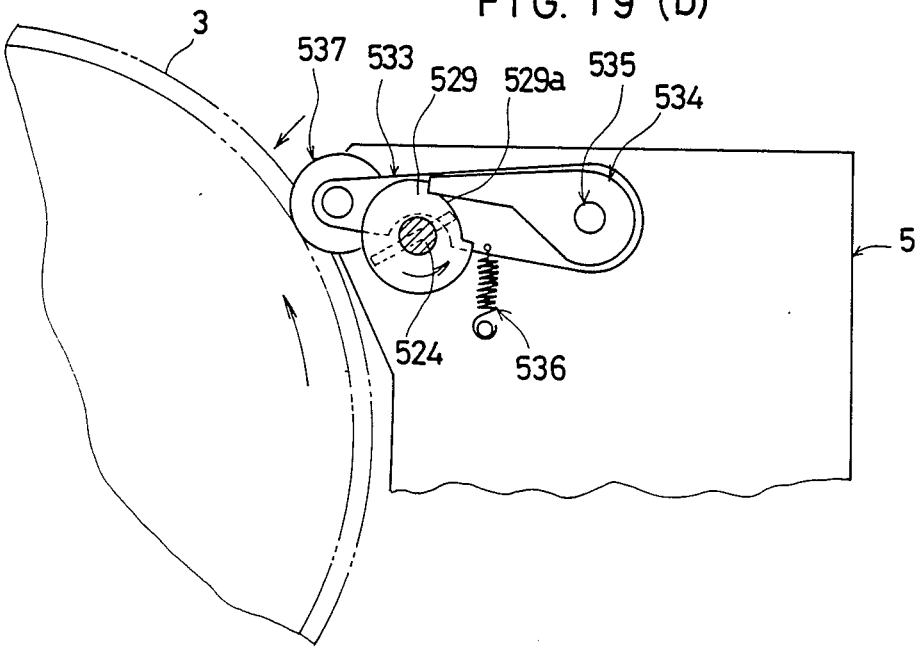

The plate-holding rollers 525 installed to the plate feeding/discharging unit 5 come into contact and depart from the plate cylinder 3 in accordance with procedure described below. As shown in FIG. 18 (*d*), after the plate-holding roller cam 356 is set to the designated position and while the plate-head clamping nails 312 remains open, the plate-holding activation roller 530 runs over the plate-holding roller cam 356. This allows both the plate-holding activation arm 531 and the rotary shaft 524 to rotate counterclockwise as shown in FIG. 19 (*a*), thus causing the roller-supporting arm 526 to rotate counterclockwise to allow the plate-holding rollers 525 to be set to the plate holding position. This operation is done while the plate-holding rollers 525 still remains in the aperture 307 of the plate cylinder 3. Simultaneous with the counterclockwise rotation of the rotary shaft 524, the latchet wheel 529 shown in FIG. 19 (*b*) also rotates counterclockwise. When the latchet wheel 529 rotates counterclockwise by the predetermined angle, the latchet 534 falls into the concave 529*a* so that it is locked. This causes the plate-holding rollers 525 to be locked at the plate-holding position. Next, the plate-head clamping nails 312 close themselves and clamp the plate head. Then, when the plate-holding rollers 525 pass through aperture 307 while the plate cylinder 3 still rotates itself, the plate-holding rollers 525 run over the external circumference of the plate cylinder 3 to press the printing plate 50 against the plate cylinder 3. When these operations are underway, since the roller-supporting arm 526 is energized by the torsion coil spring 527 so that it is rotated counterclockwise against the rotary shaft 524, the printing plate 50 is elastically pressed against the plate cylinder 3 by the plate-holding rollers 525. Thus, in conjunction with the rotation of the plate cylinder 3, while being pressed against the plate cylinder 3 by the plate-holding rollers 525, the printing plate 50 is tightly wound onto the plate cylinder 3.

Figure 20:
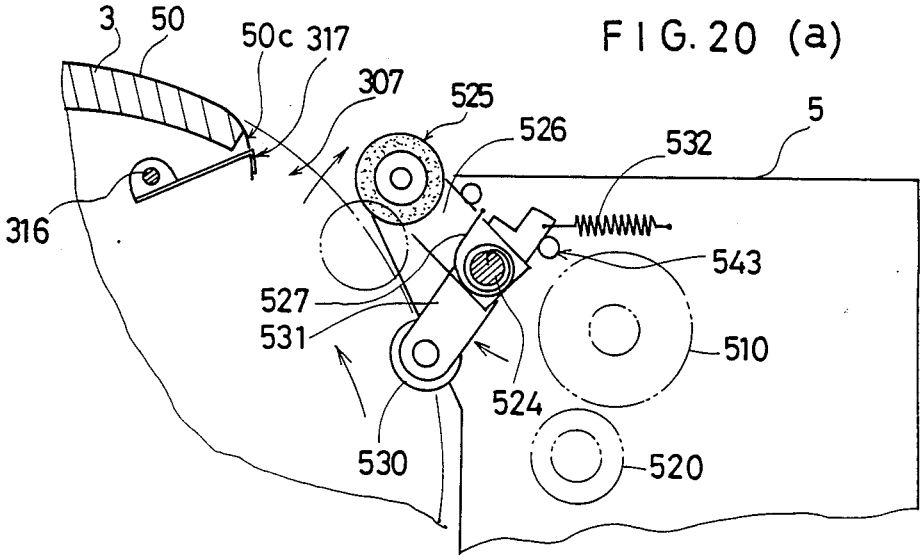
FIG. 20 explains the operations needed for unlocking the plate holding rollers.
Figure 20:
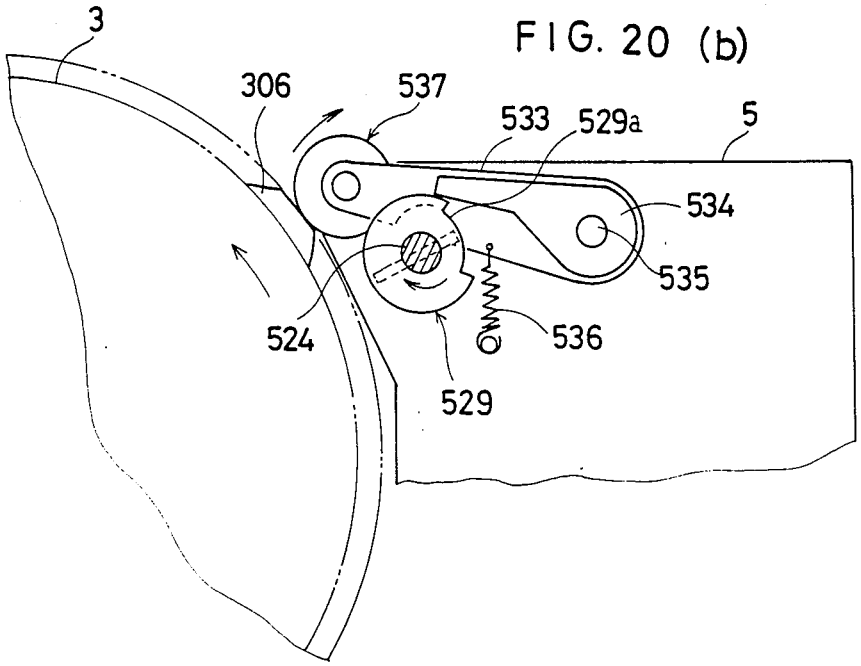

On the other hand, an unlocking cam 306 is secured to the external circumference of the plate cylinder 3 in the position opposite from an unlocking roller 537 as shown in FIG. 20 (*b*). Immediately after completing the plate feeding operation, the unlocking roller 537 runs over the unlocking cam 306. This causes the latchet 534 integrally set to the unlocking arm 533 to be rotated clockwise pivoting the shaft 535, and as a result, the tip end of the latchet 534 is disengaged from the concave 529*a* of the latchet wheel 529. As shown in FIG. 20 (*a*), the latchet wheel 529 is energized by the spring 532 via the shaft 524 and the arm 531 for rotating clockwise, and thus, when the latchet 534 is disengaged from the concave 529*a*, the latchet wheel 529 keeps rotating clockwise until coming into contact with the arm 531. When the shaft 524 rotates clockwise, the roller-supporting arm 526 also rotates clockwise, thus allowing the plate-holding rollers 525 to leave the plate cylinder 3.

(i) A plate-end hook-reset cam mechanism

Figure 21:
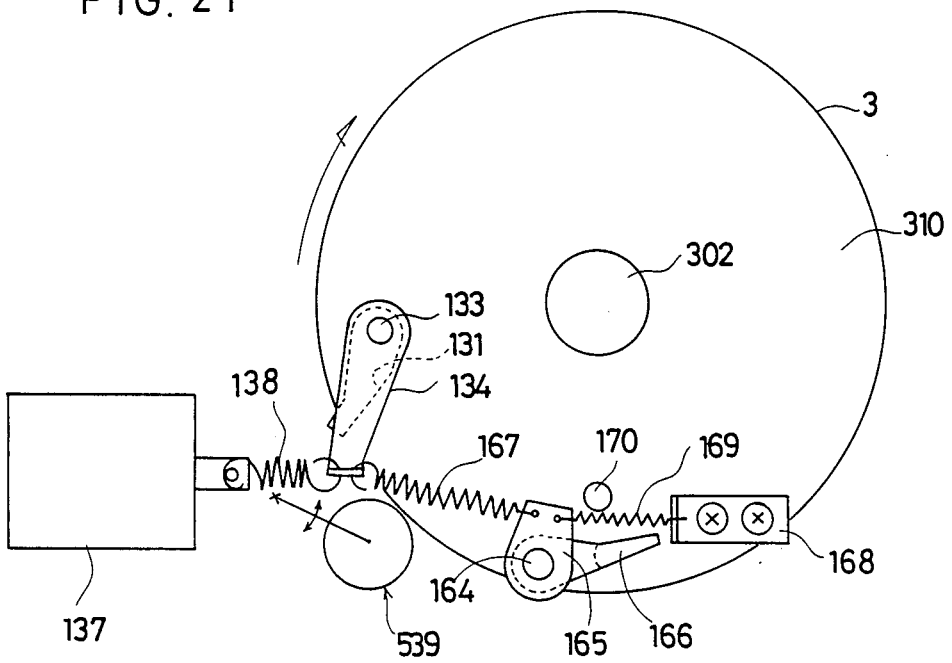
FIG. 21 explains the operations of the plate-end hook-set cam mechanism.

A plate-end hook-reset cam mechanism is installed to the right-side board 102 of the printing press body 1 as shown in FIG. 21. A link 165 and a plate-end hook-reset cam 166 are respectively secured to the external and internal edges of the shaft 164 which is installed through the right-side board 102 (not shown) so that it can freely rotate itself. In addition, a spring 167 is set between the link 165 and the lever 134 (which is already described in reference to FIG. 7). In addition, another spring 169 is set between the link 165 and a spring-holder 168 which is secured to the external surface of the right-side board 102.

Figure 22:
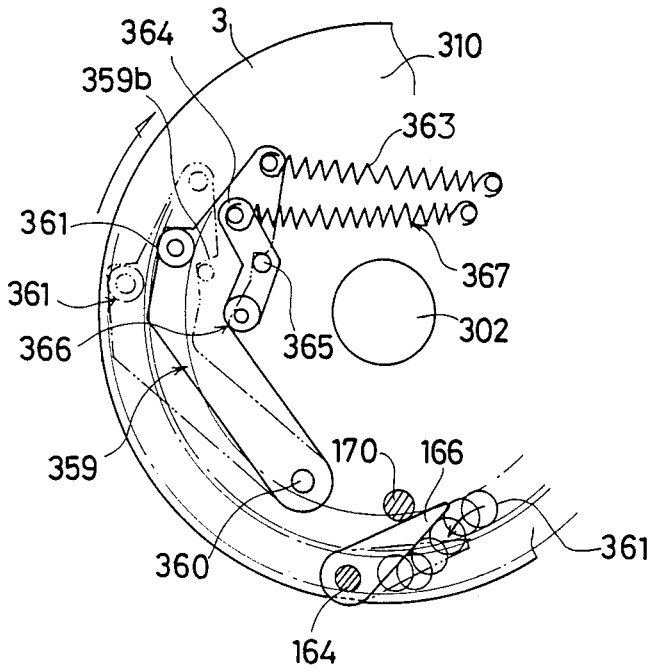
FIGS. 22 through 26 and 27 (*a*) respectively explain the operations of the plate-end-hook-operating mechanism.

These make up the plate-end hook-reset cam mechanism, while the functions of this mechanism are described below. When the solenoid 137 is activated, the lever 134 rotates clockwise pivoting the shaft 164, thus causing the link 165 to be rotated in the counterclockwise direction pivoting the shaft 164 via the spring 167. As a result, the plate-end hook-reset cam 166 secured to the shaft 164 also rotates counterclockwise. As shown in FIG. 22, rotation of the plate-end hook-reset cam 166 is inhibited by engaging itself with the stopper 170 which projects itself inside of the right-side board 102 of the printing press body 1. The activated state of the plate-end hook-reset cam 166 lasts while the solenoid 137 remains activated. When the solenoid 137 is OFF, operations reversing the procedure described above are executed. In other words, tractive force is released from the solenoid 137 to cause the lever 134 and the link 165 to respectively rotate themselves in the direction opposite from the operations described above by effect of tensile force from the spring 169. This causes the plate-end hook-reset cam 166 to eventually return to the original position to reset the entire operations.

(j) A plate-end hook operation mechanism

Figure 23:
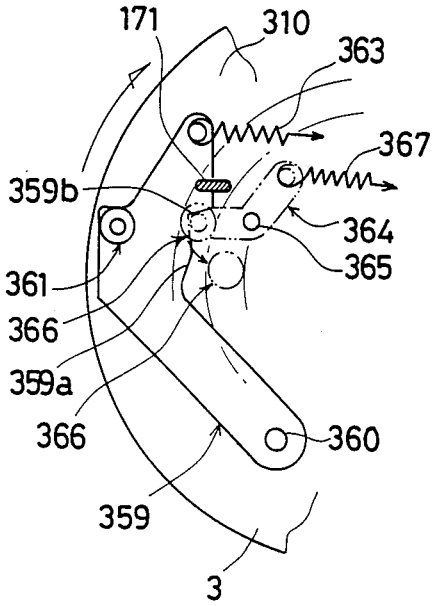

A plate-end hook operation mechanism is installed to the right side 310 of the plate cylinder 3 as shown in FIGS. 22 through 25. The plate-end hook operation mechanism is comprised of the following: As shown in FIGS. 22 and 23, a link 359 is installed to the external surface of the right side 310 of the plate cylinder 3 via a shaft 360 so that the link 359 can freely rotate itself. A cam follower 361 is set to the external surface of the link 359, whereas a pin 362 is projectively set to the internal surface of the link 359 as shown in FIG. 25. In addition, a tension spring 363 is installed between the tip end of the link 359 and the right side 310, thus allowing the link 359 to be energized so that it can rotate clockwise pivoting the shaft 360. Another link 364 is set to the external surface of the right side 310 via a shaft 365 so that the link 364 can freely rotate. A roller 366 is set to an end of the link 364, in which the roller 366 has the shaft end engaged with internal edge 359*a* of the link 359 so that it can freely rotate. A tension spring 367 is installed between the other end of the link 364 and the right side 310, thus allowing the link 364 to be rotated clockwise pivoting the shaft 365. When the link 364 is in the position for executing clockwise rotation shown in FIG. 23, it latches the link 359 at the position where the link 359 rotates counterclockwise by a specific angle pivoting the shaft 360 against tensile force from the spring 363 by causing the edge of the roller 366 to be engaged with the concave 359*b* of the link 359, thus eventually locking the link 359.

Figure 24:
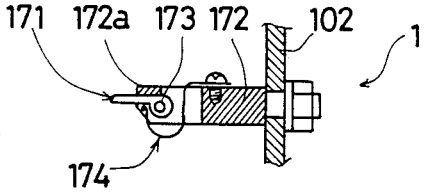
Figure 24:
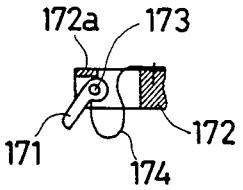

On the other hand, a plate-end hook setting cam 171 for unlocking the link 359 is installed to the printing press 1 body in the position corresponding to the link 364. As shown in FIG. 24, the plate-end hook setting cam 171 is set to the tip end of a cam-securing member 172 set to the internal surface of the right-side board 102 of the printing press body 1 via a horizontal shaft 173 so that the cam 171 can freely rotate. The plate-end hook setting cam 171 is energized by a spring 174 so that it can rotate clockwise, while the rotation of the cam 171 is constrained by a stopper member 172*a* of the cam-securing member 172 at the position at which the cam 171 is held horizontal posture. When the plate cylinder 3 rotates clockwise while the link 359 remains locked as shown in FIG. 23, the plate-end hook setting cam 171 is engaged with the link 364 to cause the link 364 to rotate counterclockwise pivoting the shaft 365, thus unlocking the link 359. Note that, when manually rotating the plate cylinder 3 in the counterclockwise direction during maintenance services, the plate-end hook setting cam 171 engages with the link 364. When this condition is present, since the cam 171 rotates counterclockwise pivoting the horizontal shaft 173 as shown in FIG. 24 (*b*) due to pressure from the link 364, neither the link 364 nor the cam 171 can be damaged.

On the other hand, as described earlier, the plate-end hooks 317 are secured to the hook shaft 316 shown in FIG. 25, which is energized by a torsion coil spring 318 so that they can rotate counterclockwise, and as a result, the link 319 secured to the right edge of the hook shaft 316 is engaged with a pin 362 installed to the link 359.

Figure 26:
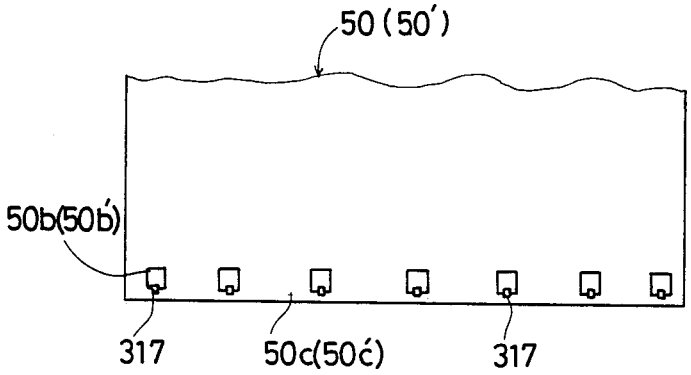

Next, function of the plate-end hook operation mechanism is described below. As shown in FIG. 22, after activating the plate-end hook-reset cam 166 by applying procedure described earlier, when the unlocked link 359 rotates itself up to the position of the plate-end hook-reset cam 166 by the clockwise rotation of the plate cylinder 3 as shown by solid line of FIG. 22, the cam follower 361 of the link 359 runs over the plate-end hook-reset cam 166. This causes the link 359 to rotate counterclockwise up to the position denoted by broken line of FIG. 22 pivoting the shaft 360 against tensile force from the spring 363. When the link 359 rotates counterclockwise, the link 364 is rotated clockwise pivoting the shaft 365 by tensile force from the spring 367. As a result, the pivoting shaft-end of the roller 366 engages with the concave 359*b* of the link 359 so that the link 359 can be locked at the position denoted by imarginary line of FIG. 22. When the link 359 rotates counterclockwise by the predetermined angle, in conjunction with this rotation, the pin 362 set to the link 359 moves to the left as shown in FIG. 25. As a result, this causes the link 319 engaged with the pin 362 rotates clockwise pivoting the hook shaft 316 against the energized force from the spring 318, thus causing the plate-end hooks 317 secured to the hook shaft 316 to rotate clockwise together with the hook shaft 316. In this case, as shown in FIGS. 26 and 27, if the printing plate 50' were mounted onto the plate cylinder 3, due to the clockwise rotation of the plate-end hooks 317, the plate-end hooks 317 are disengaged from the plate-end holes 50c', thus eventually releasing the plate-end clamping operation.

After continuous rotation, when the plate cylinder 3 reaches its rotation position shown in FIG. 23, the roller 366 of the link 364 then comes into contact with the plate-end hook-setting cam 171 so that the link 364 can be rotated counterclockwise pivoting the shaft 365. As a result, the edge of the roller 366 is disengaged from the concave 359b of link 359 to cause the link 359 to be rotated clockwise pivoting the shaft 360 by the energized force from the spring 363. When the link 359 rotates clockwise, as shown in FIG. 25, the link 319 is disengaged from the pin 362 to allow the plate-end hooks 317 to be rotated counterclockwise by the energized force from the spring 318. As shown by the imagenary line of FIG. 25 (*a*), the plate-end hooks 317 rotate counterclockwise while the plate-holding rollers 525 follows up its "contacting" operation. As a result, when the next printing plate 50 is supplied, the plate-end hook 317 then rotates counterclockwise while holding the plate-end 50c inside of the aperture 307 of the plate cylinder 3 by means of the plate holding rollers 525. As a result, the plate-end hooks 317 is caught by the plate-end holes 50b, thus allowing the tail edge 50c to be latched while being pulled in the direction of tangent of the external circumference of the plate cylinder 3.

(k) A mechanism for detecting a clamped printing plate and a deviated printing plate As shown in FIG. 9 (*b*), a mechanism for detecting a clamped printing plate and deviated printing plate is installed to the right side of the plate cylinder 3. This mechanism is comprised of the following: A mark member 375 is set to the link 319 secured to the right edge of the hook shaft 316. The plate-cylinder supporting shaft 302 is provided with a shaft-to-shaft distance regulation member 305 so that the member 305 can correctly keep the predetermined posture against the printing press body 1. The shaft-to-shaft distance regulation member 305 is provided with a photoelectric sensor 376 in the position corresponding to the mark member 375. The surface of the mark member 375 facing photoelectric sensor 376 is photoreflective. The photoelectric sensor 376 is comprised of light-emitting and light-receptive elements. When the mark member 375 is exactly set to the position facing the photoelectric sensor 376 by the rotation of the link 319, light from the light-emitting element is reflected by the mark member 375 before being incidented to the light-receptive element.

Figure 27:
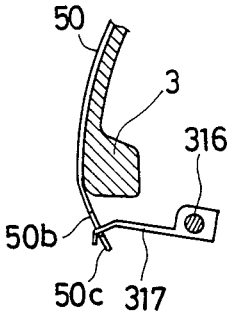
Figure 27:
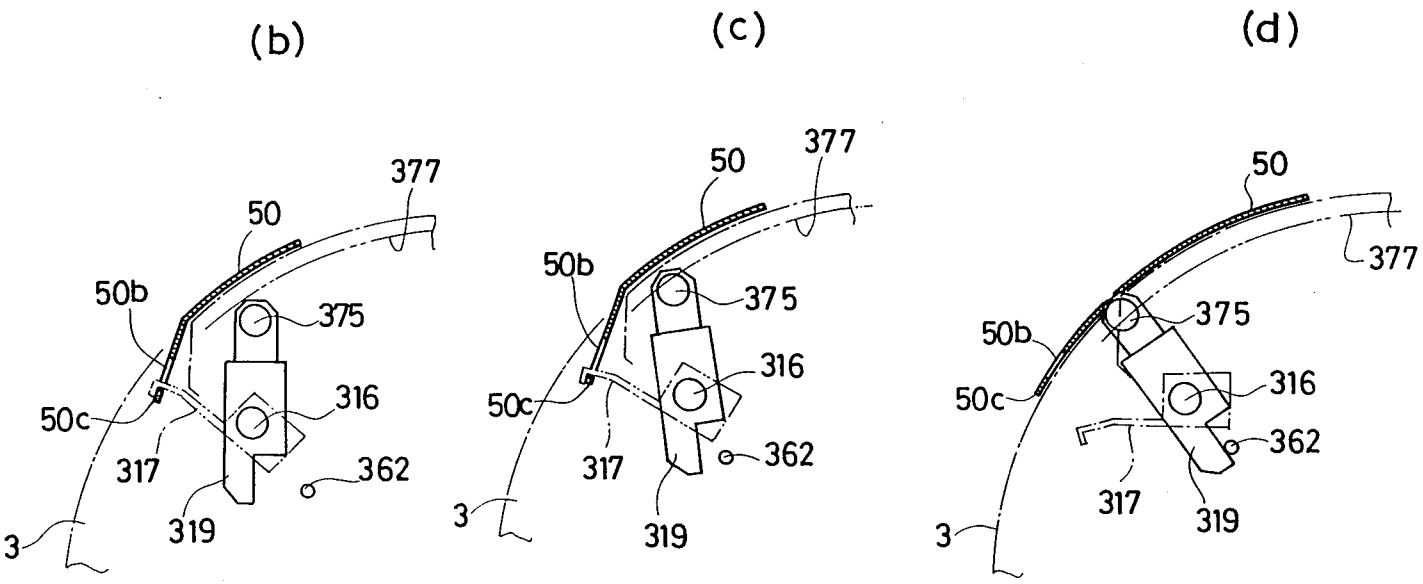

FIGS. 27 (*b*) through (*d*) respectively denote the plate-end clamped condition after feeding a printing plate. The curve line 377 denoted by means of 2-dot chained line indicates a track of the position detected by the photoelectric sensor 376 shown in FIG. 9 (*b*) in accordance with the rotation of the plate cylinder 3. As shown in FIG. 9 (*a*) and (*b*), when the plate end 50c is correctly latched by the plate-end hooks 317, the mark member 375 is off from the curve line 377, thus the mark member 375 cannot be detected by the photoelectric sensor 376. Conversely, as shown in FIG. 27 (*c*), if the plate-end holes 50b expand by damage or the plate head is incorrectly latched, the plate-end hooks 317 latches the tail edge 50c at the farther position of the counterclockwise rotation than that of FIG. 27 (*b*). Accordingly, the mark member 375 also rotates counterclockwise pivoting the hook shaft 316 by the amount exactly corresponding to the amount rotated by the plate-end hooks 317 counterclockwise. This causes the mark member 375 to be on the curve line 377, and as a result, the photoelectric esnsor 376 detects the presence of the mark member 375. Conversely, as shown in FIG. 27 (*d*), if the plate-end hooks 317 don't latch tail edge 50c, the link 319 rotates counterclockwise until it is engaged with the pin 362. Even when this operation is underway, since the mark member 375 is led to the curve line 377, the photoelectric sensor 376 correctly detects the presence of the mark member 375.

In this way, when the tail edge 50c is correctly latched by plate-end hooks 317, the photoelectric sensor 376 doesn't detect the presence of the mark member 375, whereas the photoelectric sensor 376 detects the presence of the mark member 375 only when either the position of the printing plate 50 deviates or the tail edge 50c don't latch, and thus, it makes possible for the control system to automatically detect the errors such as deviating of the printing plate 50 and/or the miss-latching of the tail edge 50c in accordance with the signal from the photoelectric sensor 376. The signal from the photoelectric sensor 376 is delivered to the microprocessor 21 shown in FIG. 2, which then identifies whether the plate-winding operation is correctly executed or not. If any error exists, the operation of the printing press immediately stops by the command from the microprocesser 21.

(l) Sectional constitution of the plate cylinder

Figure 29:
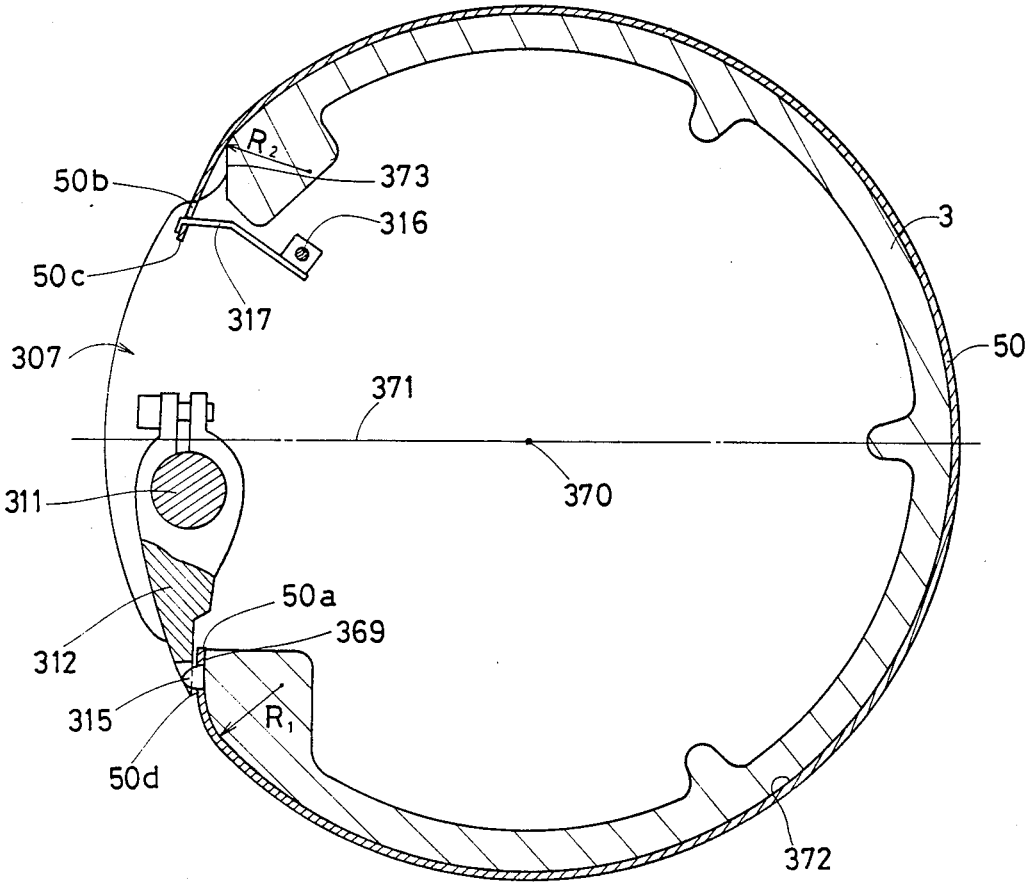

FIG. 29 denotes a sectional view of the plate cylinder 3. As shown here, corners of the aperture edge surface and external circumference surface of the plate cylinder 3 are provided with "R" configuration. More particularly, in the position of the plate-head holding mechanism, the plate-head contacting surface 369 is substantially made of flat surface crossing the assumed broken line 371 connecting the centers of aperture 307 and plate cylinder 3 at right angle, while the corners of the plate-head contacting surface 369 and the plate-cylinder external circumferential surface 372 are respectively provided with smooth curve surface having radius $R_1$. On the other hand, in the position of the plate-end holding mechanism, aperture edge surface 373 is substantially made of flat surface crossing the assumed broken line 371 in right angle, while the corners of the aperture edge surface 373 and the plate-cylinder external circumferential surface 372 are respectively provided with smooth curve surface having radius $R_2$. The "R" configuration provides the entire system with significant advantages described below. First, the plate head 50a is tightly pressed against the plate-head contacting surface 369 by the plate-head clamping nails 312. Then, when the printing plate 50 is wound onto the external circumferential surface 372 of the plate cylinder 3 while being held by the plate-holding roller 525 shown in FIG. 6, the printing plate 50 is tightly wound onto the plate cylinder 3 without generating even the slightest gap.

Furthermore, when the tail edge 50c is held by plate-end hooks 317 so that it is inwardly pulled to the aperture of the plate cylinder 3, the plate winding operation can be done by tightly fitting the tail edge 50c against the external surface of the plate cylinder 3. As a result, it is possible for the system to accurately wind the printing plate 50 onto the designated position of the plate cylinder 3. In this preferred embodiment, the radiuses $R_1$ and $R_2$ are respectively provided with 15 mm of length against 76.5 mm of the radius of the plate cylinder 3 for example.

(4) Procedure for manufacturing the printing plate and its constitution

Figure 30:
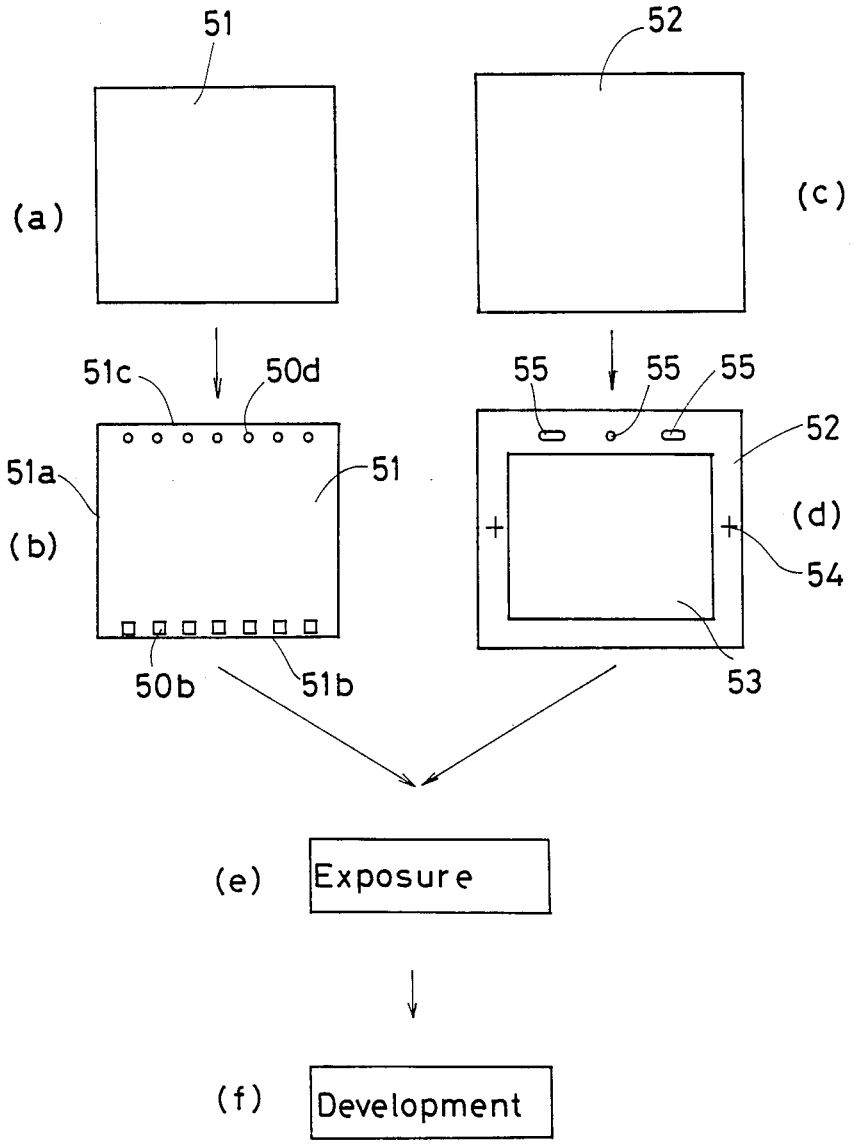
FIG. 30 is a chart denoting the manufacturing process of the printing plate.

Preceding the explanation of the automatic plate feeding/discharging operations, the procedure for manufacturing and the constitution of the printing plate 50 used for the printing press are described below. The plate 50 is manufactured by the procedure shown in FIG. 30. Concretely, as shown in FIG. 30 (*a*), an original plate 51 made of multiplied photosensitive resin layers laid on polyester film base is accuretely cut into a specific size using a knife. Next, as shown in FIG. 30 (*b*), the plate-head position of the original plate 51 is provided with plate-head holes 50d in the position corresponding to the register pins 315 shown in FIG. 9. Likewise, tail edge holes 50b are provided for the tail edge position of the original plate 51 so that they correspond to the plate-end hooks 317 shown in FIG. 9 (*a*). The positions of the plate-head holes 50d and plate-end holes 50b are respectively determined by referring to four sides of the original plate 51 including the both sides 51a, the tail edge side 51b, and the lead edge side 51c.

On the other hand, a printing pattern 53 and register marks 54 are respectively drawn on the original-plate film 52 shown in FIG. 9 (*c*) by applying a conventional precision register marking device. Also, in reference to the register mark 54 thus drawn, register holes 55 are formed at the tail edge position of the original-plate film 52 in order that it corresponds to the plate-head holes 50d. In this case, the center register hole 55 is provided with perfect roundness having the identical size to that of the plate-head hole 50d. In consideration of the thermal expansion of the original plate film 52, both sides of the original-plate film 52 are provided with lengthy register holes 55 having the long axis in the horizontal direction.

Next, register pins (not shown) are provided through the register holes 55 and the plate-head holes 50d before laying the original-plate film 52 on the original plate 51. After completing the positioning of the printing plate, exposure process shown in FIG. 30 (*e*) is then executed to allow the printing pattern 53 to be printed to the designated position of the original plate 51. After completing the exposure process, developing process shown in FIG. 30 (*f*) is applied to the prepared plate, thus a complete printing plate 50 is eventually produced.

(5) Plate feeding/discharging operation

Figure 31A:
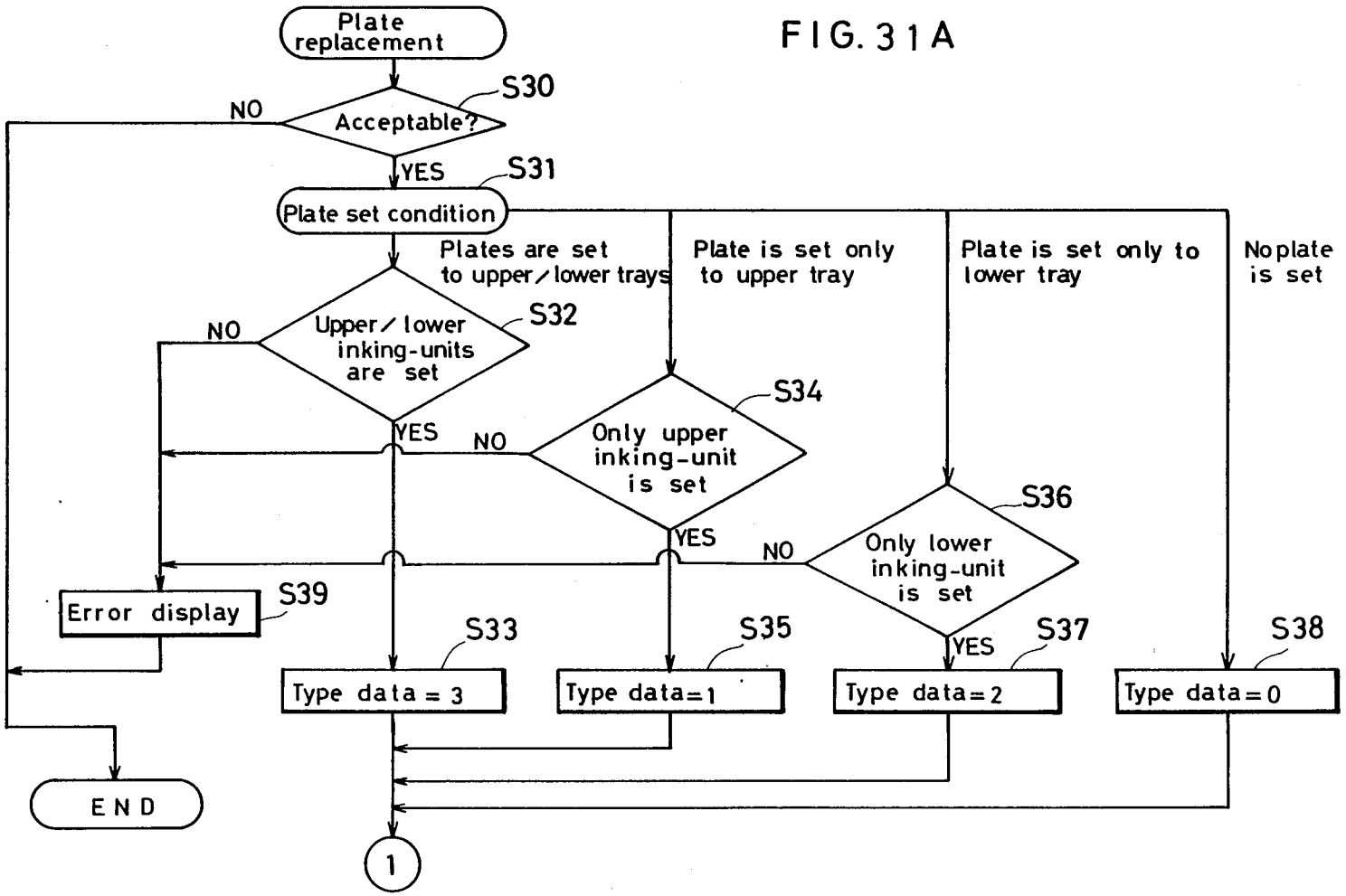
FIGS. 31A and 31B are flowcharts denoting the operations of a microprocessor in such a case a plate-replacing command signal is generated.
Figure 31B:
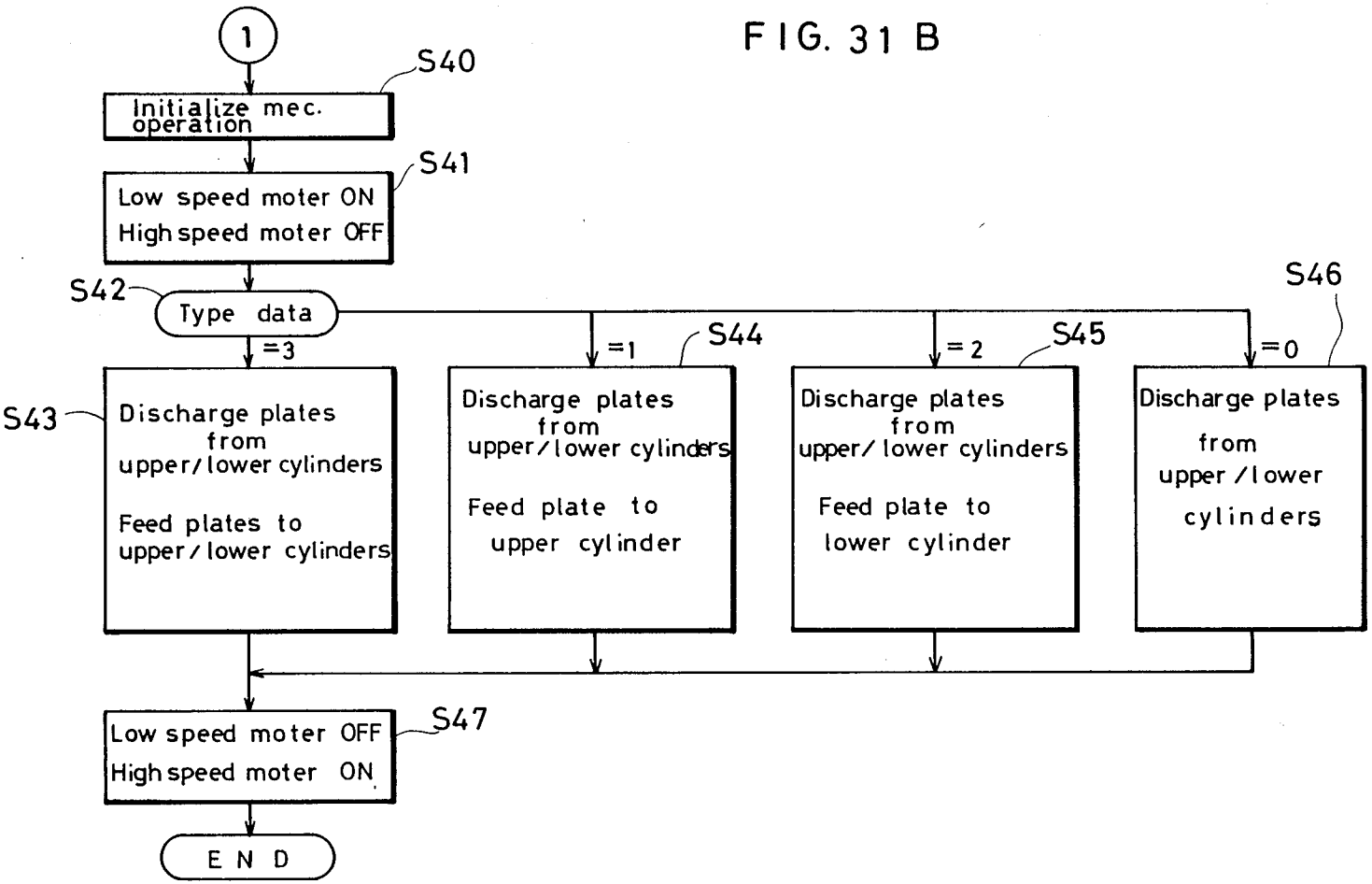

Next, the plate feeding and discharging operation before replacing the printing plate is described below. FIGS. 31A and 31B are the flowcharts describing the operation of microprocessor 21 shown in FIG. 2 when the microprocessor 21 receives the plate-replacing command signal for example from the plate-replacing key of the operation panel depressed by the operator.

When the plate-replacing command signal is generated, the microprocessor 21 then judges in the step S30 whether the command signal is acceptable, or not. If the command signal is not acceptable, the microprocessor 21 allows the entire operations to be completed. If the command signal is acceptable, operation mode proceeds to the next step S31.

When step S30 is entered, the microprocessor 21 judges whether the printing plates are set on the plate feeding/discharging trays 9 and 10 or not. Concretely, the printing plates are set by the procedure described below. See FIG. 6. The plate-head holes 50d of the printing plate 50 to be newly printed (hereinafter called new plate) is slightly inserted between the plate-feeding driving rollers 510 and the auxiliary plate-feeding driving rollers 520. The rollers 520 remain apart from the rollers 510 when the plate-head holes 50d is inserted between these. Then, both sides of the new plate 50 are properly positioned along the lateral positioning members 904 of the plate feeding/discharging tray 9 or 10 shown in FIG. 8. Likewise, the tail edge edge of the new plate 50 is properly positioned along the plate-end positioning member 903 of the plate feeding/discharging tray 9 or 10. Using the sensor 544 (see FIG. 3(*c*)) detecting the presence of the printing plate installed to the plate feeding/discharging unit 5 or 6, the microprocessor 21 judges whether the new plate 50 is set in position or not while the step S31 is underway.

If the microprocessor 21 judges that the new plates 50 are set to the plate feeding/discharging trays 9 and 10 i.e., when executign two-color printing, the operation mode proceeds to the step S33 on the condition that the state in which the inking units 7 and 8 are both correctly set in the position should be confirmed while the step S32 is still underway. When the step S33 is entered, a type-data is set to the condition "3" for example so that this can be stored in the memory. While the step S31 is underway, if the microprocessor 21 judges that the new plate 50 is merely set to the plate feeding/discharging tray 9 of the upper-stage, i.e., when executing one-color printing operation, the operation mode proceeds to the step S34 on the condition that the state in which the inking unit 7 of the upper-stage is properly set should be confirmed while the step S34 is still underway. When the step S35 is entered, a type-data is set to the condition "1" for example, which is stored in the memory. When the step S31 is underway, if the microprocessor 21 judges that the new plate 50 is merely set to the plate feeding/discharging tray 10 of the lower-stage, i.e., when executing one-color printing operation, the operation mode proceeds to the step S37 on the condition that the state in which the inking unit 8 of the lower-stage is correctly set should be confirmed while the step S36 is still underway. When the step S37 is entered, a type-data is set to the condition "2", which is then stored in the memory. In addition, when the step S31 is underway, if the microprocessor judges that the new plate 50 is not set to either of the plate feeding/discharging trays 9 and 10, i.e., when executing the plate discharging operation, the operation mode proceeds to the step S38, where a type-data is set to the condition "0" for example, which is then stored in the memory. If the designated inking unit 7 or 8 were not loaded while any of the steps S32, S34 and S36 is underway, the operation mode proceeds to the step S38 to display ERROR before discontinuing the entire operations.

After completing provision of the type-data while any of the steps S33, S35, S37 and S38 is underway, the operation mode then proceeds to the step S40 to execute mechanical initializing operation. This causes the plate cylinders 3 and 4 and the impression cylinder 11 to depart from blanket cylinder 2, and in addition, inking units 7 and 8 are set to the positions where they can depart from the plate cylinders 3 and 4.

Next, when the step S40 is entered, a low-speed motor is turned ON and a high-speed motor OFF. Thus allowing the blanket cylinder 2, the impression cylinder 11, the plate cylinders 3 and 4, and form rollers of inking units 7 and 8 to respectively start to rotate at a speed slower than the normal printing operation.

Next, when the step S42 is entered, the microprocessor 21 judges the state of the type-data stored in the memory. If the state of the type-data is judges to be "3", i.e., when feeding the upper and lower printing plates, the operation mode proceeds to the step S43 to allow the plate cylinders 3 and 4 to respectively execute the plate feeding/discharging operation. When the type-data is judged to be in the state "1", i.e., when feeding only the upper printing plate, the operation mode proceeds to the step S44 to allow the plate cylinder 3 to feed and discharge the printing plates and the plate cylinder 4 to merely discharge the printing plate. Likewise, if the type-data is judged to be in the state "2", i.e., when feeding only the lower printing plate, the operation mode proceeds to the step S45 to allow the plate cylinder 4 to feed and discharge the printing plates and the plate cylinder 3 to merely discharge the printing plate. When the type-data is judged to be in the state "0", i.e., when merely discharging the printing plates, the operation mode proceeds to the step S46 to allow both the plate cylinders 3 and 4 to merely discharge the printing plates. In this case, the difference between the plate feeding/discharging operation and the plate-discharging operation merely arises from the presence of absence of the driving force generated by the pulse motor 509 shown in FIG. 3 (*d*) that rotates the plate-feeding driving rollers 510 and the auxiliary plate-feeding driving rollers 520 shown in FIG. 7. In other words, when executing the plate feeding/discharging operation, the pulse motor 509 is driven for a specific period of time using the predetermined timing to forward the printing plate, whereas the pulse motor 509 remains OFF when executing only the plate-discharging operation without feeding the printing plate at all.

After completing the entire operations needed for feeding and discharging the printing plates while the operation mode remains in the steps S43 through S46, the operation mode is entered the stap S47, in which the low-speed motor turns OFF and the high-speed motor ON, thus the slow-speed rotation of the blanket cylinder 2, the impression cylinder 11, the plate cylinders 3 and 4, and the form rollers of inking units 7 and 8 is switched to the high-speed rotation. This completes the entire operations needed for replacing the printing plates, while these sequential operations are activated by the microprocessor 21 shown in FIG. 2 when receiving the plate-replacing command signal from the key-input operation.

Figure 28:
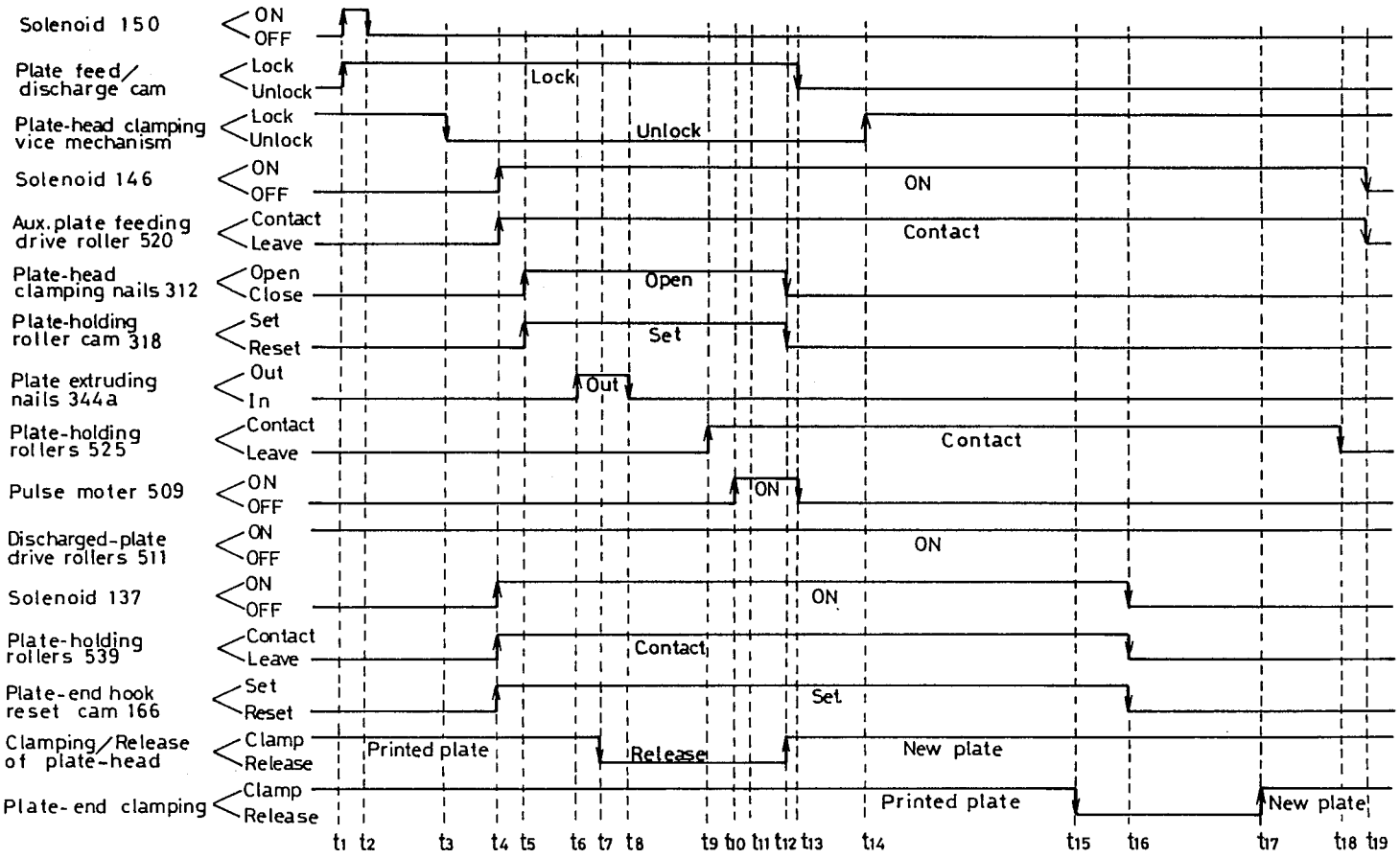
FIG. 28 is a timing chart denoting the operations of the plate feeding and discharging mechanism.

Referring now to the timing chart shown in FIG. 28, the plate feeding/discharging operations including those operations executed by a variety of mechanical components are described below. Note that the following describes those specific examples in which a new plate 50 is placed on the plate-feeding table 901 of the plate feeding/discharging tray 9, and yet, a printing-completed plate 50′ (hereinafter called the printed plate) is wound on the plate cylinder 3, i.e., denoting the state in which the plate feeding/discharging operation is executed on the part of the plate cylinder 3. In the case of the other situations, since the plate feeding/discharging operations are executed based on the principles identical to those which are described above, the description of these is deleted.

First, on receipt of the plate-replacing command signal, when the plate cylinder 3 starts to rotate itself, the plate-discharging driving rollers 511 connected to the plate-cylinder gear 301 starts to rotate counterclockwise at a constant speed via gear mechanism as shown in FIG. 7. While the plate feeding/discharging operations are underway, the plate-discharging driving rollers 511 continues their rotation.

Next, as soon as the plate cylinder 3 reaches the predetermined rotation position at time "$t_1$", the solenoid 150 shown in FIG. 10 is activated to cause the set-lever 153 to rotate counterclockwise pivoting the shaft 151 to also rotate the plate feeding/discharging cam 157 and the plate-discharging cam 163 shown in FIG. 12 counterclockwise before being locked by the lock-lever 159.

Next, as soon as time "$t_2$" is reached, the solenoid 150 turns OFF itself, whereas the plate feeding/discharging cam 157 shown in FIG. 10 still remains being locked by the lock-lever 159, thus allowing the plate feeding/discharging cam 157 and the plate-discharging cam 163 shown in FIG. 12 to be respectively latched at the designated rotation positions.

When time "$t_3$" is reached through the rotation of the plate cylinder 3, the roller 341 of the link 338 runs over the plate feeding/discharging cam 157 as shown in FIG. 15, thus allowing the link 338 to rotate clockwise pivoting the shaft 339 to cause the link 334 to be pushed in the direction of the external surface of the plate cylinder 3 by the roller 342 before unlocking the plate-head clamping vice mechanism. This allows the nail shaft 311 to rotate counterclockwise.

Next, when time "$t_4$" is reached, the solenoid 146 shown in FIG. 6 turns ON itself to activate the counterclockwise rotation of the driver lever 140 pivoting the drive shaft 142. This causes the operation lever 521 to be rotated clockwise pivoting the driving shaft 518 before the auxiliary plate-feeding driving rollers 520 are pressed against the plate-feeding driving rollers 510. As a result, the head of the new plate 50 is nipped by the rollers 510 and 520. On the other hand, the solenoid 137 shown in FIG. 7 turns ON itself to cause the driver lever 131 to be rotated clockwise pivoting the driving shaft 133. This allows the operation lever 541 to be rotated in the counterclockwise direction pivoting the rotary shaft 538 so that the plate-holding rollers 539 can correctly be set to the position allowing its contact with the plate cylinder 3. The plate-holding rollers 539 come into contact with the plate cylinder 3 when they are moved to the aperture 307 of the plate cylinder 3. When the solenoid 137 is ON, the link 165 and the shaft 164 shown in FIG. 21 respectively rotate counterclockwise, thus allowing the plate-end hook-reset cam 166 to be set to the position shown in FIG. 22.

When time "$t_5$" is reached, the roller 320 of the link 322 shown in FIG. 15 (*a*) runs over the plate feeding-/discharging cam 157 to cause the link 321 to be rotated counterclockwise together with the nail shaft 311 shown in FIGS. 15 (*b*) and (*c*) so that the plate-head clamping nails 312 can open themselves. When the nail shaft 311 rotates counterclockwise, the link 355 shown in FIG. 18 also rotates counterclockwise as shown in FIG. 18 (*c*) and (*d*), thus eventually setting the plate-holding roller cam 356 in position.

Next, when time "$t_6$" is reached, as shown in FIG. 12 (*b*), the plate-holding rollers 539 run over the plate cylinder 3 by passing through the aperture 307 to cause the head of the printed plate 50' wound on the plate cylinder 3 to be nipped by the plate-holding rollers 539 and the plate cylinder 3. On the other hand, as shown in FIG. 12 (*a*), the cam follower 350 runs over the plate-discharging cam 163. Then, as the plate cylinder 3 keeps on rotating itself, the plate-extrusion nails **344*a* protrude themselves to extrude the lead edge 50*a'* of the printed plate 50' from the plate-head register pins 315 at the moment when time "$t_7$" is reached. This disengages the lead edge 50*a'* of the printed plate 50'** from the state of being clamped.

Next, when time "$t_8$" is reached, as shown in FIG. 14 (*a*), the cam follower 350 moves its position to the second cam surface **163*b* of the plate-discharging cam 163 so that the plate-extrusion nails 344*a* can return to the original state of withdrawal. On the other hand, the lead edge 50*a'* of the printed plate 50' is delivered between the plate-discharging guides 517 and the plate-discharging driving rollers 511** as shown in FIG. 14 (*b*). After allowing the passage of the lead edge **50*a'* of the printed plate 50' through the plate-discharging guides 517 and the plate-discharging driving rollers 511, the printed plate 50' is delivered to the plate-discharging table 902 of the plate-feeding/discharging tray 9 by the plate-discharging driving rollers 511** shown in FIG. 7.

Next, when time "$t_9$" is reached, as shown in FIG. 18 (*d*), the plate-holding activation rollers 530 of the plate feeding/discharging unit 5 run over the plate-holding rollers cam 356 to allow the plate-holding roller 525 shown in FIG. 19 (*a*) to be correctly set to the plate holding position. The contacting activation between the plate-holding operation rollers 530 and the plate-holding roller cam 356 is done while the plate-holding roller 525 are exactly at the aperture 307 of the plate cylinder 3. As soon as the plate-holding rollers 525 are set to the plate holding position, the latchet 534 shown in FIG. 19 (*b*) is engaged with the concave **529*a* of the latchet wheel 529 to allow the plate-holding rollers 525** to be securely locked in the plate-holding position.

Next, when time "$t_{10}$" is reached, the activated pulse motor 509 shown in FIG. 3 (*d*) provided for the plate feeding/discharging unit 5 drives the plate-feeding driving rollers 510 and the auxiliary plate-feeding driving rollers 520 to allow the new plate 50 nipped by these rollers 510 and 520 to be delivered, while the head **50*a* of the new plate 50 is first forwarded to the space 368 between the plate-head clamping nails 312 and the plate-head register pins 315. As soon as the plate head 50*a* is delivered to the predetermined position inside of space 368, as shown in FIG. 16, the roller 320 of the link 322 reaches the concave 157*c* of the plate feeding/discharging cam 157, thus allowing the plate-head clamping nails 312 to close itself at the moment when time "$t_{11}$" is present. Next, when time "$t_{12}$" is reached, the register pins 315 are first engaged with the pin holes of the lead edge 50*a*, and then the plate head 50*a* is securely pressed against the plate cylinder 3 by the plate-head clamping nails 312**.

While the lead edge **50*a* is thus latched, as shown in FIG. 18, in conjunction with the rotation of nail shafts 311, the plate-holding roller cam 356** returns to the reset condition shown in FIG. 18 (*c*) from the activated state shown in FIG. 18 (*d*).

Immediately after the plate-head clamping is done, as shown in FIG. 19 (*a*), the plate-holding rollers 525 run over the plate cylinder 3 after passing through the aperture 307 of the plate cylinder 3 to allow the plate-holding rollers 525 to press the new plate 50 against the plate cylinder 3.

Next, when time "$t_{13}$" is reached, the pulse motor 509 turns OFF itself, thus causing both rollers 510 and 520 shown in FIG. 6 to stop forwarding operation of the new plate 50. Then, the new plate 50 being nipped by both rollers 510 and 520 shown in FIG. 6 is drawn out of the plate-feeding table 901 by the rotation force of the plate cylinder 3. In the meantime, the pressure from the plate-holding rollers 525 against the plate cylinder 3 effectively prevents the new plate 50 from incurring even the slightest slack before the new plate 50 is eventually wound onto the plate cylinder 3. Immediately after both rollers 510, 520 have stopped the plate-forwarding operation as shown in FIG. 6, the detection means such as the encoder of pulse motor 509 for example correctly detects whether these rollers 510 and 520 are continuously rotated, or not. The microprocessor 21 shown in FIG. 2 eventually judges whether such a rotation actually occurs with these rollers 510, 520 or not by checking to see that the predetermined number of pulses are correctly output from the encoder of the pulse motor 509 within a specific period of time immediately after the pulse motor 509 is OFF in accordance with the command signal from the microprocessor 21 itself. If the rotation is detected, in other words, when the plate-head clamping nails 312 still locks the lead edge **50*a*, the microprocessor 21 generates the command signal for continuously executing the plate feeding/discharging operation. Conversely, if the rotation is not detected, in other words, when the plate-head clamping nails 312 incorrectly locks the lead edge 50*a*, the microprocessor 21 generates the command signal to immediately stop the operation of the motor 20 of the printing press shown in FIG. 1 for terminating the plate feeding/discharging operation on the way of the printing operation. When allowing the plate feeding/discharging operation to be continuously executed, immediately after time "$t_{13}$" is past, the lock-lever 159 is kicked upward by the roller 320 of the link 322 as shown in FIG. 16 to eventually unlock the plate feeding discharging cam 157 and the plate-discharging cam 163** shown in FIG. 12 (*a*).

Figure 17:
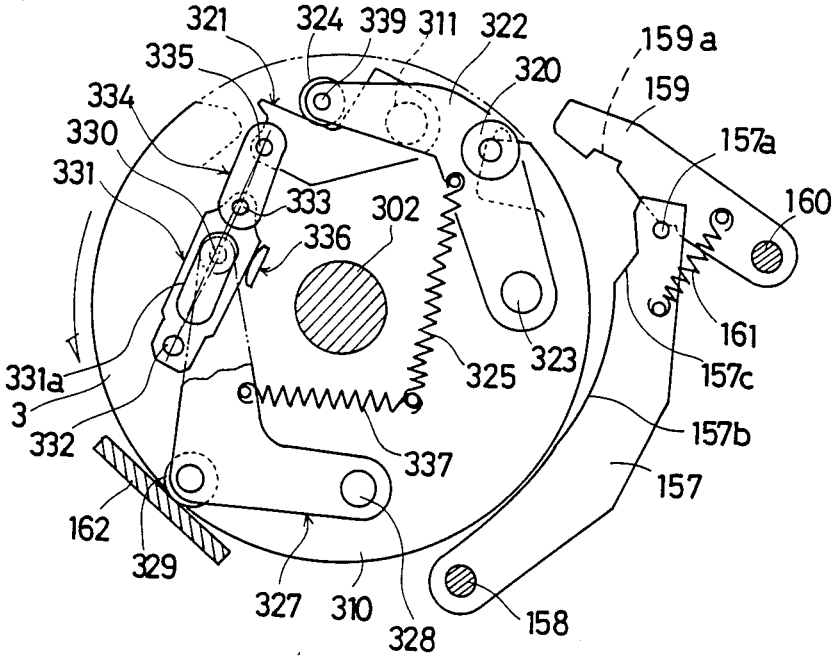

Next, when time "$t_{14}$" is reached, the plate-head clamping vice mechanism is locked. Concretely, first, as shown in FIG. 16, the roller 329 of the link 327 is pressed against the plate-head clamping-nail locking cam 162 to cause the link 327 to rotate clockwise pivoting the shaft 328 as shown in FIG. 17. As a result, the link 331 rotates clockwise pivoting the shaft 332 to move the pin 333 by a negligible distance towards inner part of the plate cylinder 3 than the straight line connecting the shaft 332 and the pin 335 across the top dead center, thus allowing the link 331 to lock itself. While the link 331 remains being locked itself, the link 321 forcibly rotates clockwise together with the nail shaft 311. This provides the plate-head clamping nails 312 with powerful pressure which allows the plate head **50*a*** to be securely locked.

Next, when time "$t_{15}$" is reached, the clamped condition of the tail edge of the printed plate 50' is released. Concretely, the cam follower 361 of the link 359 runs over the plate-end hook-reset cam 166 shown in FIG. 22, thus causing the link 359 to rotate counterclockwise pivoting the shaft 360, whereas the link 364 is rotated clockwise pivoting the shaft 365 by the energized force from the spring 367 so that the link 359 can securely be locked in its counterclockwise rotation position. When the link 359 rotates counterclockwise, the link 319 shown in FIG. 25 is pressed by the pin 362 of the link 359 so that it starts to rotate clockwise together with the hook shaft 316. As a result, the plate-end hooks 317 also rotates clockwise to disengage themselves from the plate-end holes 50' of the printed plate 50' to completely free the printed plate 50' from the plate-end clamping mechanism.

Next, when time "$t_{16}$" is reached and then the plate-head holes **50*d*' of the printed plate 50' shown in FIG. 7 passes through the plate-holding rollers 539, the solenoid 137 turns OFF. This causes the driver lever 131 to rotate counterclockwise pivoting the driving shaft 133, thus causing the operation lever 541 to be rotated clockwise pivoting the rotary shaft 538 by the energized force from the return spring. This allows the plate-holding rollers 539 to leave the plate cylinder 3. Then, while being forwarded by the plate-discharging driving rollers 511, the printed plate 50' is eventually stored inside of the plate-discharging table 902, thus completing the operation needed for discharging the printed plate 50'. On the other hand, when the solenoid 137 turns OFF, the link 165 and the shaft 164 shown in FIG. 21 are respectively rotated clockwise by the tensile force from the spring 169, thus eventually causing the plate-end hook-reset cam 166** to also rotate clockwise before returning to the reset position.

Next, when time "$t_{17}$" is reached, the end position of the new plate 50 is clamped. Concretely, as shown in FIG. 25 (*a*), as soon as the plate-holding rollers 525 passe through the external circumference of the plate cylinder 3, the plate-holding rollers 525 is led inside of aperture 307 by the energized force from the spring 527 shown in FIG. 19, and at the same time, the plate-holding rollers 525 causes the plate end **50*c* of the new plate 50 to be compulsorily inserted into the circumference of the plate cylinder 3. On the other hand, the plate-end hook setting cam 171 shown in FIG. 23 engages itself with the roller 366 of the link 364 simultaneous with the timing of inserting the tail edge 50*c* of the new plate 50 into the aperture 307. As a result, the link 364 starts to rotate counterclockwise pivoting the shaft 365, thus unlocking the link 359, which is then rotated clockwise pivoting the shaft 360 by the tensile force from the spring 363. When the link 359 rotates clockwise, the engagement of the link 319 with the pin 362 shown in FIG. 26**(*b*) is released so that the link 319 can be rotated counterclockwise together with the hook shaft 316 by the energized force from the torsion coil spring 318, thus causing the plate-end hooks 317 to also rotate counterclockwise. Those serial operations from the engagement of the plate-end hook setting cam 171 with the roller 366 of the link 364 to the activation of the counterclockwise rotation of the plate-end hooks 317 are instantly executed. The counterclockwise rotation of the plate-end hooks 317 engage themselves with the plate-end holes **50*b* of the new plate 50, thus causing the tail edge 50*c* of the new plate 50 to be eventually locked by being pulled in the direction of the tangent of the external surface of the plate cylinder 3**.

When time "$t_{18}$" is reached immediately after the new plate 50 is wound onto the plate cylinder 3, the plate-holding rollers 525 start to leave the plate cylinder 3. Concretely, as shown in FIG. 20 (*b*), the unlocking roller 537 kicks upwards by the unlocking cam 306 to disengage the tip end of the latchet 534 from the concave **529*a* of the latchet wheel 529. As a result, the rotary shaft 524 rotates clockwise on receipt of the tensile force from the spring 532 shown in FIG. 20** (*a*) to allow the plate-holding rollers 525 to leave the plate cylinder 3.

Next, whem time "$t_{19}$" is reached, the solenoid 146 shown in FIG. 6 turns OFF to cause the driver lever 140 to be rotated clockwise pivoting the drive shaft 142 by the energized force from the spring 144. This also causes the operation lever 521 to be rotated counterclockwise pivoting the driving shaft 518 by the energized force from the return spring. As a result, the auxiliary plate-feeding driving rollers 520 leave themselves from the plate-feeding driving rollers 510, thus eventually completing the entire operations needed for feeding the new plate 50.

Since the plate-feeding mechanism reflecting the preferred embodiment of the present invention executes both the feeding and discharging operations of the printing plates simultaneously while the plate cylinder 3 makes almost a full turn, it is possible for the printing press to effectively shorten time needed for replacing of the printing plates, and at the same time the double plate feeding operation can securely be prevented.

(6) Advantageous effect from the plate-mounting system embodied by the present invention As was described earlier in reference to FIG. 30, the printing plate 50 used for the printing press is provided with the plate-head holes **50*d* whose positions are accurately determined using the both sides 51*a*, the tail edge side 51*b* and the lead edge side 51*c* as the basis. The printing plate 50 is securely set to the designated position of the plate feeding/discharging tray 9 in reference to the both sides 51*a* and the tail edge side 51*b*. The plate-mounting mechanism reflecting the present invention activate the plate feeding/discharging unit 5 to forward the printing plate 50 towards the plate cylinder 3 by the predetermined distance in relation to the rotation of the plate cylinder 3 so that the plate-head holes 50*d* can be engaged with the plate-head register pins 315 shown in FIG. 7 set to the plate cylinder 3, thus allowing the printing plate 50 to be accurately mounted onto the plate cylinder 3**.

Thus, the plate-mounting mechanism embodied by the present invention provides the plate-head holes **50*d* in reference to four sides of the printing plate 50, and yet, executes the plate-head holding operation after forwarding the printing plate 50 towards the plate cylinder 3 by the predetermined distance on the basis of these four sides. As a result, it is possible to accurately mount the printing plate 50 onto the designated position of the plate cylinder 3**.

Note that the positioning of the plate-head holes **50*d* may not always be done in reference to all the four sides of the printing plate 50. In summary, the positioning may be determined in reference to at least two cross sides of the printing plate 50 such as a side 51*a* and the tail edge side 51*b* or a side 51*a* and the lead edge side 51*c* for example. If this method is employed, the plate-forwarding mechanism, i.e., the plate feeding/discharging unit 5 forwards the printing plate 50 on the basis of said two cross sides of the printing plate 50**.

(7) Functions of the plate-head clamping vice mechanism and the vice-releasing mechanism For details of the constitutions and functions of the plate-head clamping vice mechanism and the vice-releasing mechanism, review of foregoing descriptions "(e). A plate-head clamping vice mechanism and a vice-releasing mechanism" and "(5) Plate feeding/discharging operation" by referring to FIG. 28. In summary, when time "$t_1$" is reached through the rotation of the plate cylinder 3, the plate feeding/discharging cam 157 is locked. Next, when time "$t_3$" is reached, the roller 341 of the link 338 runs over the plate feeding/discharging cam 157 so that the vice mechanism is unlocked as shown in FIG. 16. Then, when time "$t_5$" is reached, the roller 320 of the link 322 runs over the plate feeding-/discharging cam 157 to open the plate-head clamping nails 312 as shown in FIG. 11(*b*). Next, when time "$t_{12}$" is reached, i.e. when the roller 320 is engaged with the concave 157*c* of the plate feeding/discharging cam 157, the plate-head clamping nails 312 are closed by the energized force from the spring 326 to clamp the plate head as shown in FIG. 16. Next, when time "$t_{13}$" is reached, the roller 320 kicks the lock lever 159 upwards to unlock the plate feeding/discharging cam 157. When time "$t_{14}$" is reached immediately after time "$t_{13}$" is past, the roller 329 of the link 327 runs over the plate-head clamping nail locking cam 162 to securely lock the vice mechanism, thus continuously providing the plate-head clamping nails 312 with powerful pressure.

Immediately after the plate-head clamping is done, in addition to the energized force from the spring 326 shown in FIG. 11 (*b*), the plate-head clamping nails 312 receive the powerful pressure from the vice mechanism, and as a result, the plate head can solidly be locked, and yet, the printing plate 50 mounted onto the plate cylinder 3 can securely be prevented from falling off while the printing operation is underway. The vice mechanism can automatically be locked and unlocked relative to the rotation of the plate cylinder 3. (8) Function of the plate-end holding mechanism As shown in FIGS. 25 through 27 (*a*), the plate-end holding operation is executed by the procedure described below. First, the plate-end hooks 317 set to the aperture 307 of the plate cylinder 3 is engaged with the plate-end holes 50*b* of the printing plate 50 wound onto the external surface of the plate cylinder 3, and then the tail edge is pulled in the direction of the tangent of the external circumference of the plate cylinder 3 by the plate-end hooks 317 using the energized force from spring means, thus allowing the tail edge to be securely held. Thus, the plate-end holding mechanism related to the present invention pulls the plate end 50*c* towards the tangent of the external surface of the plate cylinder 3 using the energized force from the spring means before securely holding it instead of bending the tail edge 50*c* against the aperture edge surface of the plate cylinder 3 before holding it. As a result, even when the plate base film is made of highly rigid material such as polyester film, aluminum, or steel for example, the plate-end holding mechanism embodied by the present invention securely holds the tail edge 50*c* by effectively using the plate-end hooks 317.

(9) Function of the mechanism for detecting a clamped printing plate and a deviated printing plate As shown in FIGS. 9 (*b*) and 27(*b*) through (*d*), the mechanism for detecting a clamped printing plate and a deviated printing plate comprised of the mark member 375 and the photoelectric sensor 376 is installed to the right of the plate cylinder 3. According to this plate-detection mechanism, as shown in FIG. 27 (*b*), when the plate-end hooks 317 correctly locks the tail edge 50*c*, the photoelectric sensor 376 doesn't detect the presence of the mark member 375. Conversely, as shown in FIG. 27 (*c*) and (*d*), when the plate is either incorrectly positioned or the tail edge is not caught by the plate-end hooks 317, the photoelectric sensor 376 detects the presence of mark member 375. As a result, in accordance with the signal output from the photoelectric sensor 376, any error in conjunction with the plate-winding operation such as the position-deviated plate and/or failure of the plate holding operation can be detected automatically.

The plate detection mechanism don't limited only the constition above mentioned. It is possible for the plate detection mechanism to apply every constitution which detects a clamped on delivered printing plate with reference to the rotational position of the plate-end hooks 317.

Note that the plate detection mechanism can concurrently be made available for detecting whether the printing plate 50 is wound onto the plate cylinder 3 or not. Specifically, when the printing plate 50 is wound onto the plate cylinder 3, the rotation position of the plate-end hooks 317 is as shown in FIG. 27 (*b*), whereas the rotation position of this hooks 317 is as shown in FIG. 27 (*d*) when the printing plate 50 is not wound onto the plate cylinder 3. Thus, like the operation described above, it is possible for the photoelectric sensor 376 to correctly detect the presence or absence of the printing plate 50 on the plate cylinder 3 by method of detecting the mark member 375. If the mark member 375 is detected, i.e., if absence of the printing plate 50 on the plate cylinder 3 is detected, in accordance with the command signal from the microprocessor 21, the control system inhibits the plate-holding rollers 539 shown in FIG. 7 from coming into contact with the plate cylinder 3. This rollers 539 remained in contact with the plate cylinder 3 while the plate feeding and discharging operation was underway. This inhibitive operation applied to the rollers 539 securely prevents them from coming into contact with the plate cylinder 3 on which no printing plate 50 is wound. Consequently, it is possible for the printing press to securely prevent the plate cylinder 3 from being soiled by ink adhered to the plate-holding rollers 539.

(10) Mechanical operation when error takes place with the plate-head holding operation (I)

Immediately after stopping the plate forwarding operation using the plate-feeding driving rollers 510 and 520 shown in FIG. 6 whle operating the printing press, the detection means made of encoder and the like detects the rotation of both rollers 510 and 520. If no rotation is detected from these rolers 510 and 520, in other words, if the plate-head clamping nails 312 don't hold the plate head, the control system instantly stops the rotation of motor 20 on the part of the printing press shown in FIG. 1 so that the printing operation can be terminated on the way. As a result, it is possible for the entire printing system to securely prevent a variety of failures and defects from unexpectedly occuring while executing printing operations, which include the following: ink-soiled plate cylinder 3 caused by direct contact of the form roller with the plate cylinder 3 when the plate is incorrectly wound onto it, or damage of the plate incorrectly wound onto the plate cylinder 3 and/or failure incurring to the printing press itself due to unwatned insertion of the printing plate 50 into the machine mechanism, and the like.

(11) Function of the "R" provided portion of plate cylinder

As shown in FIG. 29, corners of the plate-head contacting surface 369 and the external circumferential surface 372 of the plate cylinder 3, and the corners of the aperture edge surface 373 of the plate-end side and the external circumferential surface 372 of the plate cylinder 3 are respectively provided with "R" configurations. As a result, even when the printing plate base is made of highly rigid materials such as polyester film, aluminum, or steel, and the like, it is possible for the printing press 1 to tightly wind the printing plate 50 onto the plate cylinder 3 without deviating its position. More particularly, first, the lead edge 50*a* is tightly pressed against the plate-head contacting surface 369 using the plate-head clamping nails 312, and then, when the printing plate 50 is tightly wound onto the external circumferential surface 372 of the plate cylinder 3 using the plate-holding rollers 525, the printing plate 50 smoothly proceeds over the R-curved surface, thus allowing the printing plate 50 to be closely wound onto the plate cylinder 3. On the other hand, when the tail edge 50*c* is latched by being pulled in the direction of the aperture 307 of the plate cylinder 3 using the plate-end hooks 317, the printing plate 50 is closely wound onto the plate cylinder 3 by proceeding itself over the R-curved surface on the part of the plate end, thus allowing the printing plate 50 to be eventually and accurately wound onto the designated position of the plate cylinder 3 without deviating its position at all. Furthermore, since the printing plate 50 doesn't leave the external surface of the plate cylinder 3, the surface of the printing plate 50 is securely prevented from incurring soil otherwise caused by unwanted contact between the surface of the printing plate 50 and the form roller.

(12) System for controlling the plate-feeding speed

Figure 32:
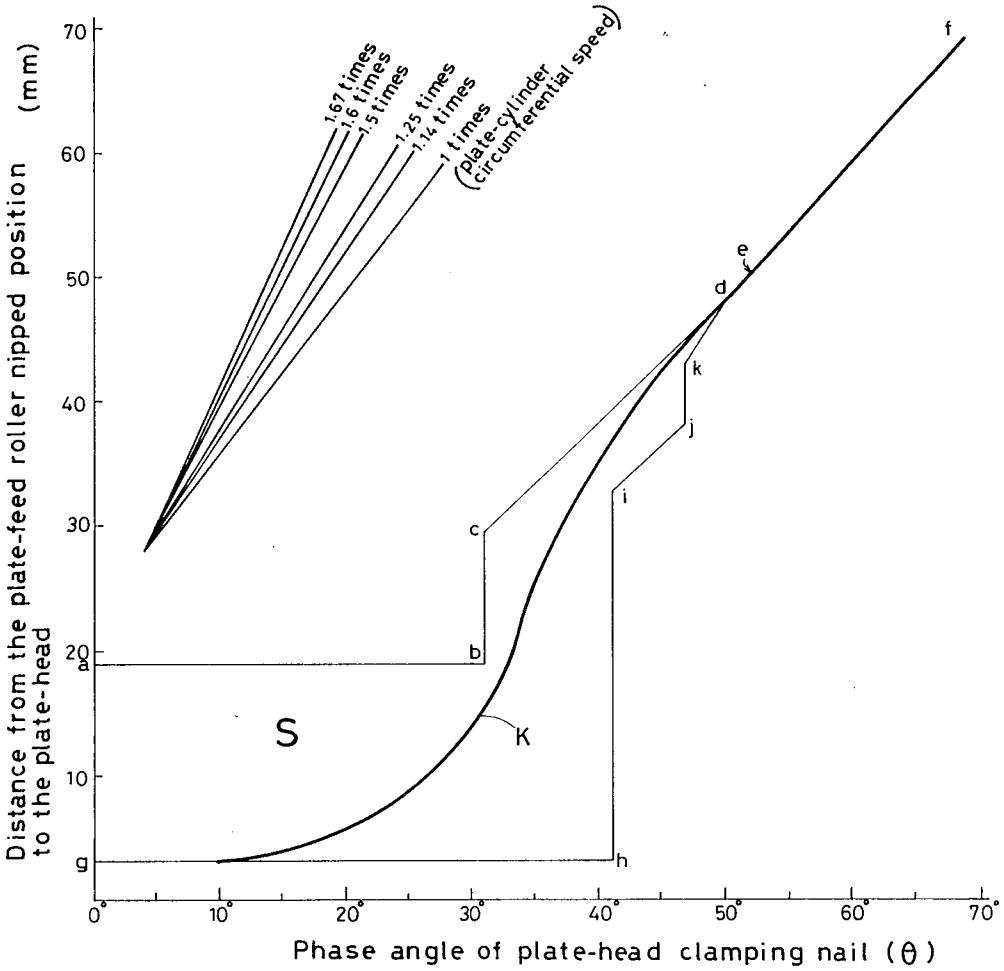
FIG. 32 denotes a track of a lead edge generated by an ideal control method.

Next, the system for controlling the plate-feeding operation is described below. FIG. 32 is a representation of the allowable range of the plate-head track needed for allowing the plate-head holding mechanism to securely lock the printing plate 50 delivered from the plate-feeding mechanism of the printing press incorporating the plate-head holding mechanism and the plate-feeding mechanism. In FIG. 32, the vertical axis denotes the distance from the point at which is plate-feeding rollers execute nipping operation, i.e., the point where the plate-feeding driving rollers 510 shown in FIG. 36 and the auxiliary plate-feeding driving rollers 520 nip the printing plate 50, to the position of the lead edge 50*a*, whereas the horizontal axis denotes the phase-angle $\theta$ of the plate-head clamping nails 312 against the pivot of the rotation of the plate cylinder 3 shown in FIG. 36(*a*).

When setting the vertical and horizontal axis as described above, the allowable range of the plate-head track can be determined as described below. First, the horizontally straight line "a" through "b" is determined to denote the limit for preventing the lead edge 50*a* from hitting against the tip end of the plate-head clamping nails 312. On the other hand, since the plate-head clamping nails 312 are provided with the curved guide plate 374 shown in FIGS. 7 and 36 in the farthest position of the plate-pressing surface using the nail shaft 311 for the center of its curvature, the line "c" through "d" extending to position "e" is then determined to denote the limit for allowing entry of the lead edge 50*a* into space 368 shown in FIG. 36 (*g*). In addition, the horizontally straight line "g" through "h" is determined to denote the still condition of the printing plate 50 (i.e., the condition in which the printing plate is securely set in position) at the position where the lead edge 50*a* is slightly out of the nipped point. The straight line "i" through "j" is also determined to denote the limit for preventing the lead edge 50*a* from hitting against the pin 315 shown in FIG. 36 (*g*) of the plate cylinder 3. In addition, the straight line "k" through "d" is determined to denote the limit for allowing the plate-head clamping nails 312 to close themselves by causing the plate-head holes 50*d* to align itself with the pin 315 of the plate cylinder 3. Consequntly, in order to correctly hold the lead edge 50*a*, the plate end 50*c* should reach the position (point "e") at which the plate-head clamping nails 312 completes its closing operation after passing through the area S surrounded by the lines - a- b- c- d -k - j - i - h - g - a. Note that the plate-head track denoted by straight line "e" through "f" represents the condition in which the clamped plate 50 is tightly pulled.

Now, in order to correctly and smoothly clamp the plate head using the printing press provided with the plate-head tracking allowable area S described above, a variety of conditions should fully be satisfied, which are described below.

(1) When activating the plate feeding operation, the printing plate 50 should smoothly be accelerated. Then, the plate-feeding speed should be raised to the designated high level within the shortest period of time while preventing the printing plate 50 from incurring even the slightest slip between the plate-feeding driving rollers 510 and the auxiliary plate-feeding driving rollers 520.

Figure 36:
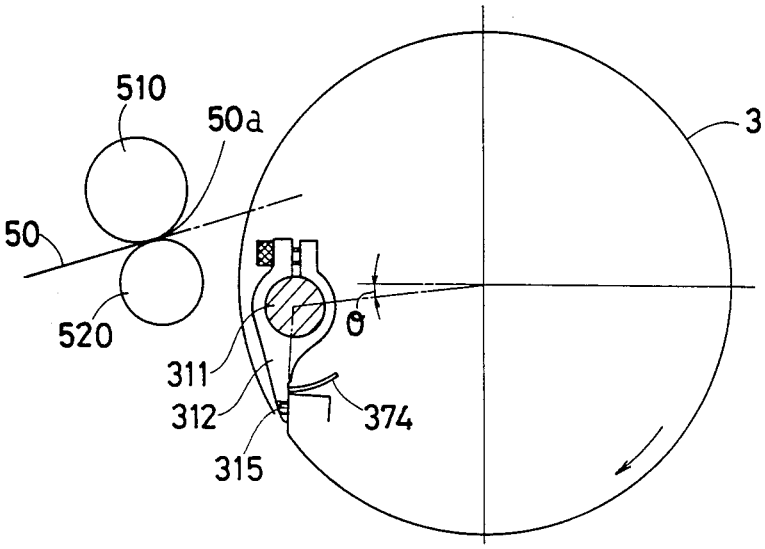
FIGS. 36 (*a*) through (*j*) respectively explain the operations for holding a lead edge.
Figure 36:
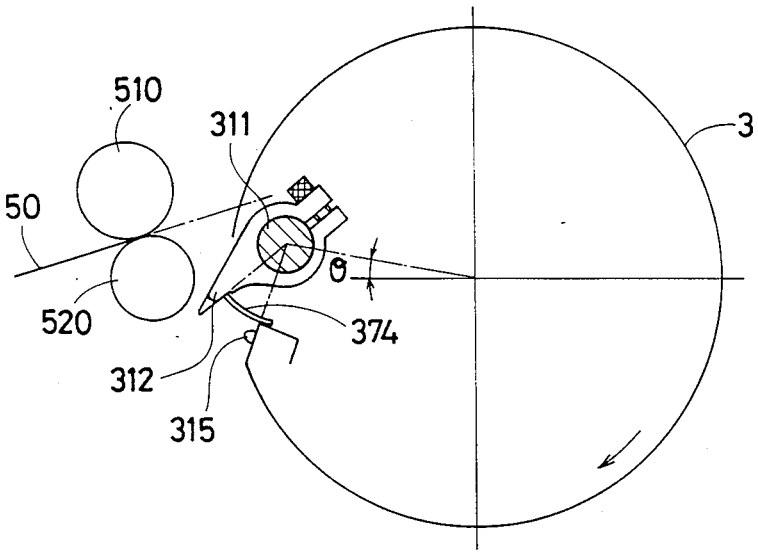
Figure 36:
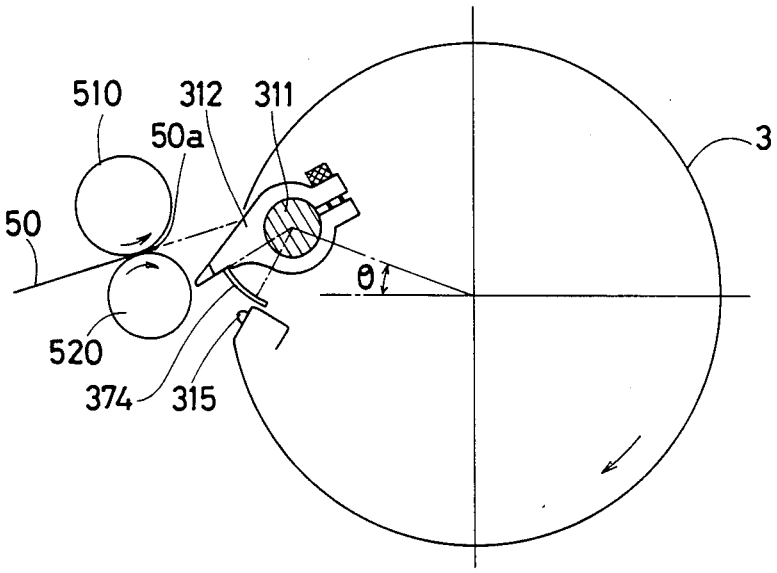
Figure 36:
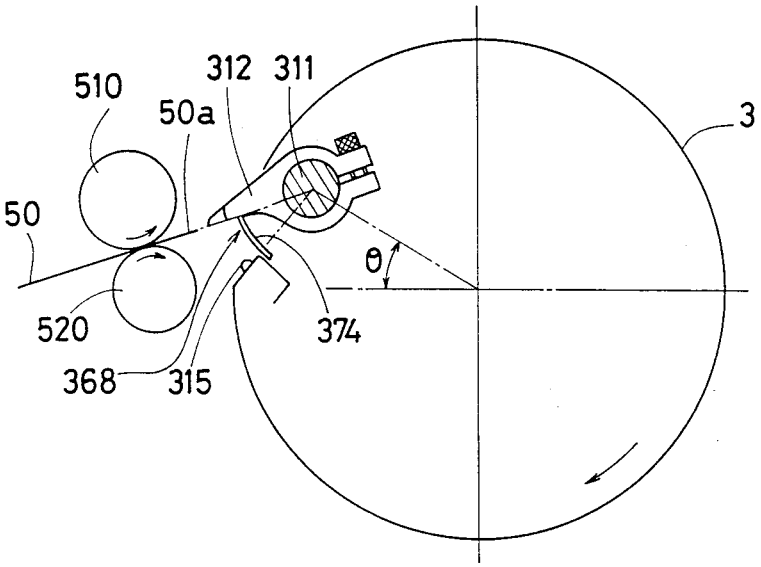
Figure 36:
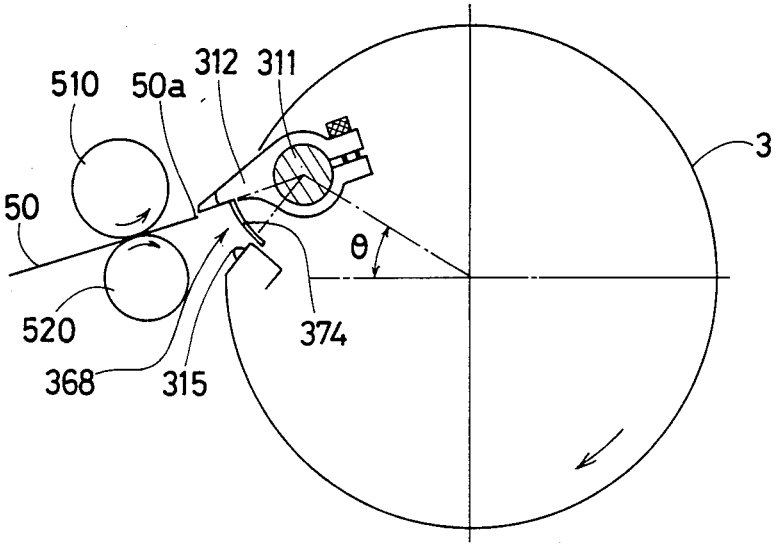
Figure 36:
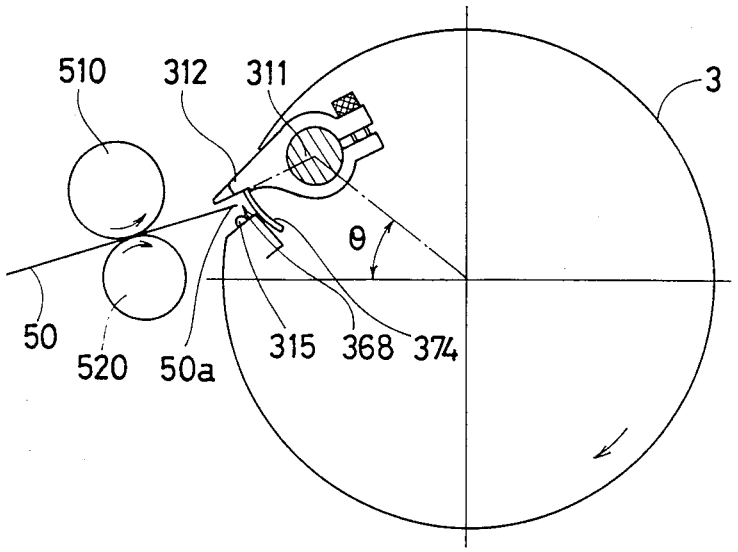
Figure 36:
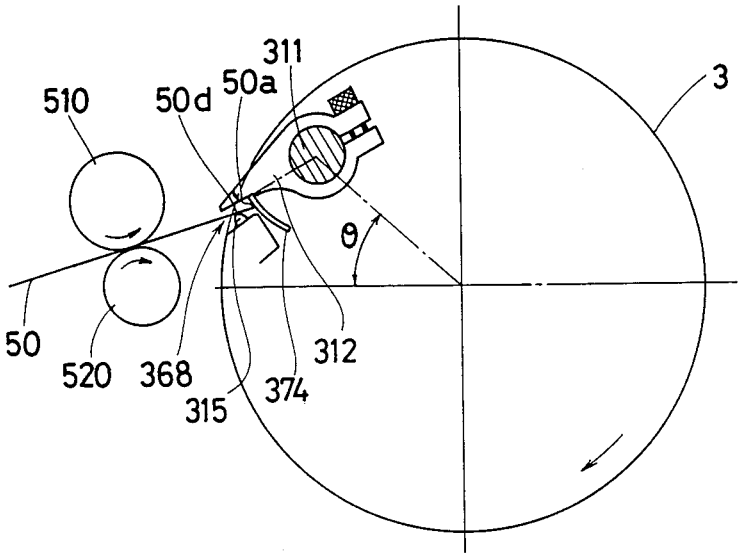
Figure 36:
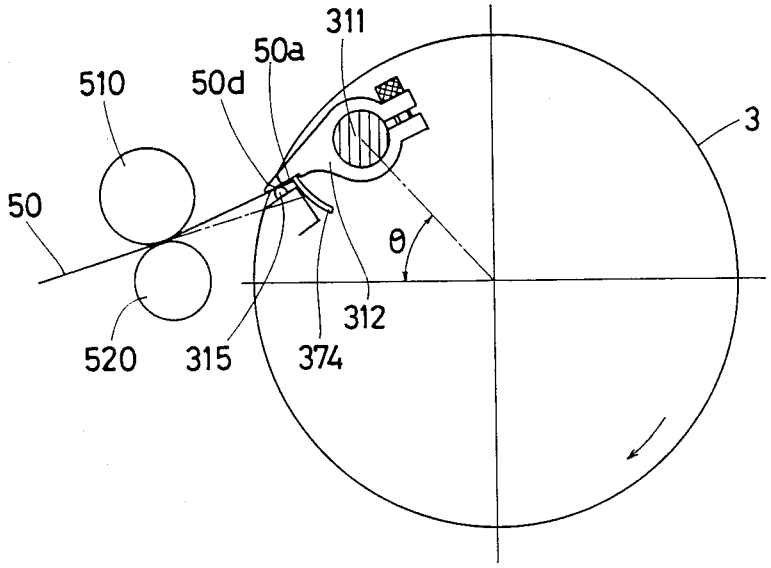
Figure 36:
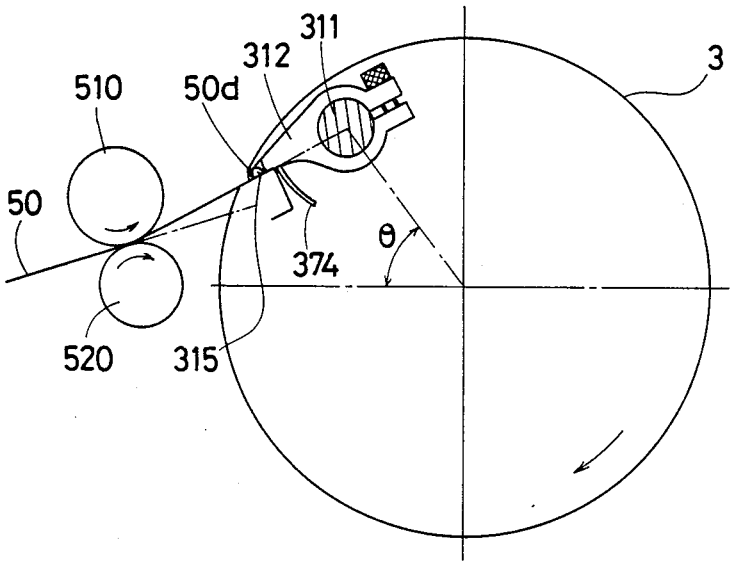
Figure 36:
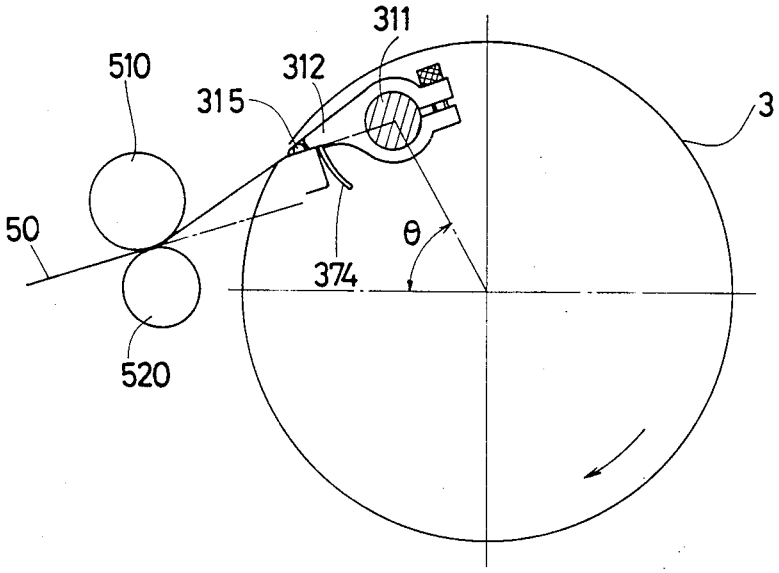
Figure 37:
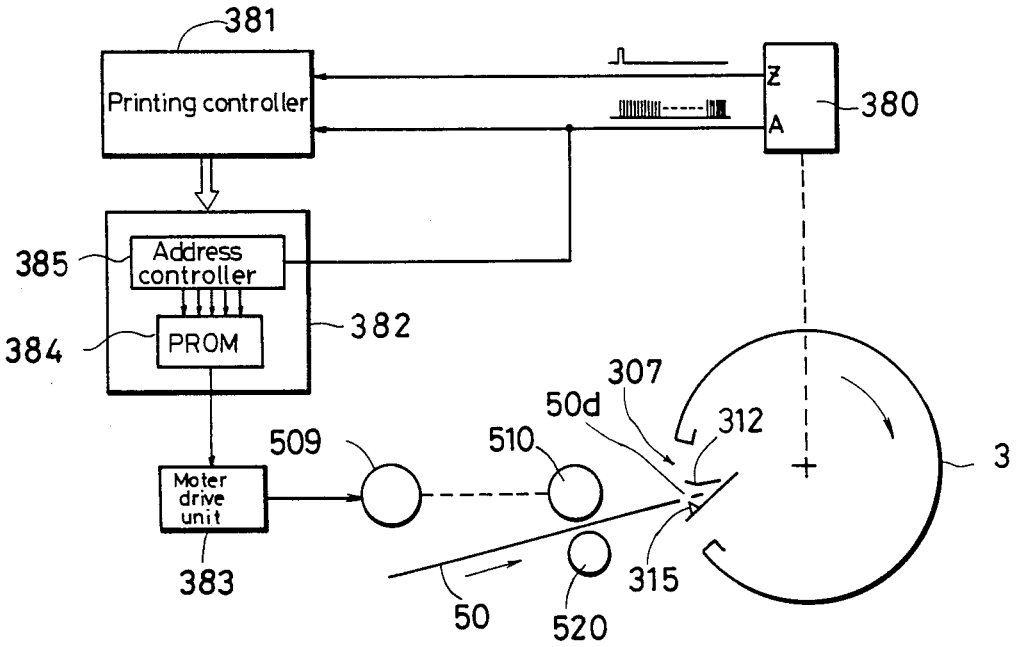
FIG. 37 is a simplified block diagram of an automatic plate-feeding controller.

(2) As soon as the tip end of the plate-head clamping nails 312 passes through the extended point of the plate track as shown in FIG. 36 (*e*), the printing plate 50 should be forwarded to space 368 of the plate-head clamping nails 312 at a very high speed. Then, while decelerating its speed, the printing plate 50 should softly be landed on the designated plate-holding position. This expands the flexibility of the plate-forwarding timing, thus providing a highly dependable printing press capable of effectively dealing with the stain and the wear taking place with both the plate-feeding driving rollers 510 and the auxiliary plate-feeding driving rollers 520, the stain of the printing plate 50, and the difference of the surface condition and rigidity of the printing plates themselves.

(3) The relative speed of the printing plate 50 itself when hitting against the curved guide plate 374 should be reduced to minimize possible damage incurring from shock applied.

(4) After hitting against the curved guide plate 374, the distance of forwarding the printing plate should be minimized to prevent the printing plate 50 from generating noticeable slack. This is particularly important when using such the printing plates which are relatively rigid and/or vulnerable to collapse caused by the slack.

The curved line "K" shown in FIG. 32 denotes an ideal track of the plate head fully satisfying those requirements (1) through (4) described above. Concretely, the lead edge 50*a* is delivered from the position exactly above the straight line "g" through "h" without generating slip at all. The lead edge 50*a* then passes through the area S before smoothly arriving at the point "d", and finally, it is forwarded at a specific speed corresponding to the line "e" through "f".

However, actually, it is rather difficult to allow the lead edge 50*a* to smoothly land onto the ideal position denoted by the curved line "K". To compensate for this, the preferred embodiment executes the plate-feeding control by providing conditions described below.

(I) The feeding operation of the printing plate 50 remains activated until the plate-head clamping nails 312 fully closes themselves.

(II) Amount of the slack generated by the shock from the contact of the lead edge 50*a* against the curved guide plate 374 should not exceed a maximum of 2 millimeters. However, since the curved guide plate 374 is set to the position which is remote from the lead edge by about 1 millimeter, the allowable amount of the slack of the printing plate 50 should actually be a maximum of 1 millimeter.

Now, therefore, taking the above requirements (I) and (II) into account, the plate-feeding speed control system reflecting the preferred embodiment of the present invention is described below in comparison with one of the conventional systems for controlling the plate-feeding speed.

Figure 33:
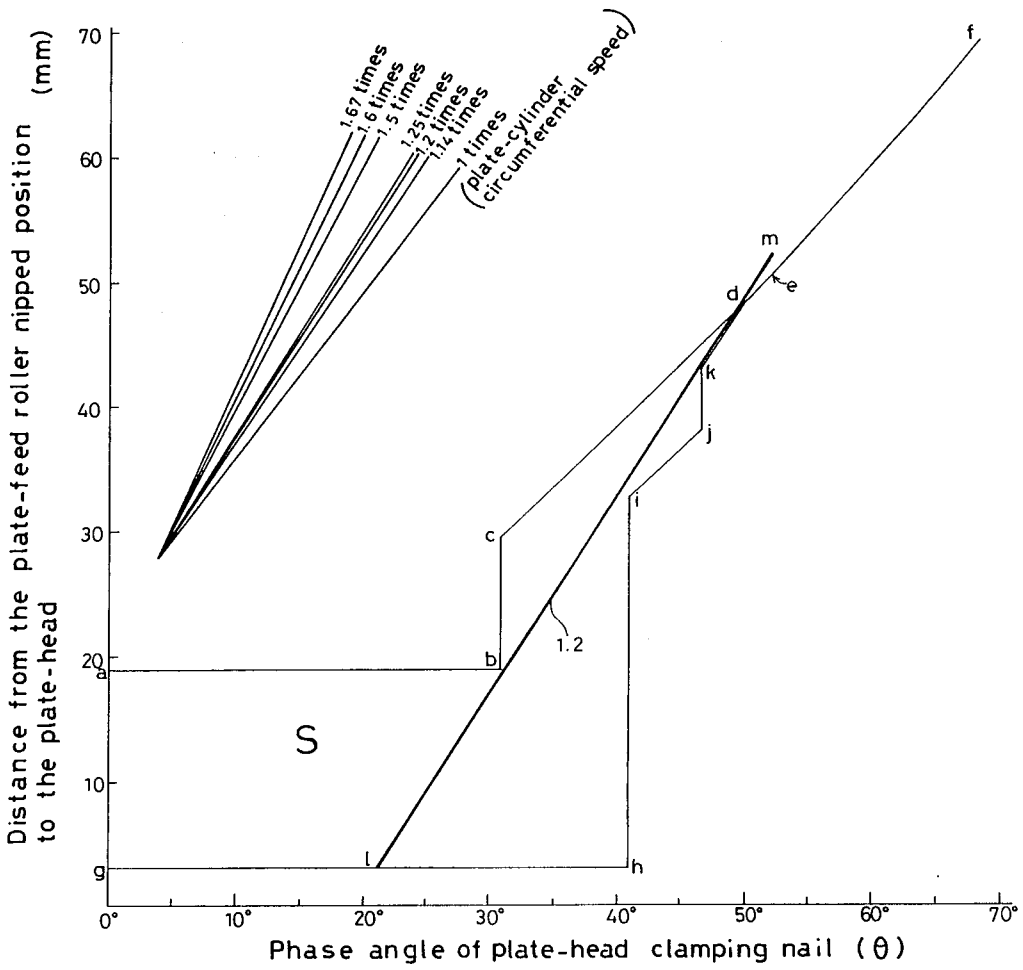
FIG. 33 is a characteristics chart denoting a track of a lead edge generated by a conventional control method.

As shown in FIG. 33, the conventional speed control system feeds printing plate 50 at a constant speed from the start-up of the plate forwarding operation to the completion of the plate holding operation. According to this conventional speed control system, the track l through m capable of narrowly executing plate-holding operation is applicable by setting the plate-feeding speed at 1.2 times the speed of the rotation of the plate cylinder 3. However, even if the track l through m deviates to the left by the least distance, the printing plate 50 hits against the plate-head clamping nails 312 at point "b", thus not plate-holding operation can be implemented. Conversely, even if the track 1 through m deviates to the right by the least distance, the holes of the printing plate 50 collapses between the line "k" through "d". If the track 1 through m deviates to the right furthermore, the printing plate 50 hit against the register pins 315 at position "i", thus eventually inhibiting the execution of the plate-holding operation. As a result, any conventional control system merely provides the plate-head tracks with a relatively narrow range workable. Actually, any of those conventional plate-feeding speed-control systems cannot accurately hold the printing plates during the printing operation.

Figure 34:
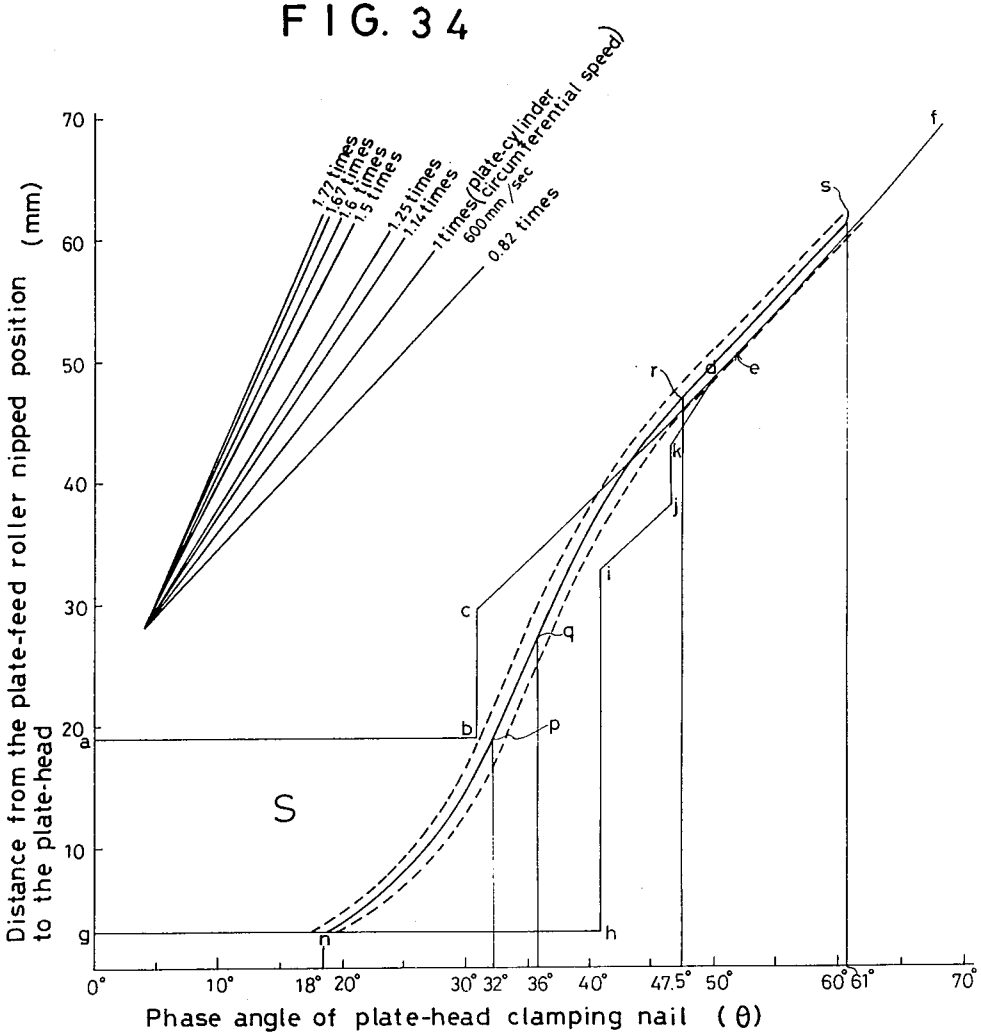
FIG. 34 is a characteristic chart denoting a track of a lead edge generated by a control method embodied by the present invention.
Figure 35:
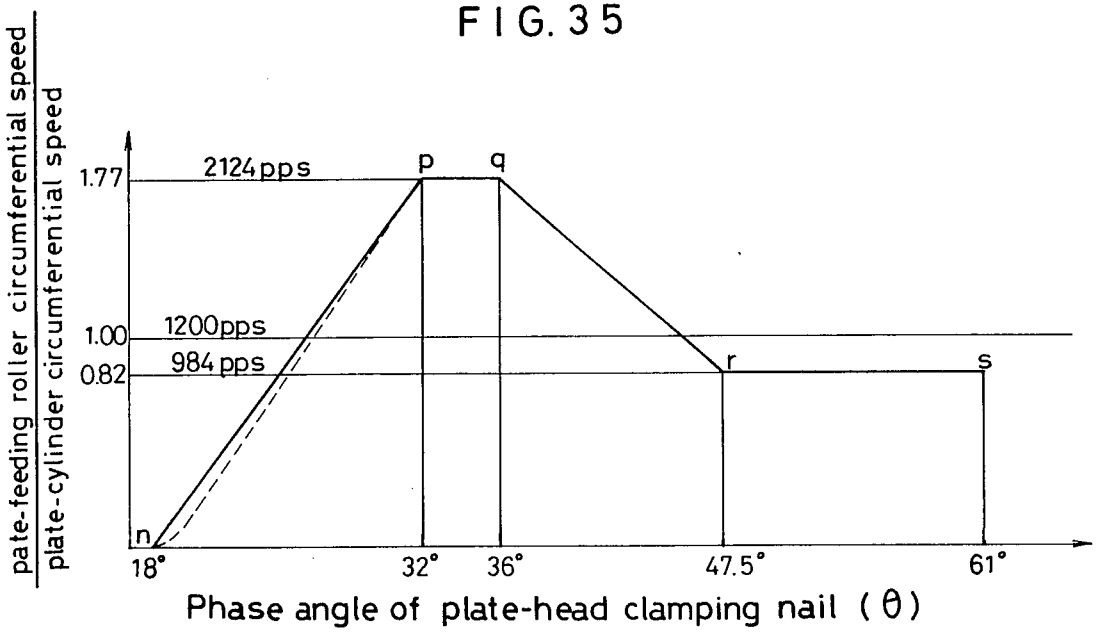
FIG. 35 is a chart denoting characteristics for controlling a plate-forwarding speed needed for realizing the lead edge track shown in FIG. 34.

Conversely, the plate-feeding speed-control system reflecting the preferred embodiment of the present invention accurately controls the plate feeding operation in accordance with the tracks "n - p - q - r - s" shown in FIG. 34, and the system accurately stops the plate-feeding operation at the designated position s. FIG. 35 denotes a relationship of the plate-feeding speed-control effects needed for realizing the tracks shown above. In FIG. 35, the horizontal axis denotes the phase-angle $\theta$ of the plate-head clamping nails 312, whereas the vertical axis denotes the ratio of the circumferential speed of the plate-feeding roller against the circumferential speed of the plate cylinder 3. In this case, the angle of the rotation of pulse motor 509 shown in FIG. 3 (*d*) per pulse is 1.8°/pulse, whereas the circumferential speed of the plate-feeding roller per pulse is 0.5 mm/pulse, whereas the circumferential speed of the plate cylinder 3 is 600 mm/second, respectively, and therefore, the circumferential speed of the plate-feeding roller is equal to that of the plate cylinder 3 when the plate-feeding roller rotates at 1200PPS of the circumferential speed.

Next, the plate-feeding operation executed by the plate-feeding speed-control system embodied by the present invention is described below. FIG. 36 (*a*) denotes the state in which the plate cylinder 3 is at −6.5 of the phase angle, where the closed plate-head clamping nails 312 are at a position close to the line extended from the plate track. The plate-feeding driving rollers 510 remain still at this moment.

Next, as shown in FIG. 36 (*b*), when the plate cylinder 3 rotates to the position corresponding to 10° of the phase angle, the plate-head clamping nails 312 open themselves to stand by for executing the plate feeding-/discharging operations.

Next, as shown in FIG. 36 (*c*), when the plate cylinder 3 rotates to the position corresponding to 18° of the phase angle, the main plate-feeding driving rollers 510 and the auxiliary plate-feeding driving rollers 520 respectively start to rotate for activating the plate-feeding operation. Then, as shown by the line n through p of FIG. 35, the plate-feeding speed is accelerated at a constant rate until the phase angle $\theta$ reaches 32°. When the phase angle $\theta$ is exactly at 32°, the plate-feeding speed reaches 1.77 times the circumferential speed of the plate cylinder 3. This allows the speed of feeding the printing plate 50 to be smoothly accelerated as shown by track n through p of FIG. 34 so that the plate feeding speed can reach the predetermined high level within the shortest period of time without causing slip to be generated between the plate-feeding driving rollers 510 and the auxiliary plate-feeding driving rollers 520. To securely prevent the printing plate 50 from slipping itself at the start-up moment, as shown by the broken line of FIG. 35, the plate-feeding operation may be started with a relatively slow speed.

FIG. 36 (*d*) denotes the state in which the phase angle $\theta$ is at 30.2° while gradually accelerating the moving speed of the printing plate 50 itself and the tip end of the plate-head clamping nails 312 is exactly at the line extended from the track of the printing plate 50. FIG. 36 (*e*) denotes the state in which the tip end of the plate-head clamping nails 312 passes through the track-extended line of the printing plate 50 when the phase angle $\theta$ is 30.5°, thus enabling the plate head 50*a* to proceed into the space 368 at a still further accelerated speed.

Now, when the phase angle $\theta$ is exactly at 32°, as shown by the track p through q of FIGS. 34 and 35, the plate-feeding speed is then switched to a constant level corresponding to 1.77 times the circumferential speed of the plate cylinder 3. In otherwords, while the constant speed is maintained, the lead edge 50*a* still proceeds itself into the space 368 at a constant speed faster than the circumferential speed of the plate cylinder 3.

Then, as soon as the phase angle $\theta$ of the plate-head clamping nails 312 reaches 36°, as shown by the track q through r of FIG. 35, the plate-feeding speed is decelerated at a constant rate until the phase angle $\theta$ reaches 47.5°. When the phase angle $\theta$ is exactly at 47.5°, the plate-feeding speed is controlled so that it exactly corresponds to 0.82 times the circumferential speed of the plate cylinder 3. As a result, as shown by the track q through r of FIG. 34, the plate-feeding speed is gradually decelerated to allow the lead edge 50*a* to softly reach the predetermined plate-holding position.

FIG. 36 (*f*) denotes the state in which the plate head 50*a* proceeds into the space 368 using the gradually decelerated speed when the phase angle $\theta$ is exactly at 38.5°, thus causing the plate-head clamping nails 312 to close themselves. FIG. 36 (*g*) denotes the state in which, when the phase angle $\theta$ is exactly at 41°, the lead edge 50*a* reaches the position of the curved guide plate 374 after passing through the space 368 at a still decelerated speed. FIG. 36 (*h*) denotes the state in which, when the phase angle $\theta$ is exactly at 47°, the plate-head clamping nails 312 close themselves to the position right above the register pins 315 so that the plate-head holes 50*d* can be engaged with register pins 315. Since the lead edge 50*a* is allowed to come into contact with the curved guide plate 374 at a reasonably decelerated speed, the lead edge 50*a* can securely be prevented from incurring the damage otherwise to be caused by impact from the curved guide plate 374. After coming into contact with the curved guide plate 374, the lead edge 50*a* is first forwarded so that it generates the slack by about 1 mm before reaching the designated position "r".

Now, when the phase angle $\theta$ reaches 47.5°, as shown by the track r through s of FIGS. 34 and 35, the plate-feeding speed is switched to a constant level corresponding to 0.82 times the circumferential speed of the plate cylinder 3. While the plate-feeding speed remains constant, the lead edge 50*a* is delivered to the position s bearing about 1 mm of the slack. Also, while the plate-feeding speed remains constant, as shown in FIG. 36 (*i*), the plate-head clamping nails 312 fully closes themselves at the moment when the phase angle $\theta$ is exactly at 52.5°, thus allowing the plate-head holes 50*d* to be fully engaged with the register pins 315.

Next, when the phase angle $\theta$ reaches 61° denoted by the state shown in FIG. 36 (*j*), as shown in FIGS. 34 and 35, the printing plate 50 is pulled by the rotation force of the printing plate cylinder 3. This causes pulse motor 509 shown in FIG. 3 (*d*) which is substantially the plate-forwarding motor itself to rotate in conjunction with the movement of the printing plate 50. Slack which is present in the printing plate 50 is offset by its own tensile force.

The functions of the plate-feeding speed-control system related to the present invention ae summarized according to respective procedures as shown below. First, the acceleration step applied to the trak n through p of FIG. 35 is indispensable for smoothly leading the lead edge 50*a* into the space 368. To realize this, the speed-control system feeds the plate cylinder 3 without generating slip between the plate-feeding rollers. The constant-speed step applied procedure in conjunction with the track p through g is also indispensable for allowing the lead edge 50*a* to proceed to the farthest position of the space 368. It should be noted however that the lead edge 50*a* may not always be led into the farthest position of the space 368 at a constant speed, and therefore, the constant-speed step is not always indispensable. On the other hand, the deceleration step applied to the track g through r is quite necessary for smoothly leading the lead edge 50*a* into the predetermined position inside of the space 368 while effectively preventing the lead edge 50*a* from forcibly hitting against the curved guide plate 374. Likewise, the constant-speed step applied to the track r through s is also quite necessary for allowing the plate-head clamping nails 312 to securely hold the lead edge 50*a* by latching the lead edge 50*a* at the predetermined position inside of the space 368 until the plate-head clamping nails 312 fully close themselves. In addition, the plate feeding stopping step beyond the position s is also quite necessary for offsetting the slack generated on the printing plate 50.

When executing the plate-feeding speed-control step described above, it is possible for the control system to allow unevenness related to the start-up timing and the speed of plate-feeding operation within the range defined by the plate-head tracks shown by means of the broken lines on both sides of the track n through s of FIG. 34. It is also possible for the speed-control system to properly adjust the relative speed of the plate-head tracking movement at the time of crossing the track c through d of FIG. 34 to be either equal to or slower than the conventional constant-speed applied control system. As a result, it is possible for the system related to the present invention to smoothly and stably hold the printing plate 50 without generating considerable slack.

To securely realize the significantly improved accuracy of the plate feeding operation, the preferred embodiment of the present invention introduces the constitution described below. To correctly identify the reference signal related to the timings needed for properly controlling the plate-feeding speed, the reference rotary encoder 380 corresponding to the sensor/switch means 26 shown in FIG. 2 is connected to the supporting shaft 302 of the plate cylinder 3, which may be substituted by the supporting shaft 302 of the blanket cylinder 2. In accordance with the rotation of the plate cylinder 3, the encoder 380 generates the signal Z of one pulse in each full turn of the plate cylinder 3 and the signal A comprised of 240 pulses per inch (ppi) against the external circumference of the plate cylinder 3. The timing reference signal Z is delivered to the printing controller 381 corresponding to the microcomputer 21 shown in FIG. 2, whereas the other timing reference signal A is inputted to the printing controller 381 and the motor controller 382 which corresponds to the control parts 23 shown in FIG. 2.

In response to these incoming reference signals Z and A, the printing controller 381 first computer the timing needed for controlling the feeding operation of printing plate 50, and then generates the timing command signals such as the plate-feeding start-up command and/or the plate-feeding termination command to the motor controller 382.

On receipt of the plate-feeding start-up command signal from the printing controller 381, the motor controller 382 delivers the plse motor 509 drive signal to the motor driver unit 383. Likewise, on receipt of the plate-feeding termination command signal from the printing controller 381, the motor controller 382 delivers the motor stop command signal to the motor driver unit 383. More particularly, the data needed for controlling the plate feeding speed is stored in PROM 384 (programmable read-only memory) of the motor controller 382. On receipt of the plate-feeding start-up command signal from the printing controller 381, in response to the timing reference signal A output from the reference rotary encoder 380, the data stored in PROM 384 is sequentially accessed in order of address via the address controller 385, thus allowing the pulse train signal having the specific pulse intervals corresponding to the predetermined speed characteristics to be delivered to the motor driver unit 383. Details of the pulse train signal are described later on.

The motor driver unit 383 first amplifies the plse train signal from the motor controller 382 before activating pulse motor 509 which is made available for operating the plate-feeding driving rollers 510.

Next, referring now to the timing chart shown in FIG. 38 and the operation chart shown in FIG. 39, the functional operations of the printing press is described below. Before the printing controller 381 generates the plate-feeding command signal, the printing plate 50 is set to the designated position so that the tip end of the lead edge of the printing plate 50 can be set to point P between the plate-feeding driving rollers 510 and 520 shown in FIG. 39. Next, the operator activates the printing press to rotate the plate cylinder 3 in the arrowed direction at a constant speed. Then, the operator inputs the plate-feeding command to the printing controller 381 by operating the plate-feeding button present in the operation control panel of the printing press. When the plate-feeding command signal is activated, the printing plate 50 is nipped by the plate-feeding driving rollers 510 and 520 before the printing controller 381 executes the operation for controlling the delivered plates described below.

Figure 38:
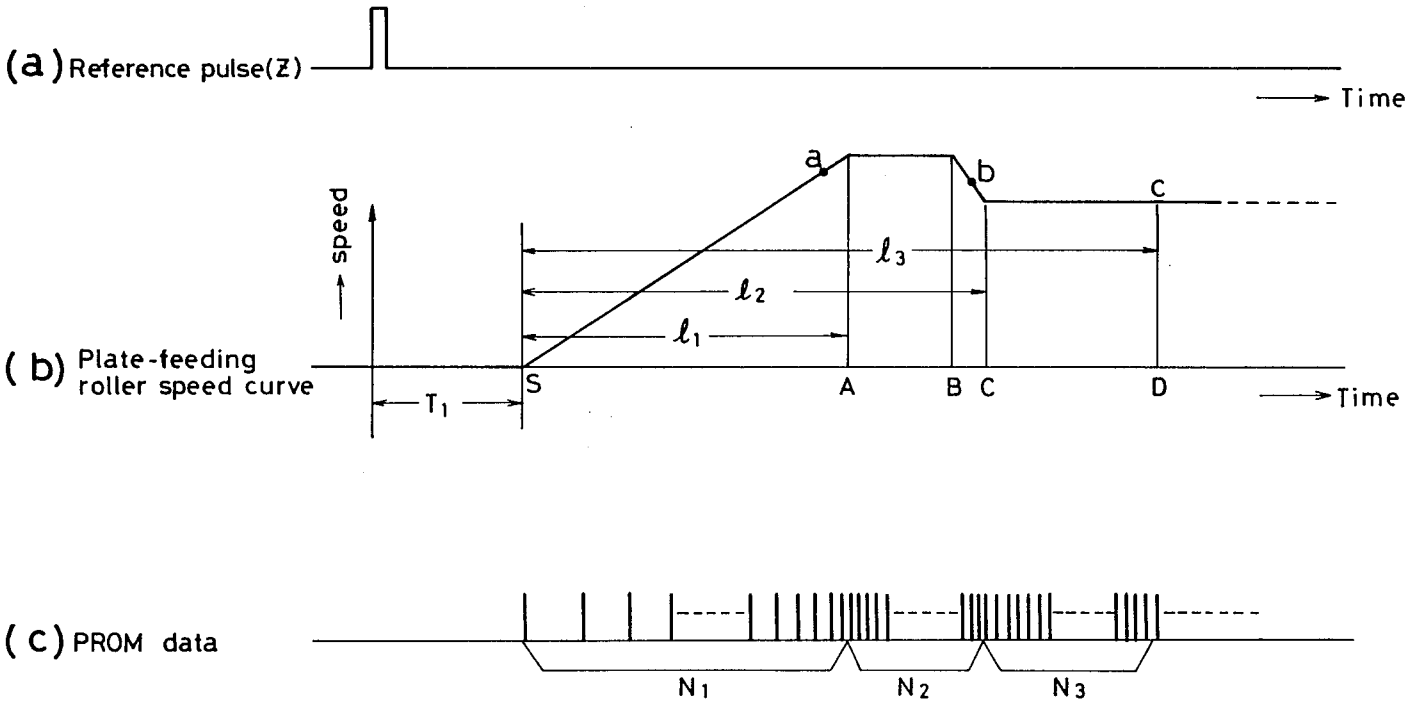
FIGS. 38 (*a*) through (*c*) are respectively the timing charts explaining the control operations of an automatic plate-feeding controller.

First, when the plate cylinder 3 is set to the predetermined rotation phase, the reference rotary encoder 380 delivers the reference signal Z shown in FIG. 38 (*a*) to the printing controller 381. Based on th moment when the reference signal Z is received, the printing controller 381 starts to count the signal A and then generates the operation start-up command the signal when counting up a specific value corresponding to the predetermined time "$t_{20}$" shown in FIG. 38 (*b*). The start-up command signal is delivered to the motor controller 382, which is then activated to read the speed-control data from PROM 384 via address controller 385 in accordance with the signal A from the reference rotary encoder 380.

The speed-control data is described below. A consideration is given to the plate-feeding operation in reference to the speed curve shown in FIG. 38 (*b*) for example. In conjunction with the speed curve, the acceleration period ranging from the start-up position S to the position A is quite important for smoothly leading the lead edge 50*a* into the space 368 between the open plate-head clamping nails 312 and the register pins 315. To securely realize this, the printing plate 50 is fed by using a specific speed faster than the circumferential speed of the plate cylinder 3 without generating slip at all between the plate-feeding driving rollers 510 and 520. The constant-speed period from the position A to position B is also quite important for allowing the lead edge 50*a* to correctly proceed into the farthest position of the space 368. Likewise, the deceleration period between the position B and the position C is quite important for leading the lead edge 50*a* to the predetermined plate-holding position by preventing the lead edge 50*a* from forcibly hitting against the guide plate 374 present in the farthest position of the space 368. Finally, the constant-speed period ranging from the position C to the position D is also quite important for allowing the plate-head clamping nails 312 to correctly hold the lead edge 50*a* at the predetermined position in the farthest position of the space 368 until the plate-head clamping nails 312 fully close themselves. Note that the distances ($l_1$, $l_2$ and $l_3$) ranging from the starting point S to the designated points A, B and C shown in FIG. 38 (*b*) respectively denote the moving distance of the printing plate 50 starting from the plate-head feeding position shown in FIG. 39, point P, in which the distance $l_1$ is 20 mm, $l_2$ is 35 mm and $l_3$ is 50 mm.

Figure 39:
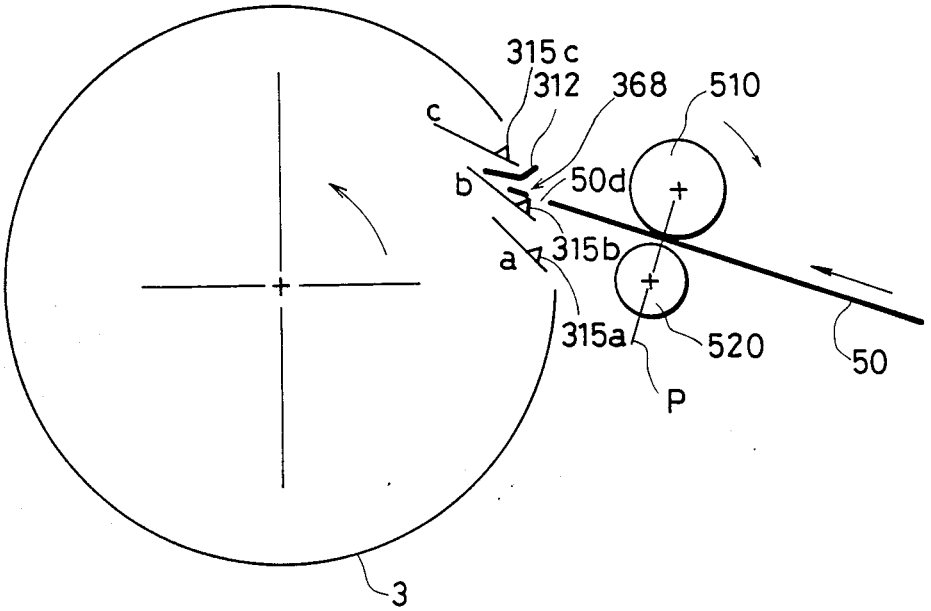
FIG. 39 explains a plate-feeding operation executed by the automatic plate-feeding controller shown in FIG. 38.

FIG. 39 is the chart denoting the plate feeding operation executed by applying the speed curve described above. The register pins 315*a*, 315*b* and 315*c* of the plate cylinder 3 shown in FIG. 39 respectively denote positions corresponding to the points A, B and C related to the speed curve shown in FIG. 38 (*b*). Concretely, the point A denotes the state in which the closed plate-head clamping nails 312 pass through the position right above the plate-feeding line, whereas the point B denotes the state in which the head of the register pins 315*b* pass through the position right above the plate-feeding line. Then, the plate head is inserted into the farthest position of the space 368 so that the holes 50*d* of the lead edge 50*a* is correctly led to the position of the positioning pins 315*b*. On the other hand, the point C denotes the state in which the register pins 315*c* are engaged with the holes 50*d* of the printing plate 50, and yet, the plate-head clamping nails 312 close themselves up to the head position of the register pins 315*c*. When the plate cylinder 3 rotates furthermore while the above state is present, the plate-head clamping nails 312 fully close themselves, thus completing the entire operations relates to the plate-feeding driving using the plate feeding rollers 510 and 520.

The data needed for securely realizing the speed curves described above is obtainable by executing the following operations. Assume that, when a pulse is delivered to the pulse motor 509, the printing plate 50 is forwarded by the plate-feeding driving rollers 510 and 520 by 0.5 mm of the distance. When this condition is present, since the distance $l_1$ between the points S and A is 20 mm, at least 40 pulses as the pulse-value $N_1$ are needed for this range. Likewise, since the distance between $l_1$ and $l_2$ is 15 mm, at least 30 pulses as the pulse-value $N_2$ are needed for the range between points A through C. Also, since the distance between $l_2$ and $l_3$ is 15 mm, at least 30 pulses as the pulse-value $N_3$ are needed for the range between the points C and D. Since the distance between the points S and A corresponds to the area designated for acceleration of the speed, the intervals of these pulses are gradually shortened. Conversely, since the distance between the points A and B corresponds to the area designated for applying the constant speed, the intervals of these pulses are equally provided. On the other hand, since the distance between the points B and C corresponds to the area designated for deceleration of the speed, the intervals of these pulses are gradually widened. Conversely, since the distance between the points C and D corresponds to the area designated for applying the contant speed, the intervals of these pulses are equally provided. PROM 384 stores the plate-feeding speed-control data generating the pulse train signal shown in FIG. 38 (*c*). The plate-feeding speed-control data containing the above pulse train signal are accessed by the printing controller 381 in accordance with the plate-feeding start-up command from the printing controller 381 and the reference signal A from the reference rotary encoder 380 as well before delivery to the motor driver unit 383.

On receipt of the pulse train signal, the motor driver unit 383 first amplifies the data before driving pulse motor 509. As a result, the plate-feeding driving rollers 510 rotate at a speed corresponding to the pulse train signal so that the printing plate 50 can smoothly be delivered in accordance with the predetermined speed curve shown in FIG. 38 (*b*).

As soon as the plate-head holding operation is completed by the plate-head holding mechanism, the printing-operation terminating command signal is outputted to the motor controller 382 in accordance with a specific timing which can be identified by counting the signal A as in the case of time "$t_{20}$". In response to this, the motor controller 382 delivers the plate-feeding terminating command signal to the motor driver unit 383 to eventually terminate the plate-feeding operation executed by the plate-feeding driving rollers 510 and 520. After terminating the plate-feeding operation with the plate-feeding driving rollers 510 and 520, the printing plate 50 is then drawn out following the rotation of the plate cylinder 3 before being wound onto it.

Using these plate-feeding driving rollers 510 and 520, the printing press starts to feed the printing plate 50 in accordance with the signal Z from the reference rotary encoder 380 set to the supporting shaft 302 of the plate cylinder 3. While the plate-feeding operation is underway, the plate-feeding speed is properly controlled in accordance with the plate-feeding speed-control data read from PROM 384. Using the constitution thus being described, the plate-feeding system accurately feeds the printing plate 50 to the predetermined position of the plate cylinder 3, and as a result, while preventing the plate head 50*a* from incorrectly being held, the system ensures high accuracy in executing the plate feeding operation. In addition, since the plate-feeding speed control data can be read out of PROM 384 in accordance with the reference signal A from the reference rotary encoder 380, even when the speed of the rotation of the plate cylinder 3 varies, the plate-feeding speed of the plate-feeding driving rollers 510 and 520 correctly follows the varied speed of the rotation of the plate cylinder 3 so that it also varies, thus securely improving the accuracy in the plate feeding operation furthermore. Note that when the plate cylinder 3 rotates at a constant speed, for example, when it is rotated at a constant speed by other control means, it is also possible for the present system to use either the signal from another stable oscillator like crystal oscillator for example or the signal output from an oscillator used for the control unit for controlling the rotation of the plate cylinder 3 i.e., the blanket cylinder 2, in place of the reference signal A from the reference rotary encoder 380. Even when using the substitutive signals mentioned above, the plate-feeding speed control system related to the present invention can securely realize accurate control of the plate-feeding speed by correctly matching the rotation phase of the plate cylinder 3 as is done with the above preferred embodiments.

Figure 40:
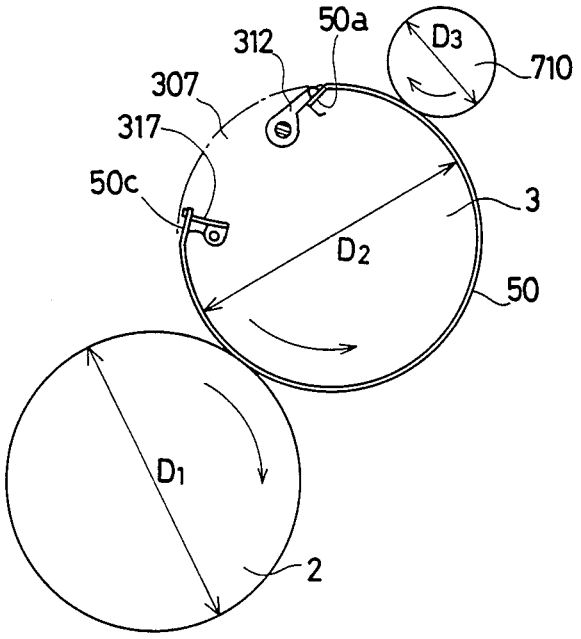
FIG. 40 is a diagram denoting the relationship between a plate-cylinder, a blanket cylinder, and a form roller in the case of executing normal printing operations.

(13) Provision of the circumferential speed of the plate cylinder and the blanket cylinder FIG. 40 is the schematic chart denoting the relationship of the plate cylinder 3, the blanket cylinder 2, and the form roller 710 while normal printing operation is underway. As shown in FIG. 40, normal printing operation is done by placing the plate cylinder 3 in contact with the blanket cylinder 2 and the form roller 710 in contact with the plate cylinder 3 for allowing the blanket cylinder 2, the plate cylinder 3, and the form roller 710 to be respectively rotated in the arrowed directions. The blanket cylinder 2, the plate cylinder 3, and the form roller 710 are connected to each other by the gear means engaged with each other at one-end of these units, while these gears are driven by the main motor set to the printing press. The diameters $D_1$, $D_2$ and $D_3$ of the blanket cylinder 2, the plate cylinder 3 and the form roller 710, are respectively designed so that the circumferential speeds of the blanket cylinder 2 and the form roller 710 are slightly faster than that of the plate cylinder 3. In this case, since the blanket cylinder 2 and the form roller 710 are made of the elastic material such as rubber, the diameters $D_1$, $D_2$ and $D_3$ are respectively determined in consideration of true roll measure. Assume that diameter $D_2$ is determined to be 153.35 mm for example, by designing $D_1$ to be 152.9 mm and $D_3$ to be 60.3 mm, respectively, both cylinders 2, 3 and the form roller 710 will be provided with the circumferential speed which is almost equal to each other. Considering these, this preferred embodiment introduces the following constitution, in which the diameter $D_1$ is determined to be 153.2 mm and $D_3$ to be 60.5 mm against 153.2 mm of the diameter $D_2$, thus providing slightly larger diameters. This provides the blanket cylinder 2 and the form roller 710 with reasonable circumferential speeds which are slightly faster than that of the plate cylinder 3. These diameters denote one of the preferred embodiments of the present invention, and thus, any diameter other than those which are shown above may freely be chosen.

The constitution of the plate-feeding mechanism thus far described generates a variety of advantageous effects, which are described below. First, when the blanket cylinder 2 and the form roller 710 respectively run over the external surface of the plate cylinder 3 after passing through the aperture 307 of the plate cylinder 3, due to the extraction force applied to the printing plate 50, the lead edge 50*a* may slightly be pulled by the plate-head clamping nails 312. However, even if the lead edge 50*a* may be pulled outward slightly, since the preferred embodiment of the invention reasonably determined diameters $D_1$, $D_2$ and $D_3$ of the blanket cylinder 2, the plate cylinder 3, and the form roller 710 as described above, when the blanket cylinder 2 and the form roller 710 respectively rotate over the external surface of the plate cylinder 3, the specific force is applied to the printing plate 50 so that it can be pushed backed in the direction of the plate head 50*a*. As a result, the printing plate 50 is brought back to its original position, thus securely preventing the plate head 50*a* from being disengaged from the plate-head clamping nails 312 while executing the printing operation for a long time. In addition, the lead edge 50*c* is elastically held by the energized force from the spring means of the plate-end hooks 317. As a result, even when the printing plate 50 deviates its position due to either pulling or push-back force mentioned above, such deviation can effectively be absorbed by the spring means without obstructing the plate-end holding operation at all.

(14) Mechanical operation when error takes place will the plate-head holding operation (II)

As was described earlier in conjunction with "(10) Mechanical operation when error takes place with the plate-head holding operation (I)", the present embodiment provides means for detecting the presence and/or absence of the rotation of the plate-feeding driving rollers 510 and 520. If no rotation is detected, the microprocessor 21 identifies that the plate-head clamping nails 312 don't hold the plate head 50*a*, and then causes the motor 20 of the printing press shown in FIG. 1 to instantly stop the operation. In this case, inactivation of the motor 20 can also be realized by employing the constitution described below. Concretely, using the sensor 544 shown in FIG. 7, the presence or absence of the printing plate 50 is again checked when the tail edge edge portion is completely drawn out of the plate-feeding table 901 at the moment between time "$t_{16}$" and "$t_{17}$". If the lead edge is correctly latched by the plate-head clamping nails 312, it indicated that the new plate 50 is already drawn out of the plate-feeding table 901, thus the presence of new plate 50 cannot be detected. If this is identified, the plate feeding and discharging operation is continuously executed. Conversely, if the plate-head clamping nails 312 don't hold the head of the new plate 50, the new plate 50 still remains on the plate-feeding table 901, thus allowing the sensor 544 to detect the presence of the new plate 50. If this is detected, the microprocessor 21 shown in FIG. 2 generates the command signal to cause the motor 20 of the printing press shown in FIG. 1 to instantly stop its operation.

Thus, if the lead edge don't be hold by the plate-head clamping nails 312 engaged with either the plate cylinder 3 or 4, this faulty operation is quickly detected by the sensor 544 on the way of feeding and/or discharging plate operation, thus instantly stopping the motor 20 of the printing press itself. This emergency remedy means effectively prevents a variety of unwanted failures including the following: stained the plate cylinder 3 or 4 due to contact with the form roller while the printing plate is incorrectly wound onto either of these plate cylinders 3 and 4, damaged the printing plate and/or braked the printing press due to unwanted entry of printing plate 50 into the printing press itself. In addition, since the plate feeding/discharging system embodied by the present invention detects the failure of the plate-winding operation using the sensor 544 for selecting the plate feeding/discharging or the plate discharging operation, the plate-feeding system related to the present invention dispenses with provision of an addition sensor for detecting the failure of the plate-winding operation, thus eventually allowing itself to correctly and quickly detect the failure of the plate-winding operation by applying simplified constitution.

Note that the preferred embodiment of the present invention thus described can effectively applied not only to a two-color printing press, but also to a multicolor printing press incorporating more than three units of the plate cylinders.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing press for automatically feeding a printing plate having a lead edge portion provided with a plurality of register holes, and at least two sides extending from the lead edge portion, comprising:

a printing press body;

a plate cylinder mounted to said printing press body:

a plurality of register pins provided at said plate cylinder and adapted to engage said register holes;

a first driving motor for driving said plate cylinder;

a plate feeding unit installed in said printing press body;

a plate feeding tray having a positioning part means for guiding to set said at least two sides of the printing plate on a predetermined position of the plate feeding tray, said plate feeding tray being installed in said plate feeding unit;

a plate forwarding mechanism including at least one plate-feeding driving roller provided at said plate feeding unit to advance the printing plate positioned on said plate feeding unit;

a second driving motor for driving said plate-feeding driving roller;

means for imparting a driving command signal to said first driving motor;

means for generating a plate-feeding command signal;

means for outputting a rotation phase detecting signal in relation to a rotation phase of said plate cylinder;

means for imparting a plate-feeding start-up command signal for driving said plate-feeding driving roller with said second driving motor in response to said plate-feeding command signal when a rotation phase of said plate cylinder detected by said rotation phase detecting signal reaches a predetermined rotation phase; and means for controlling a rotating speed of said plate-feeding driving roller on the basis of said rotation phase detecting signal so that said register pins engage with said register holes after commencement of plate-feeding by said plate-feeding driving roller.

2. A printing press in accordance with claim 1, further comprising:

second detection means for detecting either presence or absence of the rotation of the plate-feeding driving roller of said plate-forwarding mechanism after a rotation phase of said plate cylinder detected by said rotation phase detecting signal reaches a prescribed rotation phase at which said printing plate is mounted on said plate cylinder by said plate-forwarding mechanism; and first control means for stopping the first driving motor of the printing press when no rotation of said plate-feeding driving roller is detected by said second detection means.

3. A printing press in accordance with claim 1, further comprising:

said outputting means including means for generating a first reference signal related to the rotation phase of said plate cylinder;

wherein plate feeding start-up command signal imparting means includes means for outputting the plate-feeding start-up command signal at predetermined timings on receipt of said first reference signal; and wherein said controlling means includes means for controlling said second driving motor based on speed control data and including memory means for containing said speed control data read by said driving operation controlling means from said memory means sequentially on receipt of said plate-feeding start-up command signal.

4. A printing press in accordance with claim 3, wherein:

an operation for reading said speed control data from said memory means is executed as a result of a second reference signal corresponding to a pulse train output in relation to the rotation phase of said plate cylinder.

5. A printing press in accordance with claim 1, wherein said plate cylinder has right and left sides and said printing plate includes a lead edge portion, and further comprising:

a nail shaft provided rotatably between said left and right sides of the plate cylinder;

a plate-head holding member fixed to said nail shaft and for pressing the lead edge portion of the printing plate against the plate cylinder by a rotation of said nail shaft while being separated from the plate cylinder by the opposite rotation of said nail shaft;

a first spring means provided inside of the plate cylinder for energizing said plate-head holding member in a plate pressing direction;

a first link fixed at one end thereof to one end of said nail shaft extending through one side of the plate cylinder;

a second link rotatably mounted at one end thereof adjacent an external surface of one side of the plate cylinder, said second link carrying first and second rollers being respectively provided at a central portion and at the other end of the second link;

a second spring means provided between said second link and the external surface of one side of the plate cylinder to energize said second link in a direction such that said second roller engages with the other end of said first link;

a plate feeding/discharging cam rotatably provided at one end thereof on said printing press body;

a lock-lever rotatably provided at one end thereof on said printing press body for locking said plate feeding/discharging cam at a position such that said first roller runs onto a working face of said plate feeding/discharging cam, the lock-lever unlocking said plate feeding/discharging cam by movement of the other end of the lock-lever caused by said first roller; and a lock driving means for setting said plate feeding-/discharging cam to a lock-position by said lock-lever;

said first roller running on and moving along the working face of said plate feeding/discharging cam in conjunction with the rotation of said plate cylinder in a state wherein said plate feeding/discharging cam is locked;

said first link causing rotation of said nail shaft by being pushed itself by said second roller in conjunction with rotation of said plate cylinder to thereby drive said plate head holding member in a closing direction.

6. A printing press in accordance with claim 5, further comprising:

a third link rotatably provided at one end thereof at an external surface of one side of the plate cylinder and formed with a slotted hole at a central portion thereof;

a fourth link connected rotatably at one end thereof to the other end of said first link with the other end of the fourth link being connected rotatably to the other end of said third link by a pin;

a stopper fixed to the external surface of one side of the plate cylinder so that the stopper engages with said third link at a position wherein said pin moves slightly toward a center of said plate cylinder from a line connecting a rotating center in one end of said third link and a rotating center in one end of the fourth link;

a fifth link rotatably provided at one end thereof at the external surface of one side of the plate cylinder with third and fourth rollers being respectively provided at a central portion and the other end thereof, said fourth roller engaging with the slotted hole of said third link; and a lock-cam fixed to said printing press body;

said fifth link rotating toward a rotating center of said plate cylinder as said third roller runs on said lock-cam in conjunction with rotation of said plate cylinder to thereby cause said fourth roller to move along said slotted hole, said stopper engaging with said third link as said pin moves slightly toward a rotating center of said plate cylinder from the line connecting the rotating center in one end of said third link and the rotating center in one end of said fourth link in conjunction with movement of said fourth roller along said slotted hole, said first roller imparting a turning effect in a closing direction of said plate head holding member to said nail shaft by engaging said third link with said stopper.

7. A printing press in accordance with claim 6, further comprising:

a sixth link rotatably provided at a central portion thereof at the other end of said second link and fifth and sixth rollers being respectively provided at one end and the other end thereof;

said fifth roller causing said sixth link to rotate by running on the working face of said plate feeding-/discharging cam in conjunction with rotation of said plate cylinder;

said sixth roller pushing said second link out in conjunction with rotation of said plate cylinder so that said pin moves toward a peripheral part of said plate cylinder across the line connecting the rotating center in one of said third link and the rotating center in one end of said fourth link.

8. A printing press in accordance with claim 1, wherein said printing plate has a plurality of plate end holes at a tail edge portion thereof, said plate cylinder further comprising:

an aperture formed on a barrel part of said plate cylinder;

a hook shaft provided between right and left sides of said plate cylinder in an inward portion of said aperture;

a plurality of plate-end hooks rotatably provided on said hook shaft to engage with said plate-end holes of said printing plate mounted on to the barrel part of said plate cylinder; and a spring means for energizing said plate-end hooks in the direction such that the tail edge portion of the printing plate mounted on the barrel part of said part cylinder is pulled into said aperture.

9. A printing press in accordance with claim 8, further comprising:

first detection means for detecting the rotational position of the plurality of said plate-end hooks prior to detecting an incorrectly wound plate after a rotation phase of said plate cylinder detected by said rotation phase detecting signal reaches a prescribed rotation phase at which said printing plate is mounted on said plate cylinder.

10. A printing press in accordance with claim 1, further comprising:

a plurality of plate cylinders;

said first driving motor for driving said plate cylinders;

a plurality of plate-feeding means provided adjacent said plate cylinders;

a plurality of sensors for detecting presence or absence of printing plates mounted on said plate-feeding means respectively;

means for detecting presence or absence of each printing plate mounted on said each plate-feeding means by said each sensor in response to said plate-feeding command signal;

means for activating only said plate-feeding means detecting the presence of said each printing plate, to feed the detected each printing plate to said each plate cylinder;

means for re-detecting presence or absence of a subsequent printing plate mounted on said each plate-feeding means by said each sensor after a rotation phase of said each plate cylinder detected by said rotation phase detecting signal gets to a prescribed rotating phase at which said each printing plate is mounted on said each plate cylinder; and means for stopping said first driving motor only when the presence of at least a piece of printing plate is re-detected by means for re-detecting presence or absence said each printing plate.

11. A method of controlling a plate-feeding operation in a printing press having a printing press body; a plate cylinder provided on said printing press body; a plurality of register pins provided on said plate cylinder; a first driving motor for driving said plate cylinder; a plate-feeding unit installed in said printing press body; a plate feeding tray installed in said plate-feeding unit and having a positioning part for guiding to set at least two sides of a printing plate on a prescribed position of the plate feeding tray; a plate-feeding driving roller provided at said plate-feeding unit to advance the printing plate positioned on said plate feeding unit; a second driving motor for driving said plate-feeding driving roller; means for imparting a driving command signal to said first driving motor; means for generating a plate-feeding command signal; and means for outputting a rotation phase detecting signal in relation to a rotation phase of said plate cylinder; said method comprising the steps of:

positioning the printing plate provided with a plurality of register holes at a lead edge portion thereof into the plate-feeding unit;

generating a plate-feeding command signal;

providing a plate-feeding start-up command signal for driving said plate-feeding driving roller with said second driving motor in response to said plate-feeding command signal when a rotation phase of said plate cylinder detected by said rotation phase detecting signal reaches a predetermined rotation phase; and controlling a rotating speed of said plate-feeding driving roller on the basis of said rotation phase detecting signal so that said register pins engage with said register holes after start of plate-feeding by said plate-feeding driving roller.

12. A method of plate feeding operation of a printing press in accordance with claim 11, further comprising:

an acceleration step that activates the plate-feeding operation at the predetermined rotation position of said plate cylinder after opening a plate-head holding member set to said plate cylinder before eventually leading said lead edge portion into a plate-insertion space between said plate-head holding member and said plate cylinder by raising the plate-feeding speed of the plate-feeding driving roller to a predetermined level faster than the circumferential speed of said plate cylinder;

a deceleration step that decelerates the plate-feeding speed to a level almost corresponding to the circumferential speed of said plate cylinder after completing said acceleration step so that said lead edge portion can be led to the predetermined position in the farthest position of said plate-insertion space;

a constant speed step that keeps the plate-feeding speed at a specific level almost equal to the circumferential speed of said plate cylinder until said plate-head holding member fully closes itself after completing said deceleration step; and a stop step that stops the plate-feeding operation after completing said constant-speed step.

13. A method of plate feeding operation of a printing press in accordance with claim 11, further comprising:

a first step which, in response to a plate feeding/discharging command signal, releases a plate-head holding operation accomplished by a plate-head holding means at a first rotational position of said plate cylinder with respect to a first printing plate wound onto said plate cylinder;

a second step which, after completing said first step, allows said plate-head holding means to lock the lead edge portion of a second printing plate at a second rotation position of said plate cylinder while drawing out said first plate from said plate cylinder using plate extraction means and simultaneously feeding said second printing plate to said plate cylinder using plate-forward means;

a third step which, after completing said second step, unlocks a tail edge portion of said first printing plate from the state locked by said plate-holding means at a third rotation position of said plate cylinder and causes said first plate to be drawn out of said plate cylinder using said plate extraction means; and a fourth step which, after completing said third step, causes a tail edge portion of said second printing plate wound onto said plate cylinder to be locked by plate-end holding means.

* * * * *